US008412502B2

(12) United States Patent
Moncorge et al.

(10) Patent No.: US 8,412,502 B2
(45) **Date of Patent: *Apr. 2, 2013**

(54) SYSTEM AND METHOD FOR PERFORMING OILFIELD SIMULATION OPERATIONS

(75) Inventors: Arthur Regis Catherin Moncorge, Houston, TX (US); Hamdi A. Tchelepi, Belmont, CA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 160 days.

This patent is subject to a terminal disclaimer.

(21) Appl. No.: 12/960,059

(22) Filed: Dec. 3, 2010

(65) Prior Publication Data

US 2011/0077922 A1 Mar. 31, 2011

Related U.S. Application Data

(63) Continuation of application No. 11/859,722, filed on Sep. 21, 2007, now Pat. No. 7,877,246.

(60) Provisional application No. 60/846,702, filed on Sep. 22, 2006.

(51) Int. Cl.
*G06G 7/58* (2006.01)
*G06F 19/00* (2011.01)

(52) U.S. Cl. ..... 703/10; 702/13

(58) Field of Classification Search ..... 703/10; 702/13

See application file for complete search history.

(56) References Cited

U.S. PATENT DOCUMENTS

| | | | |
|---|---|---|---|
| 5,930,762 | A | 7/1999 | Masch |
| 5,992,519 | A | 11/1999 | Ramakrishnan et al. |
| 6,018,497 | A | 1/2000 | Gunasekera |
| 6,052,520 | A | 4/2000 | Watts, III |
| 6,078,869 | A | 6/2000 | Gunasekera |
| 6,106,561 | A | 8/2000 | Farmer |
| 6,230,101 | B1 | 5/2001 | Wallis |
| 6,313,837 | B1 | 11/2001 | Assa et al. |
| 6,662,146 | B1 | 12/2003 | Watts |
| 6,775,578 | B2 | 8/2004 | Couet et al. |
| 6,980,940 | B1 | 12/2005 | Gurpinar et al. |
| 7,164,990 | B2 | 1/2007 | Bratvedt et al. |
| 2003/0132934 | A1 | 7/2003 | Fremming |
| 2003/0216897 | A1 | 11/2003 | Endres et al. |
| 2004/0220846 | A1 | 11/2004 | Cullick et al. |
| 2005/0149307 | A1 | 7/2005 | Gurpinar et al. |

(Continued)

FOREIGN PATENT DOCUMENTS

| | | | |
|---|---|---|---|
| GB | 2336008 | A | 10/1999 |
| WO | 9964896 | A1 | 12/1999 |

(Continued)

OTHER PUBLICATIONS

Coats, K.H., "IMPES Stability: The CFL Limit," SPE Journal, Sep. 2003, pp. 291-297.

(Continued)

*Primary Examiner* — Dwin M Craig

(57) ABSTRACT

The invention relates to a method of performing an oilfield operation of an oilfield having at least one wellsite, each wellsite having a wellbore penetrating a subterranean formation for extracting fluid from an underground reservoir therein. The method includes determining a time-step for simulating the reservoir, the reservoir being represented as a plurality of gridded cells and being modeled as a multi-phase system using a plurality of partial differential equations, calculating a plurality of Courant-Friedrichs-Lewy (CFL) conditions of the reservoir model corresponding to the time-step, the plurality of CFL conditions comprising a temperature CFL condition, a composition CFL condition, and a saturation CFL condition, simulating a first cell of the plurality of gridded cells with an Implicit Pressure, Explicit Saturations (IMPES) system, and simulating a second cell of the plurality of gridded cells with a Fully Implicit Method (FIM) system.

19 Claims, 31 Drawing Sheets

U.S. PATENT DOCUMENTS

| | | | |
|---|---|---|---|
| 2006/0129366 | A1 | 6/2006 | Shaw |
| 2006/0184329 | A1 | 8/2006 | Rowan et al. |
| 2006/0197759 | A1 | 9/2006 | Fremming |
| 2007/0112547 | A1 | 5/2007 | Ghorayeb et al. |

FOREIGN PATENT DOCUMENTS

| | | | |
|---|---|---|---|
| WO | 0140937 | A1 | 6/2001 |
| WO | 2004049216 | A1 | 6/2004 |
| WO | 2005122001 | A1 | 12/2005 |

OTHER PUBLICATIONS

Coats, K.H., "A Note on IMPES and Some IMPES-Based Simulation Models," SPE, Journal 5, Sep. 2000, pp. 245-251, vol. 3.

Peaceman, D.W., "A Nonlinear Stability Analysis for Difference Equations Using Semi-Implicit Mobility," SPE 5735, Feb. 1977, pp. 79-91.

Thomas, G.W. and Thurnau, D.H., "Reservoir Simulation Using an Adaptive Implicit Method," Society of Petroleum Engineers Journal, Oct. 1983, pp. 759-768.

Coats, K.H., "IMPES Stability: Selection of Stable Timesteps," SPE Journal, Jun. 2003, pp. 181-187.

Peaceman, Donald W., "Fundamentals of Numerical Reservoir Simulation," 1977, pp. 45-81, Chapters 3 and 4, Elsevier Scientific Publishing Company, Amsterdam, The Netherlands.

Aziz, Khalid and Settari, Antonin, "Petroleum Reservoir Simulation," 1979, pp. 138-150, Chapter 5.4, Applied Science Publishers LTD, London.

SYSTEM AND METHOD FOR PERFORMING OILFIELD SIMULATION OPERATIONS

CROSS REFERENCE TO RELATED APPLICATIONS

This is a continuation application and claims benefit under 35 U.S.C. §120 of U.S. patent application Ser. No. 11/859,722, filed on Sep. 21, 2007, which, pursuant to 35 U.S.C. §119(e), claims priority to U.S. Provisional Patent Application No. 60/846,702, filed on Sep. 22, 2006, the disclosure of which is hereby incorporated by reference

BACKGROUND

1. Field of the Invention

The present invention relates to techniques for performing oilfield operations relating to subterranean formations having reservoirs therein. More particularly, the invention relates to techniques for performing oilfield operations involving an analysis of reservoir operations, and the techniques impact on such oilfield operations.

2. Background of the Related Art

Oilfield operations, such as surveying, drilling, wireline testing, completions, simulation, planning, and oilfield analysis, are typically performed to locate and gather valuable downhole fluids. Various aspects of the oilfield and its related operations are shown in FIGS. 1A-1D. As shown in FIG. 1A, surveys are often performed using acquisition methodologies, such as seismic scanners to generate maps of underground structures. These structures are often analyzed to determine the presence of subterranean assets, such as valuable fluids or minerals. This information is used to assess the underground structures and locate the formations containing the desired subterranean assets. Data collected from the acquisition methodologies may be evaluated and analyzed to determine whether such valuable items are present, and if they are reasonably accessible.

As shown in FIG. 1B-1D, one or more wellsites may be positioned along the underground structures to gather valuable fluids from the subterranean reservoirs. The wellsites are provided with tools capable of locating and removing hydrocarbons from the subterranean reservoirs. As shown in FIG. 1B, drilling tools are typically advanced from the oil rigs and into the earth along a given path to locate the valuable downhole fluids. During the drilling operation, the drilling tool may perform downhole measurements to investigate downhole conditions. In some cases, as shown in FIG. 1C, the drilling tool is removed and a wireline tool is deployed into the wellbore to perform additional downhole testing.

After the drilling operation is complete, the well may then be prepared for production. As shown in FIG. 1D, wellbore completions equipment is deployed into the wellbore to complete the well in preparation for the production of fluid therethrough. Fluid is then drawn from downhole reservoirs, into the wellbore and flows to the surface. Production facilities are positioned at surface locations to collect the hydrocarbons from the wellsite(s). Fluid drawn from the subterranean reservoir(s) passes to the production facilities via transport mechanisms, such as tubing. Various equipment may be positioned about the oilfield to monitor oilfield parameters and/or to manipulate the oilfield operations.

During the oilfield operations, data is typically collected for analysis and/or monitoring of the oilfield operations. Such data may include, for example, subterranean formation, equipment, historical and/or other data. Data concerning the subterranean formation is collected using a variety of sources.

Such formation data may be static or dynamic. Static data relates to, for example, formation structure and geological stratigraphy that define the geological structure of the subterranean formation. Dynamic data relates to, for example, fluids flowing through the geologic structures of the subterranean formation over time. Such static and/or dynamic data may be collected to learn more about the formations and the valuable assets contained therein.

Sources used to collect static data may be seismic tools, such as a seismic truck that sends compression waves into the earth as shown in FIG. 1A. These waves are measured to characterize changes in the density of the geological structure at different depths. This information may be used to generate basic structural maps of the subterranean formation. Other static measurements may be gathered using core sampling and well logging techniques. Core samples may be used to take physical specimens of the formation at various depths as shown in FIG. 1B. Well logging typically involves deployment of a downhole tool into the wellbore to collect various downhole measurements, such as density, resistivity, etc., at various depths. Such well logging may be performed using, for example, the drilling tool of FIG. 1B and/or the wireline tool of FIG. 1C. Once the well is formed and completed, fluid flows to the surface using production tubing as shown in FIG. 1D. As fluid passes to the surface, various dynamic measurements, such as fluid flow rates, pressure, and composition may be monitored. These parameters may be used to determine various characteristics of the subterranean formation.

Sensors may be positioned about the oilfield to collect data relating to various oilfield operations. For example, sensors in the drilling equipment may monitor drilling conditions, sensors in the wellbore may monitor fluid composition, sensors located along the flow path may monitor flow rates, and sensors at the processing facility may monitor fluids collected. Other sensors may be provided to monitor downhole, surface, equipment or other conditions. The monitored data is often used to make decisions at various locations of the oilfield at various times. Data collected by these sensors may be further analyzed and processed. Data may be collected and used for current or future operations. When used for future operations at the same or other locations, such data may sometimes be referred to as historical data.

The processed data may be used to predict downhole conditions, and make decisions concerning oilfield operations. Such decisions may involve well planning, well targeting, well completions, operating levels, production rates and other operations and/or conditions. Often this information is used to determine when to drill new wells, re-complete existing wells, or alter wellbore production.

Data from one or more wellbores may be analyzed to plan or predict various outcomes at a given wellbore. In some cases, the data from neighboring wellbores or wellbores with similar conditions or equipment may be used to predict how a well will perform. There are usually a large number of variables and large quantities of data to consider in analyzing oilfield operations. It is, therefore, often useful to model the behavior of the oilfield operation to determine the desired course of action. During the ongoing operations, the operating conditions may need adjustment as conditions change and new information is received.

Techniques have been developed to model the behavior of various aspects of the oilfield operations, such as geological structures, downhole reservoirs, wellbores, surface facilities as well as other portions of the oilfield operation. For example, U.S. Pat. No. 6,980,940 to Gurpinar discloses integrated reservoir optimization involving the assimilation of diverse data to optimize overall performance of a reservoir. In another example, Application No. WO2004/049216 to Ghorayeb discloses an integrated modeling solution for coupling multiple reservoir simulations and surface facility networks. Other examples of these modeling techniques are shown in Patent/Publication/Application Nos. U.S. Pat. No. 5,992,519, U.S. Pat. No. 6,018,497, U.S. Pat. No. 6,078,869, U.S. Pat. No. 6,106,561, U.S. Pat. No. 6,230,101, U.S. Pat. No. 6,313,837, U.S. Pat. No. 6,775,578, U.S. Pat. No. 7,164,990, WO1999/064896, WO2005/122001, GB2336008, US2003/0216897, US2003/0132934, US2004/0220846, US2005/0149307, US2006/0129366, US2006/0184329, US2006/0197759 and Ser. No. 10/586,283.

Reservoir simulation often requires the numerical solution of the equations that describe the physics governing the complex behaviors of multi-component, multi-phase fluid flow in natural porous media in the reservoir and other types of fluid flow elsewhere in the production system. The governing equations typically used to describe the fluid flow are based on the assumption of thermodynamic equilibrium and the principles of conservation of mass, momentum and energy, as described in Aziz, K. and Settari, A., Petroleum Reservoir Simulation, Elsevier Applied Science Publishers, London, 1979. The complexity of the physics that govern reservoir fluid flow leads to systems of coupled nonlinear partial differential equations that are not amenable to conventional analytical methods or modeling. As a result, numerical solution techniques are necessary.

A variety of mathematical models, formulations, discretization methods, and solution strategies have been developed and are associated with a grid imposed upon an area of interest in a reservoir. Detailed discussions of the problems of reservoir simulation and the equations dealing with such problems can be found, for example, in a PCT published patent application to ExxonMobil, International Publication No. WO2001/40937, and in U.S. Pat. No. 6,662,146 B1 (the "146 patent"). Reservoir simulation can be used to predict production rates from reservoirs and can be used to determine appropriate improvements, such as facility changes or drilling additional wells that can be implemented to improve production.

A grid imposed upon an area of interest in a model of a reservoir may be structured or unstructured. Such grids include cells, each cell having one or more unknown properties, but with all the cells in the grid having one common unknown variable, generally pressure. Other unknown properties may include, but are not limited to, for example, fluid properties such as water saturation or temperature, or rock properties such as permeability or porosity to name a few. A cell treated as if it has only a single unknown variable (typically pressure) is called herein a "single variable cell," or an "IMPES cell", while a cell with more than one unknown is called herein a "multi-variable cell" or an "implicit cell."

The most popular approaches for solving the discrete form of the nonlinear equations are the fully implicit method (FIM) and Implicit Pressure, Explicit Saturations Systems (IMPES), as described by Peaceman, D., "Fundamentals of Reservoir Simulation", published by Elsevier London, 1977, and Aziz, K. and Settari, A., "Petroleum Reservoir Simulation", Elsevier Applied Science Publishers, London, 1979. There are a wide variety of specific FIM and IMPES formulations, as described by Coats, K. H., "A Note on IMPES and Some IMPES-Based Simulation Models", SPEJ (5) No. 3, (September 2000), p. 245.

The fully implicit method (FIM) assumes that all the variables and the coefficients that depend on these variables are treated implicitly. In a FIM system, all cells have a fixed number (greater than one) of unknowns, represented herein by the letter "m." As a result, the FIM is unconditionally stable, so that one can theoretically take any time step size. At each time step, a coupled system of nonlinear algebraic equations, where there are multiple degrees of freedom (implicit variables) per cell, must be solved. The most common method to solve these nonlinear systems of equations is the Newton-Raphson scheme, which is an iterative method where the approximate solution to the nonlinear system is obtained by an iterative process of linearization, linear system solution, and updating.

FIM simulations are computationally demanding. A linear system of equations with multiple implicit variables per cell arises at each Newton-Raphson iteration. The efficiency of a reservoir simulator depends, to a large extent, on the ability to solve these linear systems of equations in a robust and computationally efficient manner.

In an IMPES method, only one variable (typically pressure) is treated implicitly. All other variables, including but not limited to saturations and compositions, are treated explicitly. Moreover, the flow terms (transmissibilities) and the capillary pressures are also treated explicitly. For each cell, the conservation equations are combined to yield a pressure equation. These equations form a linear system of coupled equations, which can be solved for the implicit variable (typically pressure). After the pressure is obtained, the saturations and capillary pressures are updated explicitly. Explicit treatment of saturation (and also of transmissibility and capillary pressure) leads to conditional stability. That is, the maximum allowable time step depends heavily on the characteristics of the problem, such as the maximum allowable throughput, and/or saturation change, for any cell. When the time step size is not too restrictive, the IMPES method is extremely useful. This is because the linear system of equations has one implicit variable (usually pressure) per cell. In some practical settings, however, the stability restrictions associated with the IMPES method lead to impractically small time steps.

The adaptive implicit method (AIM) was developed in order to combine the large time step size of FIM with the low computational cost of IMPES. See Thomas, G. W. and Thurnau, D. H., "Reservoir Simulation Using an Adaptive Implicit Method," SPEJ (October, 1983), p. 759 ("Thomas and Thurnau"). In an AIM system, the cells of the grid may have a variable number of unknowns. The AIM method is based on the observation that in most cases, for a particular time step, only a small fraction of the total number of cells in the simulation model requires FIM treatment, and that the simpler IMPES treatment is adequate for the vast majority of cells. In an AIM system, the reservoir simulator adaptively and automatically selects the appropriate level of implicitness for a variable (e.g., pressure and/or saturation) on a cell by cell basis (see, e.g., Thomas & Thurnau). Rigorous stability analysis can be used to balance the time-step size with the target fraction of cells having the FIM treatment (see, e.g., Coats, K. H. "IMPES Stability: Selection of Stable Timesteps", SPEJ (June 2003), p. 181-187). AIM is conditionally stable and its time-steps can be controlled using a stability condition called the Courant-Friedrichs-Lewy (CFL) condition.

Despite the development and advancement of reservoir simulation techniques in oilfield operations, such as the FIM, IMPES, and AIM, there remains a need for a thermal adaptive implicit method (TAIM) in reservoir simulation of a thermal system with improved simulation run time and memory usage. It is desirable to calculate multiple CFL conditions in each cell concurrently. It is further desirable that such techniques for reservoir simulation be capable of one of more of the following, among others: decoupling CFL conditions in each cell for performing concurrent calculation, enabling the linear stability analysis for compositional two-phase and compositional three-phase thermal systems with inter-phase mass transfer, capillarity, and gravity effects, expanding CFL conditions from an isothermal simulator to include temperature effect for a thermal simulator, and/or estimating CFL conditions for multi-phase system with mass transfer based on CFL conditions calculated for multi-phase system without mass transfer.

SUMMARY

In general, in one aspect, the invention relates to a method of performing an oilfield operation of an oilfield having at least one wellsite, each wellsite having a wellbore penetrating a subterranean formation for extracting fluid from an underground reservoir therein. The method includes determining a time-step for simulating the reservoir using a reservoir model, the reservoir being represented as a plurality of gridded cells and being modeled as a multi-phase system using a plurality of partial differential equations, calculating a plurality of Courant-Friedrichs-Lewy (CFL) conditions of the reservoir model corresponding to the time-step, the plurality of CFL conditions being calculated for each of the plurality of gridded cells and comprising a temperature CFL condition, a composition CFL condition, and a saturation CFL condition calculated concurrently, simulating a first cell of the plurality of gridded cells using the reservoir model with an Implicit Pressure, Explicit Saturations (IMPES) system to obtain a first simulation result, the first cell having no CFL condition of the plurality of CFL conditions with a value greater than one, simulating a second cell of the plurality of gridded cells using the reservoir model with a Fully Implicit Method (FIM) system to obtain a second simulation result, the second cell having at least one CFL condition of the plurality of CFL conditions with a value greater than one, and performing the oilfield operation based on the first and second simulation results.

In general, in one aspect, the invention relates to a method of performing an oilfield operation of an oilfield having at least one wellsite, each wellsite having a wellbore penetrating a subterranean formation for extracting fluid from an underground reservoir therein. The method includes determining a time-step for simulating the reservoir, the reservoir being represented as a plurality of gridded cells and being modeled as a multi-phase system using a plurality of partial differential equations, the multi-phase system having a plurality of phases, calculating a plurality of Courant-Friedrichs-Lewy (CFL) conditions of a first reservoir model corresponding to the time-step, the first reservoir model having no mass transfer among the plurality of phases, the plurality of CFL conditions being calculated for each of the plurality of gridded cells and comprising a temperature CFL condition, a composition CFL condition, and a saturation CFL condition calculated concurrently, simulating a first cell of the plurality of gridded cells using a second reservoir model with an Implicit Pressure, Explicit Saturations (IMPES) system to obtain a first simulation result, the second reservoir model having mass transfer among the plurality of phases, the first cell having no CFL condition of the plurality of CFL conditions with a value greater than one, simulating a second cell of the plurality of gridded cells using the second reservoir model with a Fully Implicit Method (FIM) system to obtain a second simulation result, the second cell having at least one CFL condition of the plurality of CFL conditions with a value greater than one, and performing the oilfield operation based on the first and second simulation results.

In general, in one aspect, the invention relates to a method of performing an oilfield operation of an oilfield having at least one wellsite, each wellsite having a wellbore penetrating a subterranean formation for extracting fluid from an underground reservoir therein. The method includes determining a time-step for simulating the reservoir, the reservoir being represented as a plurality of gridded cells and being modeled as a multi-phase system using a plurality of partial differential equations, the multi-phase system having a plurality of phases with no mass transfer among the plurality of phases, calculating a plurality of Courant-Friedrichs-Lewy (CFL) conditions corresponding to the time-step, the plurality of CFL conditions being calculated for each of the plurality of gridded cells and comprising a temperature CFL condition, a composition CFL condition, and a saturation CFL condition, the composition CFL condition and the saturation CFL condition being calculated based on an isothermal simulator, the temperature CFL condition being calculated based on a thermal simulator, simulating a first cell of the plurality of gridded cells using the thermal simulator with an Implicit Pressure, Explicit Saturations (IMPES) system to obtain a first simulation result, the first cell having no CFL condition of the plurality of CFL conditions with a value greater than one, simulating a second cell of the plurality of gridded cells using the thermal simulator with a Fully Implicit Method (FIM) system to obtain a second simulation result, the second cell having at least one CFL condition of the plurality of CFL conditions with a value greater than one, and performing the oilfield operation based on the first and second simulation results.

In general, in one aspect, the invention relates to a method of optimizing computer usage when performing simulations for a reservoir using a reservoir model wherein the reservoir model is gridded into cells. The method includes a. determining a preferred percentage of cells to be simulated using an Implicit Pressure, Explicit Saturations (IMPES) system for optimizing computer usage, b. determining a time-step for simulating the reservoir, c. calculating Courant-Friedrichs-Lewy (CFL) conditions according to the time-step for each cell of the reservoir model including calculating a temperature CFL condition, a composition CFL condition, and a saturation CFL condition, d. calculating a percentage of cells having no CFL condition with a value greater than one, e. determining whether the percentage calculated from step d is equal to or greater than the preferred percentage and if not, reducing the time-step and returning to step c, and f. simulating all cells having no CFL value greater than one using the IMPES system and simulating all other cells using a Fully Implicit Method (FIM) system.

In general, in one aspect, the invention relates to a computer system with optimized computer usage when performing simulations for an oilfield operation of an oilfield having at least one wellsite, each wellsite having a wellbore penetrating a subterranean formation for extracting fluid from an underground reservoir therein. The computer system includes a processor, memory, and software instructions stored in memory to execute on the processor to a. determine a preferred percentage of cells to be simulated using an Implicit Pressure, Explicit Saturations (IMPES) system for optimizing computer usage, b. determine a time-step for simulating the reservoir, c. calculate Courant-Friedrichs-Lewy (CFL) conditions according to the time-step for each cell of the reservoir model including calculating a temperature CFL condition, a composition CFL condition, and a saturation CFL condition, d. calculate a percentage of cells having no CFL condition with a value greater than one, e. determine whether the percentage calculated from step d is equal to or greater than the preferred percentage and if not reducing the time-step and returning to step c, and f. simulate all cells having no CFL value greater than one using the IMPES system and simulating all other cells using a Fully Implicit Method (FIM) system.

Other aspects and advantages of the invention will be apparent from the following description and the appended claims.

BRIEF DESCRIPTION OF DRAWINGS

So that the above recited features and advantages of the present invention can be understood in detail, a more particular description of the invention, briefly summarized above, may be had by reference to the embodiments thereof that are illustrated in the appended drawings. It is to be noted, however, that the appended drawings illustrate only typical embodiments of this invention and are therefore not to be considered limiting of its scope, for the invention may admit to other equally effective embodiments.

FIGS. 1A-1D depict exemplary schematic views of an oilfield having subterranean structures including reservoirs therein and various oilfield operations being performed on the oilfield. FIG. 1A depicts an exemplary survey operation being performed by a seismic truck. FIG. 1B depicts an exemplary drilling operation being performed by a drilling tool suspended by a rig and advanced into the subterranean formation. FIG. 1C depicts an exemplary wireline operation being performed by a wireline tool suspended by the rig and into the wellbore of FIG. 1B. FIG. 1D depicts an exemplary simulation operation being performed by a simulation tool being deployed from the rig and into a completed wellbore for drawing fluid from the downhole reservoir into a surface facility.

FIG. 2A depicts an exemplary seismic trace of the subterranean formation of FIG. 1A. FIG. 2B depicts exemplary core sample of the formation shown in FIG. 1B. FIG. 2C depicts an exemplary well log of the subterranean formation of FIG. 1C. FIG. 2D depicts an exemplary simulation decline curve of fluid flowing through the subterranean formation of FIG. 1D.

DETAILED DESCRIPTION

Figure 1A:
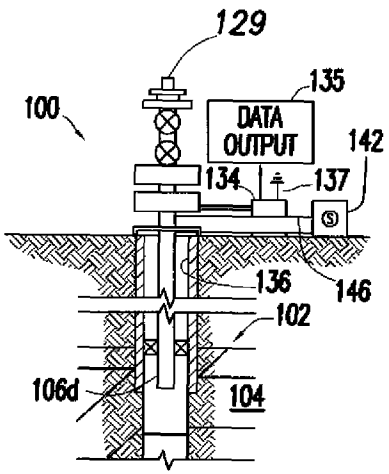

Presently preferred embodiments of the invention are shown in the above-identified Figs. and described in detail below. In describing the preferred embodiments, like or identical reference numerals are used to identify common or similar elements. The Figs. are not necessarily to scale and certain features and certain views of the Figs. may be shown exaggerated in scale or in schematic in the interest of clarity and conciseness.

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

FIGS. 1A-D depict an oilfield (100) having geological structures and/or subterranean formations therein. As shown in these Figs., various measurements of the subterranean formation are taken by different tools at the same location. These measurements may be used to generate information about the formation and/or the geological structures and/or fluids contained therein.

FIGS. 1A-1D depict schematic views of an oilfield (100) having subterranean formations (102) containing a reservoir (104) therein and depicting various oilfield operations being performed on the oilfield (100). FIG. 1A depicts a survey operation being performed by a seismic truck (106*a*) to measure properties of the subterranean formation. The survey operation is a seismic survey operation for producing sound vibration(s) (112). In FIG. 1A, one such sound vibration (112) is generated by a source (110) and reflects off a plurality of horizons (114) in an earth formation (116). The sound vibration(s) (112) is (are) received in by sensors (S), such as geophone-receivers (118), situated on the earth's surface, and the geophone-receivers (118) produce electrical output signals, referred to as data received (120) in FIG. 1.

In response to the received sound vibration(s) (112) representative of different parameters (such as amplitude and/or frequency) of the sound vibration(s) (112). The data received (120) is provided as input data to a computer (122*a*) of the seismic recording truck (106*a*), and responsive to the input data, the recording truck computer (122*a*) generates a seismic data output record (124). The seismic data may be further processed as desired, for example by data reduction.

FIG. 1B depicts a drilling operation being performed by a drilling tool (106*b*) suspended by a rig (128) and advanced into the subterranean formation (102) to form a wellbore (136). A mud pit (130) is used to draw drilling mud into the drilling tool (106*b*) via flow line (132) for circulating drilling mud through the drilling tool (106*b*) and back to the surface. The drilling tool (106*b*) is advanced into the formation to reach reservoir (104). The drilling tool (106*b*) is preferably adapted for measuring downhole properties. The drilling tool (106*b*) may also be adapted for taking a core sample (133) as shown, or removed so that a core sample (133) may be taken using another tool.

A surface unit (134) is used to communicate with the drilling tool (106*b*) and offsite operations. The surface unit (134) is capable of communicating with the drilling tool (106*b*) to send commands to drive the drilling tool (106*b*), and to receive data therefrom. The surface unit (134) is preferably provided with computer facilities for receiving, storing, processing, and analyzing data from the oilfield (100). The surface unit (134) collects data output (135) generated during the drilling operation. Computer facilities, such as those of the surface unit (134), may be positioned at various locations about the oilfield (100) and/or at remote locations.

Sensors (S), such as gauges, may be positioned throughout the reservoir, rig, oilfield equipment (such as the downhole tool), or other portions of the oilfield for gathering information about various parameters, such as surface parameters, downhole parameters, and/or operating conditions. These sensors (S) preferably measure oilfield parameters, such as weight on bit, torque on bit, pressures, temperatures, flow rates, compositions and other parameters of the oilfield operation.

The information gathered by the sensors (S) may be collected by the surface unit (134) and/or other data collection sources for analysis or other processing. The data collected by the sensors (S) may be used alone or in combination with other data. The data may be collected in a database and all or select portions of the data may be selectively used for analyzing and/or predicting oilfield operations of the current and/or other wellbores.

Data outputs from the various sensors (S) positioned about the oilfield may be processed for use. The data may be historical data, real time data, or combinations thereof. The real time data may be used in real time, or stored for later use. The data may also be combined with historical data or other inputs for further analysis. The data may be housed in separate databases, or combined into a single database.

The collected data may be used to perform analysis, such as modeling operations. For example, the seismic data output may be used to perform geological, geophysical, reservoir engineering, and/or production simulations. The reservoir, wellbore, surface and/or process data may be used to perform reservoir, wellbore, or other production simulations. The data outputs from the oilfield operation may be generated directly from the sensors (S), or after some preprocessing or modeling. These data outputs may act as inputs for further analysis.

The data is collected and stored at the surface unit (134). One or more surface units (134) may be located at the oilfield (100), or linked remotely thereto. The surface unit (134) may be a single unit, or a complex network of units used to perform the necessary data management functions throughout the oilfield (100). The surface unit (134) may be a manual or automatic system. The surface unit (134) may be operated and/or adjusted by a user.

The surface unit (134) may be provided with a transceiver (137) to allow communications between the surface unit (134) and various portions (or regions) of the oilfield (100) or other locations. The surface unit (134) may also be provided with or functionally linked to a controller for actuating mechanisms at the oilfield (100). The surface unit (134) may then send command signals to the oilfield (100) in response to data received. The surface unit (134) may receive commands via the transceiver or may itself execute commands to the controller. A processor may be provided to analyze the data (locally or remotely) and make the decisions to actuate the controller. In this manner, the oilfield (100) may be selectively adjusted based on the data collected to optimize fluid recovery rates, or to maximize the longevity of the reservoir (104) and its ultimate production capacity. These adjustments may be made automatically based on computer protocol, or manually by an operator. In some cases, well plans may be adjusted to select optimum operating conditions, or to avoid problems.

FIG. 1C depicts a wireline operation being performed by a wireline tool (106*c*) suspended by the rig (128) and into the wellbore (136) of FIG. 1B. The wireline tool (106*c*) is preferably adapted for deployment into a wellbore (136) for performing well logs, performing downhole tests and/or collecting samples. The wireline tool (106*c*) may be used to provide another method and apparatus for performing a seismic survey operation. The wireline tool (106*c*) of FIG. 1C may have an explosive or acoustic energy source (143) that provides electrical signals to the surrounding subterranean formations (102).

The wireline tool (106*c*) may be operatively linked to, for example, the geophones (118) stored in the computer (122*a*) of the seismic recording truck (106*a*) of FIG. 1A. The wireline tool (106*c*) may also provide data to the surface unit (134). As shown data output (135) is generated by the wireline tool (106*c*) and collected at the surface. The wireline tool (106*c*) may be positioned at various depths in the wellbore (136) to provide a survey of the subterranean formation.

FIG. 1D depicts a production operation being performed by a production tool (106*d*) deployed from the rig (128) and into the completed wellbore (136) of FIG. 1C for drawing fluid from the downhole reservoirs into surface facilities (142). Fluid flows from reservoir (104) through wellbore (136) and to the surface facilities (142) via a surface network (144). Sensors (S) positioned about the oilfield (100) are operatively connected to a surface unit (142) for collecting data therefrom. During the production process, data output (135) may be collected from various sensors (S) and passed to the surface unit (134) and/or processing facilities. This data may be, for example, reservoir data, wellbore data, surface data, and/or process data.

While FIGS. 1A-1D depict monitoring tools used to measure properties of an oilfield (100), it will be appreciated that the tools may be used in connection with non-oilfield operations, such as mines, aquifers or other subterranean facilities. Also, while certain data acquisition tools are depicted, it will be appreciated that various measurement tools capable of sensing properties, such as seismic two-way travel time, density, resistivity, production rate, etc., of the subterranean formation and/or its geological structures may be used. Various sensors (S) may be located at various positions along the subterranean formation and/or the monitoring tools to collect and/or monitor the desired data. Other sources of data may also be provided from offsite locations.

The oilfield configuration in FIGS. 1A-1D is not intended to limit the scope of the invention. Part, or all, of the oilfield (100) may be on land and/or sea. Also, while a single oilfield at a single location is depicted, the present invention may be used with any combination of one or more oilfields (100), one or more processing facilities and one or more wellsites. Additionally, while only one wellsite is shown, it will be appreciated that the oilfield (100) may cover a portion of land that hosts one or more wellsites. One or more gathering facilities may be operatively connected to one or more of the wellsites for selectively collecting downhole fluids from the wellsite(s).

Figure 2A:
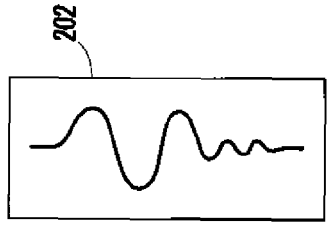
FIGS. 2A-2D are exemplary graphical depictions of data collected by the tools of FIGS. 1A-1D, respectively.
Figure 2B:
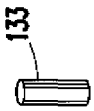
Figure 2C:
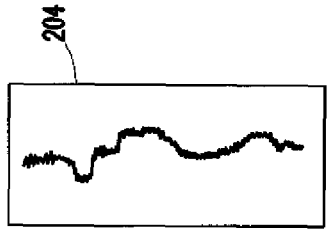
Figure 2D:
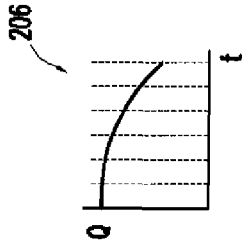

FIGS. 2A-2D are graphical depictions of data collected by the tools of FIGS. 1A-D, respectively. FIG. 2A depicts a seismic trace (202) of the subterranean formation of FIG. 1A taken by survey tool (106*a*). The seismic trace (202) measures a two-way response over a period of time. FIG. 2B depicts a core sample (133) taken by the drilling tool (106*b*). The core test typically provides a graph of the density, resistivity, or other physical property of the core sample (133) over the length of the core. Tests for density and viscosity are often performed on the fluids in the core at varying pressures and temperatures. FIG. 2C depicts a well log (204) of the subterranean formation of FIG. 1C taken by the wireline tool (106*c*). The wireline log typically provides a resistivity measurement of the formation at various depths. FIG. 2D depicts a production decline curve (206) of fluid flowing through the subterranean formation of FIG. 1D taken by the production tool (106*d*). The production decline curve (206) typically provides the production rate Q as a function of time t.

The respective graphs of FIGS. 2A-2C contain static measurements that describe the physical characteristics of the formation. These measurements may be compared to determine the accuracy of the measurements and/or for checking for errors. In this manner, the plots of each of the respective measurements may be aligned and scaled for comparison and verification of the properties.

FIG. 2D provides a dynamic measurement of the fluid properties through the wellbore. As the fluid flows through the wellbore, measurements are taken of fluid properties, such as flow rates, pressures, composition, etc. As described below, the static and dynamic measurements may be used to generate models of the subterranean formation to determine characteristics thereof.

Figure 3:
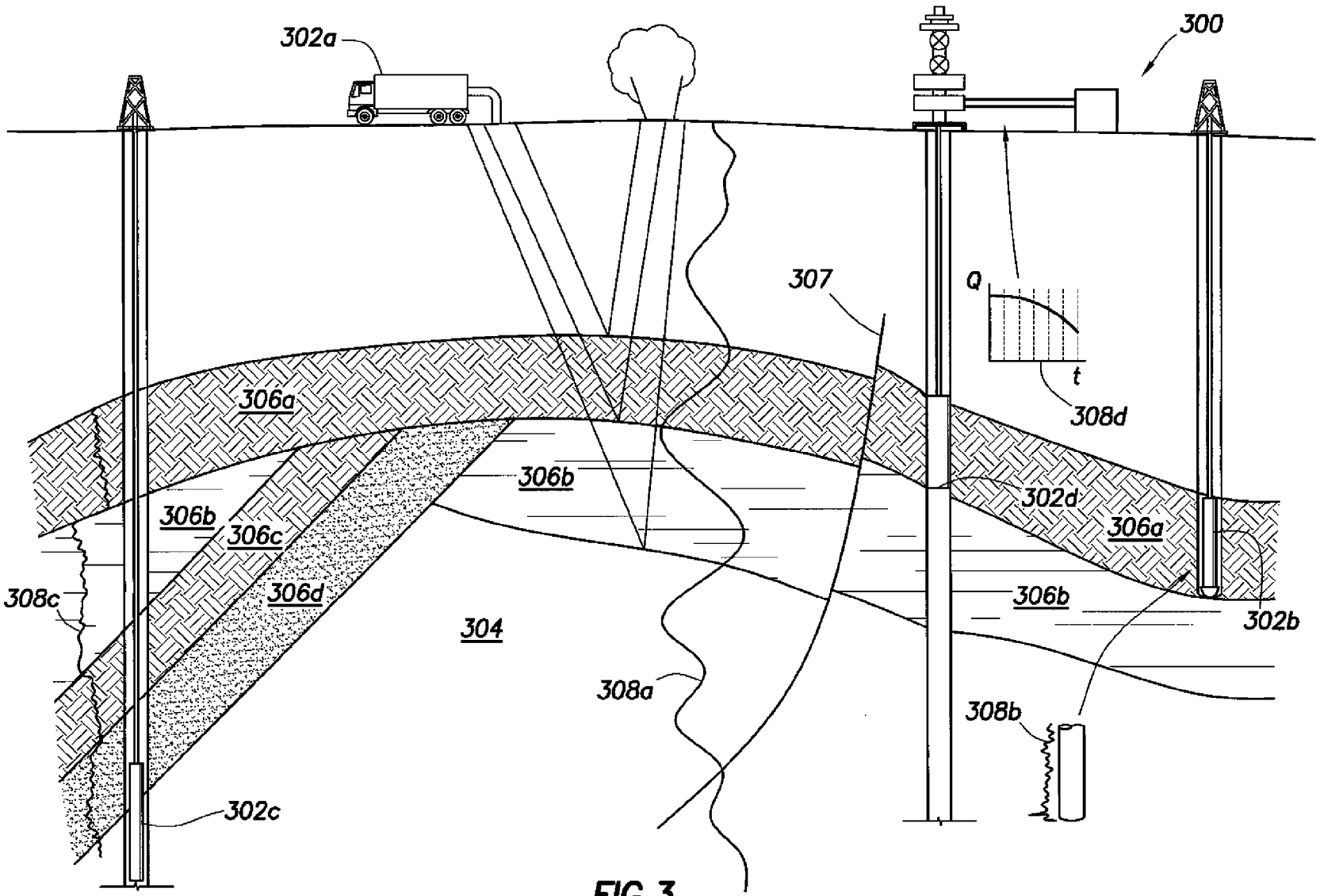
FIG. 3 depicts an exemplary schematic view, partially in cross section, of an oilfield having a plurality of data acquisition tools positioned at various locations along the oilfield for collecting data from the subterranean formation.

FIG. 3 is a schematic view, partially in cross section of an oilfield (300) having data acquisition tools (302*a*), (302*b*), (302*c*), and (302*d*) positioned at various locations along the oilfield for collecting data of a subterranean formation (304). The data acquisition tools (302*a*-302*d*) may be the same as data acquisition tools (106*a*-106*d*) of FIG. 1, respectively. As shown, the data acquisition tools (302*a*-302*d*) generate data plots or measurements (308*a*-308*d*), respectively.

Data plots (308*a*-308*c*) are examples of static data plots that may be generated by the data acquisition tools (302*a*-302*d*), respectively. Static data plot (308*a*) is a seismic two-way response time and may be the same as the seismic trace (202) of FIG. 2A. Static plot (308*b*) is core sample data measured from a core sample of the formation (304), similar to the core sample (133) of FIG. 2B. Static data plot (308*c*) is a logging trace, similar to the well log (204) of FIG. 2C. Data plot (308*d*) is a dynamic data plot of the fluid flow rate over time, similar to the graph (206) of FIG. 2D. Other data may also be collected, such as historical data, user inputs, economic information, other measurement data, and other parameters of interest.

The subterranean formation (304) has a plurality of geological structures (306*a*-306*d*). As shown, the formation has a sandstone layer (306*a*), a limestone layer (306*b*), a shale layer (306*c*), and a sand layer (306*d*). A fault line (307) extends through the formation. The static data acquisition tools are preferably adapted to measure the formation and detect the characteristics of the geological structures of the formation.

While a specific subterranean formation (304) with specific geological structures is depicted, it will be appreciated that the formation may contain a variety of geological structures. Fluid may also be present in various portions of the formation. Each of the measurement devices may be used to measure properties of the formation and/or its underlying structures. While each acquisition tool is shown as being in specific locations along the formation, it will be appreciated that one or more types of measurement may be taken at one or more location across one or more oilfields or other locations for comparison and/or analysis.

The data collected from various sources, such as the data acquisition tools of FIG. 3, may then be evaluated. Typically, seismic data displayed in the static data plot (308*a*) from the data acquisition tool (302*a*) is used by a geophysicist to determine characteristics of the subterranean formation (304). Core data shown in static plot (308*b*) and/or log data from the well log (308*c*) is typically used by a geologist to determine various characteristics of the geological structures of the subterranean formation (304). Production data from the production graph (308*d*) is typically used by the reservoir engineer to determine fluid flow reservoir characteristics.

Figure 4:
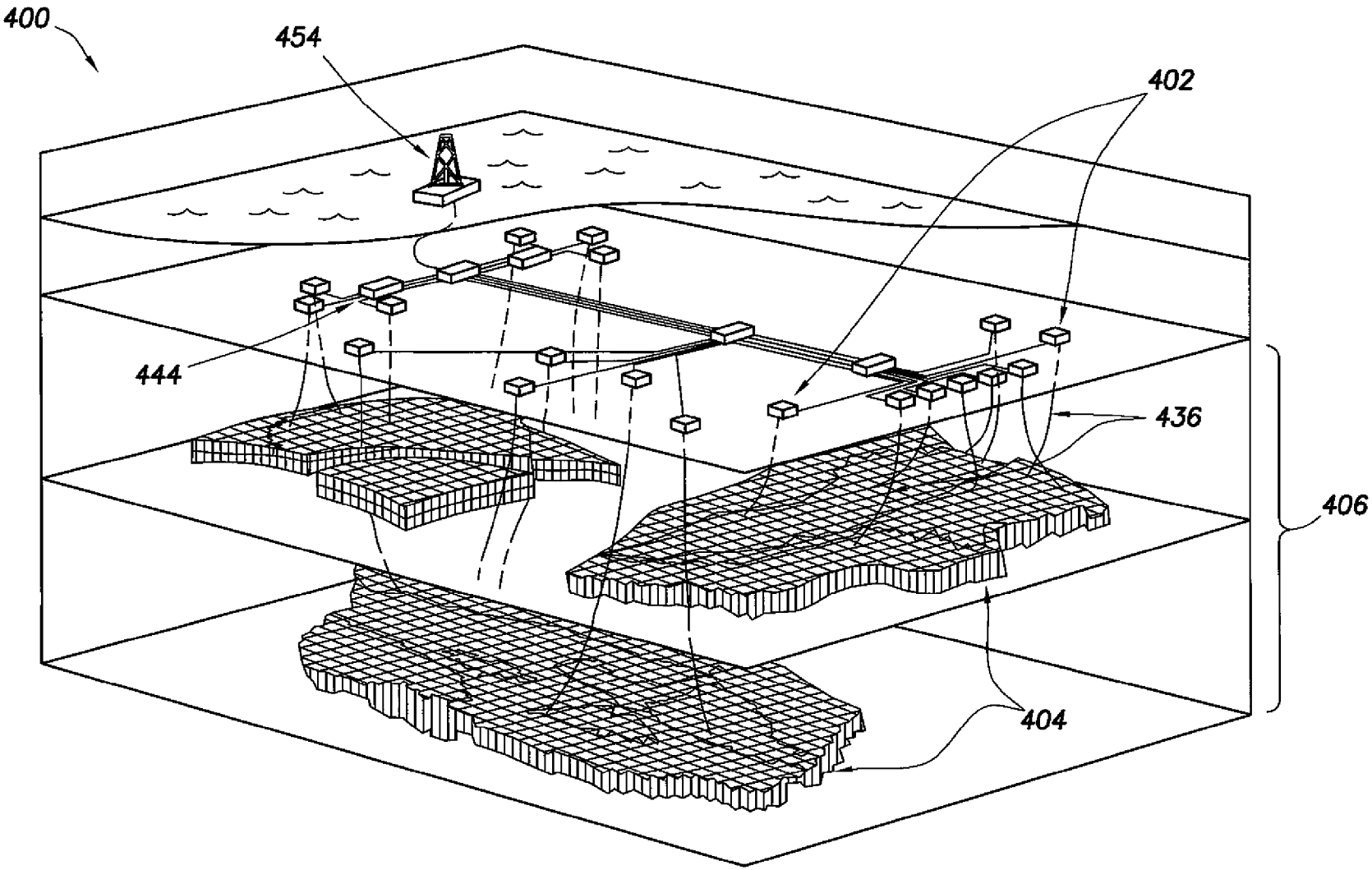
FIG. 4 depicts an exemplary schematic view of an oilfield having a plurality of wellsites for producing hydrocarbons from the subterranean formation.

FIG. 4 depicts an oilfield (400) for performing simulation operations. As shown, the oilfield has a plurality of wellsites (402) operatively connected to a central processing facility (454). The oilfield configuration of FIG. 4 is not intended to limit the scope of the invention. Part or all of the oilfield may be on land and/or sea. Also, while a single oilfield with a single processing facility and a plurality of wellsites is depicted, any combination of one or more oilfields, one or more processing facilities and one or more wellsites may be present.

Each wellsite (402) has equipment that forms a wellbore (436) into the earth. The wellbores extend through subterranean formations (406) including reservoirs (404). These reservoirs (404) contain fluids, such as hydrocarbons. The wellsites draw fluid from the reservoirs and pass them to the processing facilities via surface networks (444). The surface networks (444) have tubing and control mechanisms for controlling the flow of fluids from the wellsite to the processing facility (454).

Figure 5:
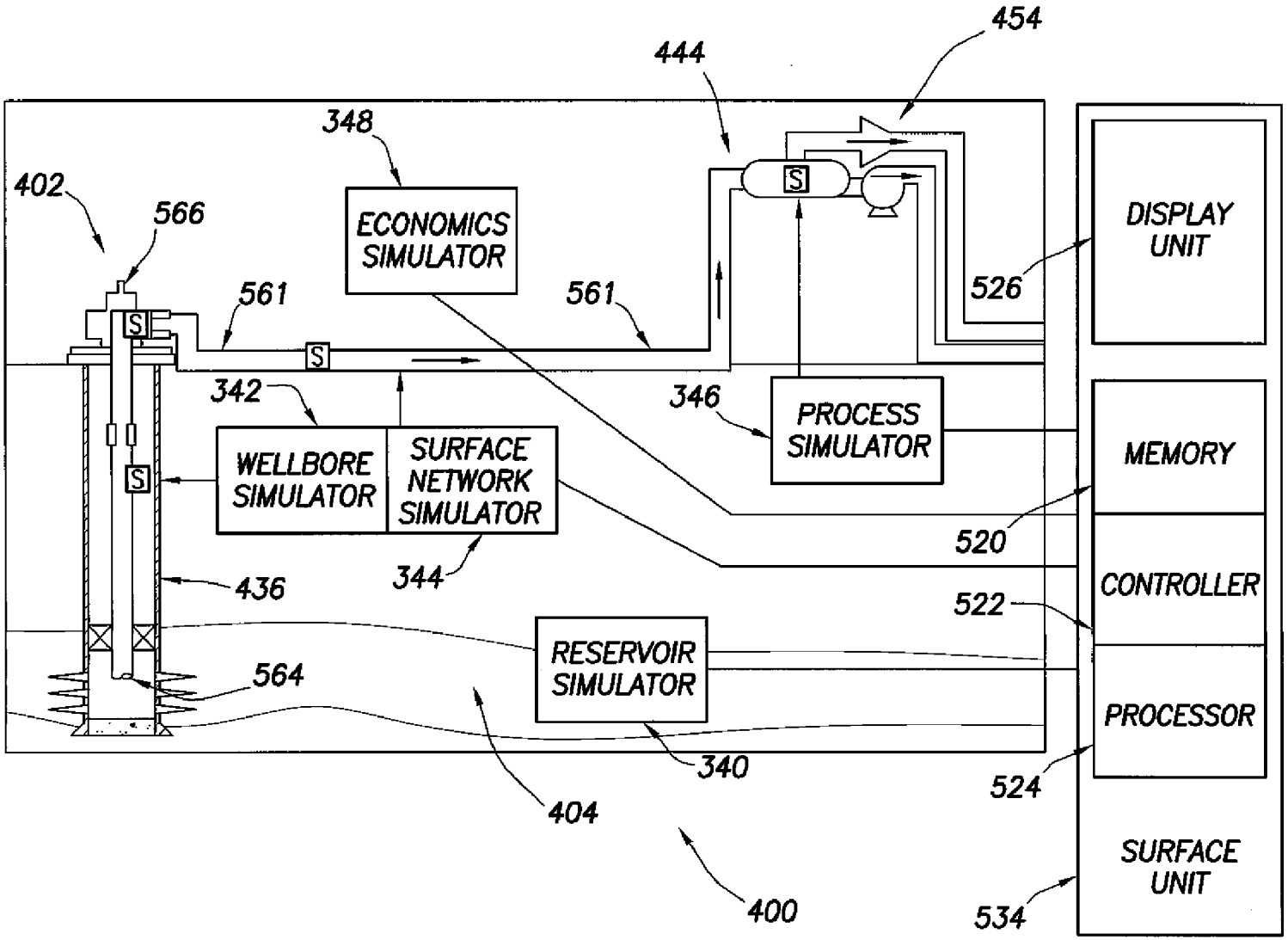
FIG. 5 depicts an exemplary schematic diagram of a portion of the oilfield of FIG. 4 depicting the simulation operation in detail.

FIG. 5 depicts a schematic view of a portion (or region) of the oilfield (400) of FIG. 4, depicting a producing wellsite (402) and surface network (444) in detail. The wellsite (402) of FIG. 5 has a wellbore (436) extending into the earth therebelow. As shown, the wellbores (436) is already drilled, completed, and prepared for production from reservoir (404).

Wellbore production equipment (564) extends from a wellhead (566) of wellsite (402) and to the reservoir (404) to draw fluid to the surface. The wellsite (402) is operatively connected to the surface network (444) via a transport line (561). Fluid flows from the reservoir (404), through the wellbore (436), and onto the surface network (444). The fluid then flows from the surface network (444) to the process facilities (454).

As further shown in FIG. 5, sensors (S) are located about the oilfield (400) to monitor various parameters during oilfield operations. The sensors (S) may measure, for example, pressure, temperature, flow rate, composition, and other parameters of the reservoir, wellbore, surface network, process facilities and/or other portions (or regions) of the oilfield operation. These sensors (S) are operatively connected to a surface unit (534) for collecting data therefrom. The surface unit may be, for example, similar to the surface unit (134) of FIGS. 1A-D.

One or more surface units (534) may be located at the oilfield (400), or linked remotely thereto. The surface unit (534) may be a single unit, or a complex network of units used to perform the necessary data management functions throughout the oilfield (400). The surface unit may be a manual or automatic system. The surface unit may be operated and/or adjusted by a user. The surface unit is adapted to receive and store data. The surface unit may also be equipped to communicate with various oilfield equipment. The surface unit may then send command signals to the oilfield in response to data received or modeling performed.

As shown in FIG. 5, the surface unit (534) has computer facilities, such as memory (520), controller (522), processor (524), and display unit (526), for managing the data. The data is collected in memory (520), and processed by the processor (524) for analysis. Data may be collected from the oilfield sensors (S) and/or by other sources. For example, oilfield data may be supplemented by historical data collected from other operations, or user inputs.

The analyzed data (e.g., based on modeling performed) may then be used to make decisions. A transceiver (not shown) may be provided to allow communications between the surface unit (534) and the oilfield (400). The controller (522) may be used to actuate mechanisms at the oilfield (400) via the transceiver and based on these decisions. In this manner, the oilfield (400) may be selectively adjusted based on the data collected. These adjustments may be made automatically based on computer protocol and/or manually by an operator. In some cases, well plans are adjusted to select optimum operating conditions or to avoid problems.

To facilitate the processing and analysis of data, simulators may be used to process the data for modeling various aspects of the oilfield operation. Specific simulators are often used in connection with specific oilfield operations, such as reservoir or wellbore simulation. Data fed into the simulator(s) may be historical data, real time data, or combinations thereof. Simulation through one or more of the simulators may be repeated or adjusted based on the data received.

As shown, the oilfield operation is provided with wellsite and non-wellsite simulators. The wellsite simulators may include a reservoir simulator (340), a wellbore simulator (342), and a surface network simulator (344). The reservoir simulator (340) solves for hydrocarbon flow through the reservoir rock and into the wellbores. The wellbore simulator (342) and surface network simulator (344) solves for hydrocarbon flow through the wellbore and the surface network (444) of pipelines. As shown, some of the simulators may be separate or combined, depending on the available systems.

The non-wellsite simulators may include process (346) and economics (348) simulators. The processing unit has a process simulator (346). The process simulator (346) models the processing plant (e.g., the process facilities (454)) where the hydrocarbon(s) is/are separated into its constituent components (e.g., methane, ethane, propane, etc.) and prepared for sales. The oilfield (400) is provided with an economics simulator (348). The economics simulator (348) models the costs of part or the entire oilfield (400) throughout a portion or the entire duration of the oilfield operation. Various combinations of these and other oilfield simulators may be provided.

Figure 6:
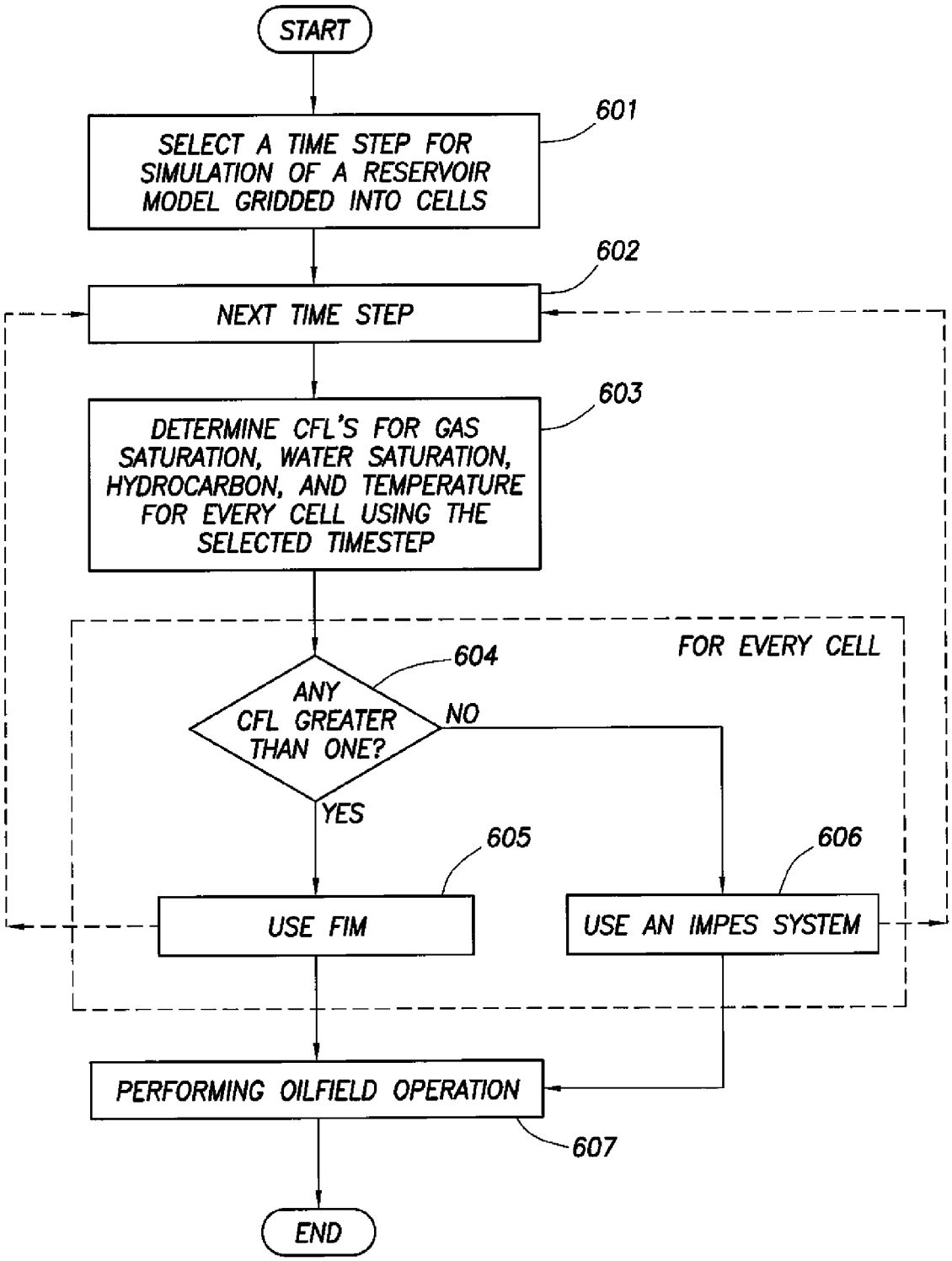
FIGS. 6-8 depict exemplary flow charts for performing simulation operations of an oilfield.

FIG. 6 depicts a method for forecasting production from a reservoir using a reservoir model. Prior to starting the method, the reservoir, which is a multi-phase system, is gridded into cells (i.e., blocks or gridblocks). Initially, a time-step for simulating the reservoir is determined (Step 601). An example time-step may be a second, a minute, an hour, a day, a week, a month, a year, any portion thereof, or any other time measurement. In Step 603, CFL conditions are then calculated concurrently according to the time-step for each cell of the reservoir model (as determined in Step 601). The calculation of CFL conditions includes, but is not limited to, calculating a temperature CFL condition, a composition CFL condition, and a saturation CFL condition. The details of exemplary calculations are described below and shown in FIG. 8. All cells having no CFL value greater than one are subsequently simulated using an IMPES system (Step 606). The simulation results in a first simulation result. All other cells are simulated using a FIM system (Step 605), which results in a second simulation result. Next, the method is incremented by the time step to continue the simulation (Step 602) until the simulation is complete. The oilfield operation (e.g., forecasting reservoir production) is then performed according to first and second simulation results (Step 607).

Figure 7:
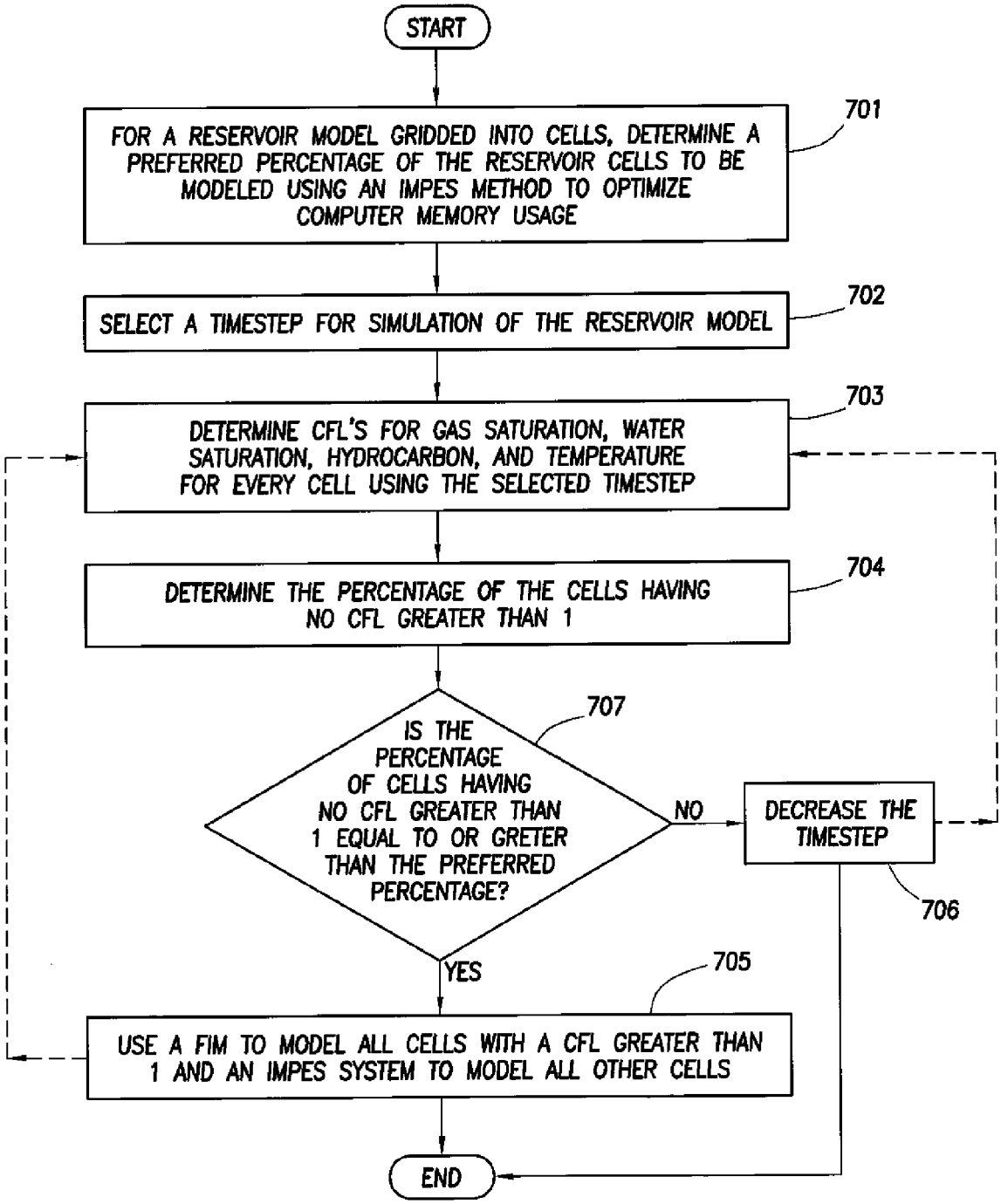

FIG. 7 depicts a method of optimizing computer usage when performing simulations for a reservoir using a reservoir model. As described herein, prior to optimizing computer usage, the reservoir model is gridded into cells (i.e., blocks or gridblocks). Initially, a preferred percentage of cells is determined that is to be simulated using an IMPES system for optimizing memory usage (Step 701). As described above in relation to Step 601, a simulation time-step is also selected for simulation of the reservoir model (Step 702). CFL conditions are then calculated according to the time-step for every cell of the reservoir model (Step 703). The calculation includes, but not limited to, calculating a temperature CFL condition, a composition CFL condition, and a saturation CFL condition. The details of exemplary calculations are described below and shown in FIG. 8. Subsequently, a percentage of cells having no CFL condition with a value greater than one is calculated (Step 704). If the calculated percentage is greater than or equal to the preferred percentage (Step 707), all cells having no CFL value greater than one are simulated using an IMPES system and all other cells are simulated using an FIM system (Step 705). The method may then terminate or proceed to Step 703. If the calculated percentage is less than the preferred percentage (Step 707), the time-step is decreased (Step 706) and the method may then terminate or proceed to Step 703.

Figure 8:
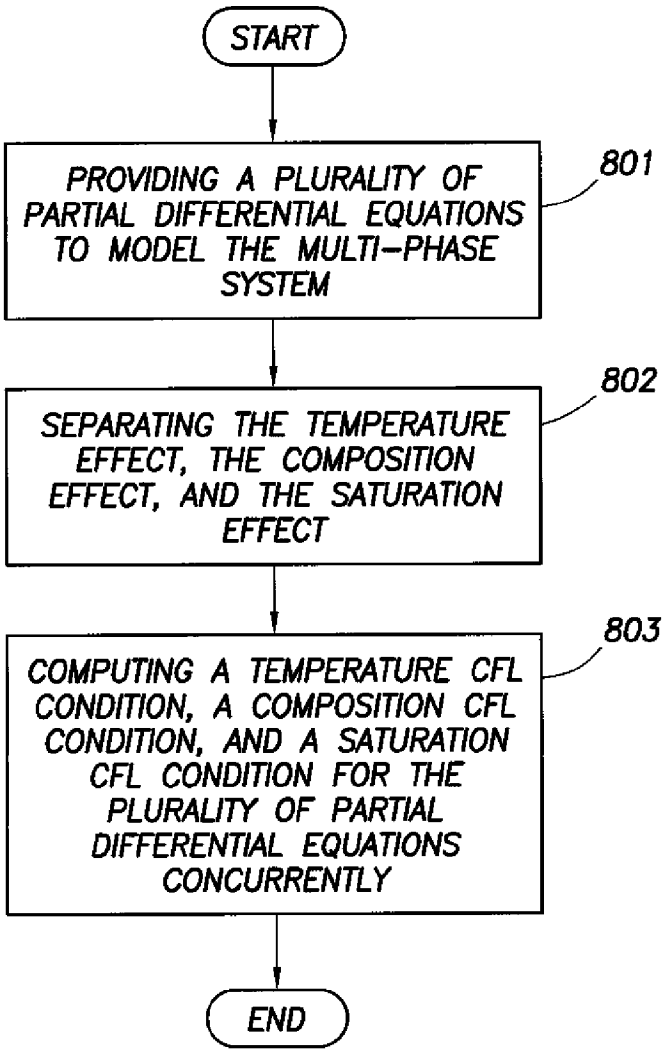

FIG. 8 depicts a method for calculating CFL conditions. As described herein the reservoir model is gridded into cells (i.e., blocks or gridblocks). The reservoir model is represented as a plurality of partial differential equations. The partial differential equations are provided to model the multi-phase system (Step 801). The reservoir model is a multi-phase system which includes, but is not limited to, a plurality of phases, a temperature effect, a composition effect, and a saturation effect. Next, the temperature effect, the composition effect, and the saturation effect are separated (Step 802). The separation enables a temperature CFL condition, a composition CFL condition, and a saturation CFL condition for the plurality of partial differential equations to be calculated concurrently (Step 803). More details of the method to separate the temperature effect, the composition effect, and the saturation effect are described below. The notations used in the calculations are listed in table 1 below.

Figure 9:
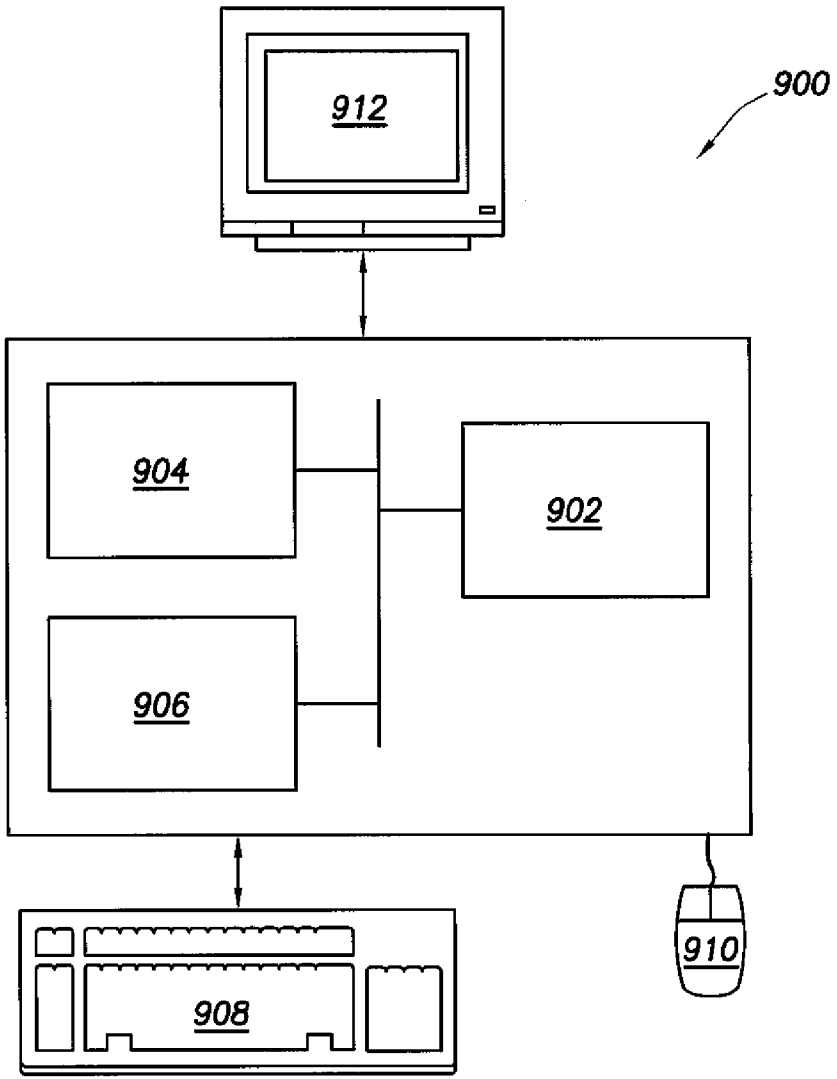
FIG. 9 depicts a computer system for performing simulation operations of an oilfield.

The invention may be implemented on virtually any type of computer regardless of the platform being used. For example, as shown in FIG. 9, a computer system (900) includes a processor (902), associated memory (904), a storage device (906), and numerous other elements and functionalities typical of today's computers (not shown). The computer system (900) may also include input means, such as a keyboard (908) and a mouse (910), and output means, such as a monitor (912). The computer system (900) is connected to a local area network (LAN) or a wide area network (e.g., the Internet) (not shown) via a network interface connection (not shown). Those skilled in the art will appreciate that these input and output means may take other forms.

Further, those skilled in the art will appreciate that one or more elements of the aforementioned computer system (900) may be located at a remote location and connected to the other elements over a network. Further, the invention may be implemented on a distributed system having a plurality of nodes, where each portion of the invention may be located on a different node within the distributed system. In one embodiment of the invention, the node corresponds to a computer system. Alternatively, the node may correspond to a processor with associated physical memory. The node may alternatively correspond to a processor with shared memory and/or resources. Further, software instructions to perform embodiments of the invention may be stored on a computer readable medium such as a compact disc (CD), a diskette, a tape, a file, or any other computer readable storage device.

TABLE 1

| |
|---|
| Primary/gas pressure |
| P (psi) |
| gas/oil capillary pressure |
| $P_o = P - P_{cGO}(S_g)$ (psi) |
| water/oil capillary pressure |
| $P_w = P_o - P_{cWO}(S_w) = P - P_{cGO}(S_g) - P_{cWO}(S_w)$ (psi) |

TABLE 1-continued

Gas saturation
$S_g$
water saturation
$S_w$
Temperature of the rock and fluids
T (°F.)
Gas mole fractions of hydrocarbon component
$y_c$
Oil mole fractions of hydrocarbon component
$x_c$
Depth
D (ft)
Gravity constant $$g = \frac{1}{144}(\text{psi-ft}^2/\text{lb})$$

Porosity
$\phi$
Permeability
K (mD)
Rock and fluids heat conductivity
$\kappa$ (Btu/ft-day-°F.)
Hydrocarbon component K-value
$K_c$
Water component K-value
$K_w$
Gas velocity, oil velocity, water velocity and total velocity
$u_g$, $u_o$, $u_w$ and $u_t = u_g + u_o + u_w$ (ft/day)
Gas mobility, oil mobility, water mobility and total mobility $$\lambda_g = \frac{kr_g}{\mu_g},\ \lambda_o = \frac{kr_o}{\mu_o},\ \lambda_w = \frac{kr_w}{\mu_w} \text{ and } \lambda_t = \lambda_g + \lambda_o + \lambda_w$$

Gas density, oil density and water molar density
$\rho_g$, $\rho_o$ and $\rho_w$ (mol/ft$^3$)
Gas density, oil density and water mass density
$\bar{\rho}_g$, $\bar{\rho}_o$ and $\bar{\rho}_w$ (lb/ft$^3$)
Gas energy, oil energy and water internal energy
$U_g$, $U_o$, $U_w$ (Btu/mol)
Gas enthalpy, oil enthalpy and water internal enthalpy
$H_g$, $H_o$, $H_w$ (Btu/mol)
Rock energy
$\rho_r U_r$ (in Btu/ft$^3$)
Time step
$\Delta t$ (day)
Cell volume
V
Cell length in the direction of the flow
$\Delta x$ (ft$^3$ and ft)
Transmissibility $$T = \frac{V}{\Delta x^2}K \text{ (md.ft)}$$

Heat transmissibility $$T_h = \frac{V}{\Delta x^2}\kappa \text{ (Btu/day-°F.)}$$

Gas, oil, water, and total volumetric rates in (ft$^3$/day)

$$q_g = \frac{V}{\Delta x}u_g,\ q_o = \frac{V}{\Delta x}u_o,\ q_w = \frac{V}{\Delta x}u_w \text{ and } q_t = \frac{V}{\Delta x}u_t$$

$C_r$ rock compressibility
$C_{re}$ rock heat capacity
$C_{P,c}$ oil compressibility for hydrocarbon component c
$C_{T,c}$ oil thermal expansion coefficient for hydrocarbon component c
D depth of a grid block
g gravitational constant
$H_p$ phase enthalpy
$H_s$ steam enthalpy
$H_{p,c}$ phase enthalpy for hydrocarbon component c $$K_c = \frac{y_c}{x_c}$$

TABLE 1-continued

K-value of hydrocarbon component c between gas and oil phases, $K_w = y_w$, K-value of water component between gas and water phases
k permeability
$n_h$ number of hydrocarbon components
P pressure
$P_{cGO}' \geqq 0$ derivative of gas capillary pressure with respect to gas saturation ($P_{cGO} = P_g - P_o \geqq 0$),
$P_{cWO}' \leqq 0$ derivative of water capillary pressure with respect to water saturation ($P_{cWO} = P_o - P_w \leqq 0$)
$P_{ref}$ reference pressure $$q_t = \frac{V}{\Delta x}u_t \text{ total volumetric rate}$$

R universal gas constant
$S_p$ saturation of phase p
T temperature
$T_{crit_c}$ critical temperature of hydrocarbon component c
$T_{ref}$ reference temperature $$\bar{T} = \frac{V}{\Delta x^2}k \text{ transmissitivity}$$

$$T = \frac{V}{\Delta x^2}k \text{ heat transmissitivity}$$

t and $\Delta t$ time variable and discretization
$U_p$ phase energy
$u_p$ phase velocity, $u_t = \Sigma_p u_p$ total velocity, $f_p$ phase fractional flow
V volume (rock and fluid) of a grid block
x and $\Delta x$ space variable and discretization
$x_c$ fraction of component c in the oil phase
$y_c$ fraction of component c in the gas phase
$Z_c$ Z-factor for hydrocarbon component c
$\alpha_c$ conversion factor Psi → Btu/ft$^3$
$\kappa$ heat conductivity of the rock and the fluids
$\kappa_c$ heat capacity of hydrocarbon component c
$\lambda_p$ phase mobility, $\lambda_t = \Sigma_p$ total mobility, $$\frac{1}{\lambda} = \sum_p \frac{1}{\lambda_p} \text{ harmonic average, } \lambda_{pq} = \frac{\lambda_p \lambda_q}{\lambda_t}$$

$\mu_p$ phase viscosity
$\mu_{o,c}$ oil viscosity of hydrocarbon component c
$\Phi$ porosity of the rock
$\rho_p$ phase molar density, $\bar{\rho}_p$ phase mass density
$\rho_s$ steam molar density
$\rho_c^{ref}$ oil molar density for hydrocarbon component c at reference conditions
$\rho_r U_r$ or $\rho_r H_r$ rock energy Below are various exemplary explanations of methodologies and/or modeling used as part of the present invention in relation to an oilfield (in furtherance of FIGS. 6-8), such as a multiphase reservoir system. The various equations used below are numbered simply for ease of reference and do not necessarily indicate any relative importance or ordering. Following the explanations are detailed derivations of the equations and models used below as well as exemplary tests performed in the oilfield.

Derivation of the General Stability Criteria

To evaluate the viability of using AIM-based formulations to model thermal compositional reservoir flows, the behavior of these complex systems is illustrated below with some of the primary variables treated explicitly. For that purpose, a comprehensive linear stability analysis is performed, and concise expressions of the stability limits are reported. The derived stability criteria for the Thermal Adaptive Implicit Method (TAIM) account for explicit treatment of compositions, saturations, and temperature. If the stability limits prove to be sharp, they can be used as 'switching criteria' (i.e., labeling a primary variable implicit or explicit for the current time step) in a TAIM-based reservoir simulator.

The system of coupled nonlinear partial differential conservation equations that govern thermal-compositional porous media flows is considered here. Using a minimum set of assumptions, a system of coupled linear convection-dispersion differential equations is derived. The assumptions that lead to this linear system, which are stated clearly, are motivated by physical arguments and observations. The coupled system of linear equations is discretized using standard methods widely used in general-purpose reservoir simulation. Specifically, first-order forward Euler (explicit) approximation is used for the time derivative. First order spatial derivatives are discretized using single-point upstream weighting, and second-order spatial derivatives are discretized using centered differences. The applicability of the limits obtained using the linear stability analysis is tested using fully implicit nonlinear thermal-compositional simulations in the parameter space of practical interest.

The governing equations, which are written for each grid-block, or control-volume of a simulator, are the (1) conservation of mass (moles) for each hydrocarbon component, which may be present in the gas and oil phases, (2) conservation of the water component, which in addition to the (liquid) water phase, could vaporize into the gas phase, and (3) conservation of energy. The coupled nonlinear system of equations is first linearized, then the stability of the discrete linear system, with respect to the growth of small perturbation as a function of time, is tested for all possible combinations of explicit treatment of compositions, saturations, and temperature.

While the derived stability limits are not strictly CFL (Courant-Friedrichs-Lewy) numbers, the term CFL is used to indicate that these numbers can be used to control the time step if an explicit treatment of the variable is employed, or as local switching criteria in adaptive implicit treatments. $CFLX_c$, $CFLS_p$ and CFLT are defined as the stability limits for explicit treatment of the composition of hydrocarbon component c, $x_c$, saturation of phase p, $S_p$, and temperature T, respectively. A system is stable if for every time step and for every grid-block in the model, all CFL<1.

In the derivation, the effect of rock compressibility on the stability behavior is neglected, and the porosity, $\phi$, is assumed constant. Even if the thermal conductivity of the rock and fluid system, $\kappa$, depends on water saturation, that dependence is expected to have a negligible impact on the stability behavior. The conservation of mass, or moles, for each of hydrocarbon component c can be written as $$\phi \frac{\partial}{\partial t}[x_c(K_c\rho_g S_g + \rho_o S_o)] = -\frac{\partial}{\partial x}[x_c(K_c\rho_g u_g + \rho_o u_o)] \tag{1}$$

Where $n_h$ is the number of hydrocarbon components, $n_h$ equations such as equation (1) are formulated. The conservation of the water component, where its presence in the gas phase is only considered for thermal problems, is given by $$\phi \frac{\partial}{\partial t}(K_w\rho_g S_g + \rho_w S_w) = -\frac{\partial}{\partial x}(K_w\rho_g u_g + \rho_w u_w) \tag{2}$$

For thermal systems, the overall energy balance can be written as follows $$\phi\frac{\partial}{\partial t}\left(\sum_p \rho_p U_p S_p\right) + (1-\phi)\frac{\partial}{\partial t}(\rho_r U_r) = -\frac{\partial}{\partial x}\left(\sum_p \rho_p H_p u_p\right) + \kappa\frac{\partial^2 T}{\partial x^2} \tag{3}$$

where $\Sigma_p$ indicates summation over all $n_p$ fluid phases.

An equation for the overall mass (mole) conservation is obtained by summing the conservation equations of all the hydrocarbon components together with the water equation as below.

$$\phi\frac{\partial}{\partial t}\left(\sum_p \rho_p S_p\right) = -\frac{\partial}{\partial x}\left(\sum_p \rho_p u_p\right) \tag{4}$$

This overall mass balance equation can be used to replace one of the component conservation equations (Eq. 1).

The following are chosen as primary variable set in the system of equations: gas-phase pressure, P; temperature, T; gas saturation $S_g$; water saturation, $S_w$; the compositions of $n_{h-1}$ hydrocarbon components in the oil phase $x_c$. Once all the primary variables are available, all the remaining secondary variables can be computed. The secondary variables include: oil and water pressures, oil saturation, hydrocarbon compositions in the gas phase, and water concentration in the gas.

Temperature Equation

It is noted that the component compositions do not appear explicitly in the overall energy balance. Second, in many steam injection processes, the vapor phase in a few grid-blocks, for example in the steam front or close to a steam injector, can quickly become nearly fully saturated with steam, while the compositions of the oil and water phases show small variations. Experience indicates that the derivatives of the energy balance with respect to component compositions can be important, especially when the gas phase had just appeared (i.e. $S_g$ is quite small). In these situations, however, the derivatives of the energy equation with respect to temperature are up to two orders of magnitude larger than those with respect to component compositions. It then makes sense to assume that the stability of the discrete overall energy balance is a weak function of changes in the composition of the fluid phases. So, the energy equation over a control-volume can be thought of as tracking multiple fluid phases with different energy content, but where the composition of the phases is nearly constant. Based on this assumption, the overall energy balance will be nearly independent of the various component conservation equations. With these considerations, a temperature equation for a system composed of $n_p$ phases is derived. Later, the results obtained under this assumption are validated for thermal problems with significant compositional effects.

The equations ($\phi$ assumed constant) are the $n_p$ mole conservation equations:

$$\phi\frac{\partial}{\partial t}(\rho_p S_p) = -\frac{\partial}{\partial x}(\rho_p u_p)\ \forall\ p = 1 \ldots n_p \tag{5}$$

Conservation of energy:

$$\phi\left(\frac{\partial}{\partial t}\sum_p \rho_p U_p S_p\right) + (1-\phi)\frac{\partial \rho_T U_T}{\partial t} = -\frac{\partial}{\partial x}\left(\sum_p \rho_p H_p u_p\right) + \frac{\partial}{\partial x}\left(\kappa\frac{\partial T}{\partial x}\right) \tag{6}$$

A. Pressure Equation

Developing the conservation of mole equations gives (assuming $\rho_p \neq 0$):

$$\phi\rho_p\frac{\partial S_p}{\partial t} + \phi\frac{\partial \rho_p}{\partial t}S_p = -\frac{\partial \rho_p}{\partial x}u_p - \rho_p\frac{\partial u_p}{\partial x}\ \forall\ p = 1 \ldots n_p \Leftrightarrow \phi\frac{\partial S_p}{\partial t} + \phi\frac{1}{\rho_p}\frac{\partial \rho_p}{\partial t}S_p = -\frac{1}{\rho_p}\frac{\partial \rho_p}{\partial x}u_p - \frac{\partial u_p}{\partial x}\ \forall\ p = 1 \ldots n_p \tag{7}$$

Summing all the equations gives the pressure equation:

$$\phi\sum_p \frac{1}{\rho_p}\frac{\partial \rho_p}{\partial t}S_p = -\sum_p \frac{1}{\rho_p}\frac{\partial \rho_p}{\partial x}u_p - \frac{\partial u_t}{\partial x} \tag{8}$$

The primary pressure P is the pressure of one of the phase.

Assuming spatial variation of the total velocity small, the pressure equation can be written as:

$$\phi\left(\sum_p \frac{1}{\rho_p}\frac{\partial \rho_p}{\partial P}S_p\right)\frac{\partial P}{\partial t} + \phi\left(\sum_p \frac{1}{\rho_p}\frac{\partial \rho_p}{\partial T}S_p\right)\frac{\partial T}{\partial t} = -\left(\sum_p \frac{1}{\rho_p}\frac{\partial \rho_p}{\partial T}u_p\right)\frac{\partial T}{\partial x} \tag{9}$$

B. Temperature Equation

Developing the energy equation gives (assuming κ constant):

$$\phi\sum_p \frac{\partial \rho_p U_p S_p}{\partial t} + (1-\phi)\frac{\partial \rho_r U_r}{\partial t} = -\sum_p \frac{\partial \rho_p H_p}{\partial x}u_p - \sum_p \rho_p H_p\frac{\partial u_p}{\partial x} + \kappa\frac{\partial^2 T}{\partial x^2} \tag{10}$$

Replacing $$\frac{\partial u_p}{\partial x}$$

from (7) in the energy equation gives:

$$\phi\sum_p\left(\frac{\partial \rho_p U_p S_p}{\partial t} - H_p\frac{\partial \rho_p S_p}{\partial t}\right) + (1-\phi)\frac{\partial \rho_r U_r}{\partial t} = -\sum_p\left(\frac{\partial \rho_p H_p}{\partial x} - H_p\frac{\partial \rho_p}{\partial x}\right)u_p + \kappa\frac{\partial^2 T}{\partial x^2} \tag{11}$$

With $\rho_p U_p = \rho_p H_p - \alpha P_p$ (α conversion factor psi↔ Btu/ft$^3$) the equation can be written as:

$$\phi\sum_p\left(\rho_p\frac{\partial H_p}{\partial t}S_p - \alpha\frac{\partial P_p S_p}{\partial t}\right) + (1-\phi)\frac{\partial \rho_r U_r}{\partial t} = -\sum_p \rho_p\frac{\partial H_p}{\partial x}u_p + \kappa\frac{\partial^2 T}{\partial x^2} \tag{12}$$

$$\left[\phi\sum_p \rho_p\frac{\partial H_p}{\partial T}S_p + (1-\phi)\frac{\partial \rho_r U_r}{\partial T}\right]\frac{\partial T}{\partial t} - \alpha_e\phi\sum_p P_p\frac{\partial S_p}{\partial t} + \phi\left(\sum_p \rho_p\frac{\partial H_p}{\partial P}S_p - \alpha_e\right)\frac{\partial P}{\partial t} = -\left(\sum_p \rho_p\frac{\partial H_p}{\partial T}u_p\right)\frac{\partial T}{\partial x} + \kappa\frac{\partial^2 T}{\partial x^2} \tag{13}$$

Replacing $$\frac{\partial P}{\partial t}$$

from the pressure equation (9) and defining $\gamma_s$ and $\gamma_u$ in (14) and (15) gives an equation in function of the temperature derivatives and the saturations derivatives:

$$\gamma_S = \sum_p \rho_p\frac{\partial H_p}{\partial T}S_p + \frac{1-\phi}{\phi}\frac{\partial}{\partial T}(\rho_r U_r) - \frac{\sum_p \rho_p\frac{\partial H_p}{\partial P}S_p - \alpha}{\sum_p \frac{1}{\rho_p}\frac{\partial \rho_p}{\partial P}S_p}\left(\sum_p \frac{1}{\rho_p}\frac{\partial \rho_p}{\partial T}S_p\right) \tag{14}$$

$$\gamma_u = \sum_p \rho_p\frac{\partial H_p}{\partial T}u_p - \frac{\sum_p \rho_p\frac{\partial H_p}{\partial P}S_p - \alpha}{\sum_p \frac{1}{\rho_p}\frac{\partial \rho_p}{\partial P}S_p}\left(\sum_p \frac{1}{\rho_p}\frac{\partial \rho_p}{\partial T}u_p\right)$$

$$\phi\gamma_S\frac{\partial T}{\partial t} - \alpha\phi\sum_p P_p\frac{\partial S_p}{\partial t} = -\gamma_u\frac{\partial T}{\partial x} + \kappa\frac{\partial^2 T}{\partial x^2} \tag{15}$$

This equation is a temperature equation only if the capillary pressures in the accumulation terms is neglected. For instance, for 3-phase problems with $S_g$ and $S_w$ as primary variables, $S_o = 1 - S_g - S_w$ and the saturation derivative term can be written as:

$$-\alpha\phi\sum_p P_p\frac{\partial S_p}{\partial t} = -\alpha\phi(P_g - P_o)\frac{\partial S_g}{\partial t} - \alpha\phi(P_w - P_o)\frac{\partial S_w}{\partial t} \approx 0 \tag{16}$$

Giving the advection/diffusion equation in temperature only:

$$\phi\gamma_S\frac{\partial T}{\partial t} = -\gamma_u\frac{\partial T}{\partial x} + \kappa\frac{\partial^2 T}{\partial x^2} \tag{17}$$

Discretizing these linear equations with forward Euler schemes for time and length and analyzing the errors growth by the Von Neumann method will result in CFL for the explicit treatment of the temperature composed of a convection term function of the phase volumetric rates $q_p$ and a conduction term proportional to the heat transmissibility $\overline{T}h$:

$$CFLT = \Delta t\left|\frac{1}{\phi V}\frac{\gamma_q}{\gamma_S} + \frac{\overline{T}_h}{\phi V}\frac{2}{\gamma_S}\right| < 1 \tag{18}$$

$$\gamma_q = \sum_p \rho_p \frac{\partial H_p}{\partial T} q_p - \frac{\sum_p \rho_p \frac{\partial H_p}{\partial P} S_p - \alpha_e}{\sum_p \frac{1}{\rho_p}\frac{\partial \rho_p}{\partial P} S_p}\left(\sum_p \frac{1}{\rho_p}\frac{\partial \rho_p}{\partial T} q_p\right)$$

Coupled Thermal-Compositional System

Thermal multi-component multiphase flow in porous media can be described using the following system of coupled conservation equations:

- $(n_h-1)$ hydrocarbon-component conservation equations. With each equation, the corresponding hydrocarbon composition in the liquid phase (for compositional and black-oil systems only) is aligned as the primary unknown.
- $(n_p-1)$ 'saturation equations'. Namely, the conservation equation for total mass (moles) and the conservation equation for the water component. The saturation of gas and water are aligned, respectively, with these two equations. For a two-phase system, one equation and one saturation are used; the specific choice depends on the phase state.
- The temperature equation (overall energy balance) is aligned with the temperature variable.

Let X denote the vector of $n_h-1$ oil compositions and S the vector of phase saturations $(S_g,S_w)$. The following assumptions are made: (1) the derivatives with respect to pressure are negligible, (2) the dependence of fluid properties on composition is weak, (3) spatial variation of the total-velocity is small (i.e., $\partial u_t/\partial_x \approx 0$), and (4) the cross-derivative terms are negligible. Based on these considerations, the nonlinear system of conservation equations can be reduced to the following coupled linear convection-dispersion equations:

$$\begin{pmatrix} C_{XX} & C_{XS} & C_{XT} \\ & C_{SS} & C_{ST} \\ & & C_{TT} \end{pmatrix}\begin{pmatrix} \partial_t X \\ \partial_t S \\ \partial_t T \end{pmatrix} = -\begin{pmatrix} L_{XX} & L_{XS} & L_{XT} \\ & L_{SS} & L_{ST} \\ & & L_{TT} \end{pmatrix}\begin{pmatrix} \partial_t X \\ \partial_t S \\ \partial_t T \end{pmatrix} + \begin{pmatrix} & M_{XS} & M_{XT} \\ & M_{SS} & M_{ST} \\ & & M_{TT} \end{pmatrix}\begin{pmatrix} \partial_x^2 X \\ \partial_x^2 S \\ \partial_x^2 T \end{pmatrix} \tag{19}$$

Note that the equations are ordered as follows: the first block-row is composed of $n_h-1$ component mass balances; the second block row is composed of $n_p-1$ equations, which for three-phase flow are the balances of overall-mass and water; the last row is the temperature equation. The primary variables are ordered as $(X,S,T)^T$.

In Eq. 19, the second block-row (saturation equations) is independent of the composition vector, X, and the last row (temperature equation) is decoupled from both X and S. Using the temperature equation and the overall mass balance and water equations to eliminate the off diagonal terms on the left-hand-side, the following is obtained:

$$\begin{pmatrix} C_{XX} & & \\ & C_{SS} & \\ & & C_{TT} \end{pmatrix}\begin{pmatrix} \partial_t X \\ \partial_t S \\ \partial_t T \end{pmatrix} = -\begin{pmatrix} L_{XX} & L'_{XS} & L'_{XT} \\ & L_{SS} & L'_{ST} \\ & & L_{TT} \end{pmatrix}\begin{pmatrix} \partial_x X \\ \partial_x S \\ \partial_x T \end{pmatrix} + \begin{pmatrix} & M'_{XS} & M'_{XT} \\ & M_{SS} & M'_{ST} \\ & & M_{TT} \end{pmatrix}\begin{pmatrix} \partial_x^2 X \\ \partial_x^2 S \\ \partial_x^2 T \end{pmatrix} \tag{20}$$

Application of the inverse of the diagonal left-hand-side matrix gives a coupled system of linear convection-dispersion equations:

$$\begin{pmatrix} \partial_t X \\ \partial_t S \\ \partial_t T \end{pmatrix} = -L\begin{pmatrix} \partial_x X \\ \partial_x S \\ \partial_x T \end{pmatrix} + M\begin{pmatrix} \partial_x^2 X \\ \partial_x^2 S \\ \partial_x^2 T \end{pmatrix} \tag{21}$$

where $$L = \begin{pmatrix} C_{XX}^{-1}L_{XX} & C_{XX}^{-1}L'_{XS} & C_{XX}^{-1}L'_{XT} \\ 0 & C_{SS}^{-1}L_{SS} & C_{SS}^{-1}L'_{ST} \\ 0 & 0 & C_{TT}^{-1}L_{TT} \end{pmatrix} \tag{22}$$

and $$M = \begin{pmatrix} 0 & C_{XX}^{-1}M'_{XS} & C_{XX}^{-1}M'_{XT} \\ 0 & C_{SS}^{-1}M_{SS} & C_{SS}^{-1}M'_{ST} \\ 0 & 0 & C_{TT}^{-1}M_{TT} \end{pmatrix} \tag{23}$$

It is shown below that the stability of the discrete linear system depends on the diagonal entries in L and M.

The composition term has the following form $$C_{XX}^{-1}L_{XX} = \frac{1}{\phi}\begin{pmatrix} \xi_1 & & \\ & \ddots & \\ & & \xi_{n_h-1} \end{pmatrix} \tag{24}$$

where $$\xi_c = \frac{K_c\rho_g u_g + \rho_o u_o}{K_c\rho_g S_g + \rho_o S_o} \tag{25}$$

is the ratio of the mass (moles) of component, c, flowing out of the gridblock to the amount of component c in the gridblock.

For a three-phase system, whether thermal or isothermal, the saturation terms are given by:

$$C_{SS}^{-1}L_{SS} = \frac{u_t}{\phi}\begin{pmatrix} \frac{\partial f_g}{\partial S_g} & \frac{\partial f_g}{\partial S_w} \\ \frac{\partial f_w}{\partial S_g} & \frac{\partial f_w}{\partial S_w} \end{pmatrix} = \frac{u_t}{\phi}F \tag{26}$$

where F is the matrix of fractional flow derivatives. And, $$C_{SS}^{-1}M_{SS} = \frac{k}{\phi}Q, \text{ where} \tag{27}$$

-continued $$Q = \begin{pmatrix} \bar{\lambda}_{gw} P'_{c_{WO}} & (\bar{\lambda}_{go} + \bar{\lambda}_{gw}) P'_{c_{GO}} \\ -(\bar{\lambda}_{gw} + \bar{\lambda}_{ow}) P'_{c_{WO}} & -\bar{\lambda}_{gw} P'_{c_{GO}} \end{pmatrix}$$

The proofs for Eqs. 26 and 27 are shown in the section "Thermal Saturation System" below. For a two-phase system, the saturation terms are:

$$C_{SS}^{-1} L_{SS} = \frac{u_t}{\phi} \frac{\partial f_p}{\partial S_p} \tag{28}$$

and $$C_{SS}^{-1} M_{SS} = \frac{k}{\phi} \bar{\lambda} P'_c \tag{29}$$

The terms related to the energy, or temperature, equation, for either two or three-phase systems are given by:

$$C_{TT}^{-1} L_{TT} = \frac{\gamma_u}{\phi \gamma_S} \tag{30}$$

and $$C_{TT}^{-1} M_{TT} = \frac{\kappa}{\phi \gamma_S} \tag{31}$$

Stability Analysis

In this section, the results of the stability analysis on the entire linear discrete thermal-compositional system is reported.

Eq. 21 is discretized using explicit first-order (forward Euler) time discretization. First-order spatial derivatives are discretized using single-point upstream weighting, and second-order derivatives are represented using centered differences. Linear stability analysis of this coupled discrete thermal-compositional system is performed. Specifically, a Von Neumann analysis is applied, in which the growth of small errors as a function of time is analyzed. The details of the methodology are shown in the Appendix.

Here, the expressions of the comprehensive stability criteria for explicit treatment of compositions, saturations and temperature is given:

The CFL criterion for the explicit treatment of each hydrocarbon composition c is:

$$CFLX_c = \Delta t \left| \frac{1}{\phi V} \frac{K_c \rho_g q_g + \rho_o q_o}{K_c \rho_g S_g + \rho_o S_o} \right| < 1 \tag{32}$$

These expressions basically state that the mass (moles) flowing out of a gridblock in a time step cannot exceed the mass (moles) in the gridblock.

The CFL for the explicit treatment of saturation in a two-phase system is:

$$CFLS_p = \Delta t \left| \frac{q_t}{\phi V} \frac{\partial f_p}{\partial S_p} + 2 \frac{\bar{T}}{\phi V} \bar{\lambda} P'_c \right| < 1 \tag{33}$$

The CFL for the explicit treatment of saturation in a three-phase system is expressed as the eigenvalues of a two by two matrix system:

$$CFLS = \Delta t \left| \frac{q_t}{\phi V} F + 2 \frac{\bar{T}}{\phi V} Q \right| < 1 \tag{34}$$

The CFL for the explicit treatment of temperature is:

$$CFLT = \Delta t \left| \frac{1}{\phi V} \frac{\gamma_q}{\gamma_S} + \frac{\bar{T}_h}{\phi V} \frac{2}{\gamma_S} \right| < 1 \tag{35}$$

with $$\gamma_q = \sum_p \rho_p \frac{\partial H_p}{\partial T} q_p - \frac{\sum_p \rho_p \frac{\partial H_p}{\partial P} S_p - \alpha_e}{\sum_p \frac{1}{\rho_p} \frac{\partial \rho_p}{\partial P} S_p} \left( \sum_p \frac{1}{\rho_p} \frac{\partial \rho_p}{\partial T} q_p \right) \tag{36}$$

Note that the CFL criterion for explicit treatment of compositions contains convection terms only. This is because the effects of physical dispersion in the component conservation equations is neglected. The CFL criteria for explicit treatment of saturation and temperature contain both convection and dispersion terms. In the case of the saturation CFL expressions, the dispersion term is proportional to the derivative of the capillary pressure with respect to saturation, which is usually small and often neglected in large-scale numerical reservoir simulation. The dispersion term in the temperature CFL expressions, on the other hand, represents thermal conduction, which can be more significant than the heat convection term for some thermal processes of practical interest.

Thermal Saturation System

In this section, the saturation system for thermal problems is shown to be the same as the saturation system for isothermal flows. The matrices of interest for the thermal saturation system are (written with $\rho_{pq} = \rho_p - \rho_q$):

$$C_{XX} = \phi \begin{pmatrix} \rho_{go} & \rho_{wo} \\ K_w \rho_g & \rho_w \end{pmatrix} \tag{37}$$

$$L_{XX} = u_t \begin{pmatrix} \rho_{go} \frac{\partial f_g}{\partial S_g} + \rho_{wo} \frac{\partial f_w}{\partial S_g} & \rho_{go} \frac{\partial f_g}{\partial S_w} + \rho_{wo} \frac{\partial f_w}{\partial S_w} \\ K_w \rho_g \frac{\partial f_g}{\partial S_g} + \rho_w \frac{\partial f_w}{\partial S_g} & K_w \rho_g \frac{\partial f_g}{\partial S_w} + \rho_w \frac{\partial f_w}{\partial S_w} \end{pmatrix} \tag{38}$$

$$M_{XX} = \begin{pmatrix} (\rho_{go} \alpha_g + \rho_{wo} \alpha_w) P'_{C_{WO}} & (\rho_{go} \beta_g + \rho_{wo} \beta_w) P'_{C_{GO}} \\ (K_w \rho_g \alpha_g + \rho_w \alpha_w) P'_{C_{WO}} & (K_w \rho_g \beta_g + \rho_w \beta_w) P'_{C_{GO}} \end{pmatrix} \tag{39}$$

where $$\begin{aligned} \alpha_g &= k \bar{\lambda}_{gw} \\ \beta_g &= k(\bar{\lambda}_{go} + \bar{\lambda}_{gw}) \\ \alpha_w &= -k(\bar{\lambda}_{gw} + \bar{\lambda}_{ow}) \\ \beta_w &= -k \bar{\lambda}_{gw} \end{aligned} \tag{40}$$

Setting $$\alpha = \frac{\rho_{wo}}{\rho_{go}}, \beta = \frac{K_w \rho_g}{\rho_w}$$

and multiplying by $$\begin{pmatrix} \frac{1}{\rho_{go}} & \\ & \frac{1}{\rho_w} \end{pmatrix}$$

the following expressions are obtained $$\begin{pmatrix} \frac{1}{\rho_{go}} & \\ & \frac{1}{\rho_w} \end{pmatrix} C_{XX} = \phi \begin{pmatrix} 1 & \alpha \\ \beta & 1 \end{pmatrix} \tag{41}$$

$$\begin{pmatrix} \frac{1}{\rho_{go}} & \\ & \frac{1}{\rho_w} \end{pmatrix} L_{XX} = u_t \begin{pmatrix} \frac{\partial f_g}{\partial S_g} + \alpha \frac{\partial f_w}{\partial S_g} & \frac{\partial f_g}{\partial S_w} + \alpha \frac{\partial f_w}{\partial S_w} \\ \beta \frac{\partial f_g}{\partial S_g} + \frac{\partial f_w}{\partial S_g} & \beta \frac{\partial f_g}{\partial S_w} + \frac{\partial f_w}{\partial S_w} \end{pmatrix} \tag{42}$$

$$\begin{pmatrix} \frac{1}{\rho_{go}} & \\ & \frac{1}{\rho_w} \end{pmatrix} M_{XX} = \begin{pmatrix} (\alpha_g + \alpha\alpha_w) P'_{C_{WO}} & (\beta_g + \alpha\beta w) P'_{C_{GO}} \\ (\beta\alpha_g + \alpha_w) P'_{C_{WO}} & (\beta\beta_g + \beta_w) P'_{C_{GO}} \end{pmatrix} \tag{43}$$

For an isothermal model, water does not partition in the gas phase; therefore, Kw=0 or β=0. By setting this constraint, the thermal system reduces to an isothermal one. Notice that the matrices $$\begin{pmatrix} \frac{1^-}{\rho_{go}} & \\ & \frac{1}{\rho_w} \end{pmatrix} L_{XX} \text{ and } \begin{pmatrix} \frac{1}{\rho_{go}} & \\ & \frac{1}{\rho_w} \end{pmatrix}$$

$M_{XX}$ are both of the form:

$$\begin{pmatrix} a + \alpha b & c + \alpha d \\ \beta a + b & \beta c + d \end{pmatrix} \tag{44}$$

Also notice that:

$$\begin{pmatrix} 1 & \alpha \\ \beta & 1 \end{pmatrix}^{-1} \begin{pmatrix} a + \alpha b & c + \alpha d \\ \beta a + b & \beta c + d \end{pmatrix} = \begin{pmatrix} a & c \\ b & d \end{pmatrix} \tag{45}$$

Consequently, $$C_{XX}^{-1} A = C_{XX}^{-1} \begin{pmatrix} \rho_{go} & \\ & \rho_w \end{pmatrix} \begin{pmatrix} \frac{1}{\rho_{go}} & \\ & \frac{1}{\rho_w} \end{pmatrix} A = \left[ \begin{pmatrix} \frac{1}{\rho_{go}} & \\ & \frac{1}{\rho_w} \end{pmatrix} C_{XX} \right]^{-1} \left[ \begin{pmatrix} \frac{1}{\rho_{go}} & \\ & \frac{1}{\rho_w} \end{pmatrix} A \right] \tag{46}$$

It follows that $$C_{XX}^{-1} L_{XX} = \frac{u_t}{\phi} \begin{pmatrix} \frac{\partial f_g}{\partial S_g} & \frac{\partial f_g}{\partial S_w} \\ \frac{\partial f_w}{\partial S_g} & \frac{\partial f_w}{\partial S_w} \end{pmatrix} \tag{47}$$

$$C_{XX}^{-1} M_{XX} = \frac{1}{\phi} \begin{pmatrix} \alpha_g P'_{C_{WO}} & \beta_g P'_{C_{GO}} \\ \alpha_w P'_{C_{WO}} & \beta_w P'_{C_{GO}} \end{pmatrix} \tag{48}$$

This shows that $C_{XX}^{-1} L_{XX}$ and $C_{XX}^{-1} M_{XX}$ do not depend on the value of α and β, and that the thermal case with β=0 is the same as the isothermal case.

Stability Analysis and Decoupling of CFL Criteria

A linear stability analysis of the linear multidimensional convection dispersion system of coupled equations for thermal-compositional flows is performed to derive the following equation:

$$\begin{pmatrix} \partial_t X \\ \partial_t S \\ \partial_t T \end{pmatrix} = -L \begin{pmatrix} \partial_x X \\ \partial_x S \\ \partial_x T \end{pmatrix} + M \begin{pmatrix} \partial_x^2 X \\ \partial_x^2 S \\ \partial_x^2 T \end{pmatrix} \tag{49}$$

The linear system is discretized using the standard low-order discretization schemes, which are widely used in the industry. The stability of the discrete linear system is studied by the von Neumann method, which is based on Fourier series decomposition. A linear system has the property that if an instability is introduced to the solution, each frequency of the instability is also a solution of the system. A necessary condition for stability is that all the frequencies of the error decay with time.

Let ϵ denote the solution error of each variable in the vectors X, S and T, and βϵ as the frequency of these errors. The error, ϵ, satisfies the linear system Eq. 49. Discretizing the time derivative using a first-order forward Euler approximation and the first-order spatial derivative using single-point upstream weighting can be written for gridblock i:

$$\frac{\partial \varepsilon}{\partial t} = \frac{\varepsilon^{n+1} e^{j\beta_\varepsilon i} - \varepsilon^n e^{j\beta_\varepsilon i}}{\Delta t} = e^{j\beta_\varepsilon i} \frac{\varepsilon^{n+1} - \varepsilon^n}{\Delta t} \tag{50}$$

$$\frac{\partial \varepsilon}{\partial x} = \frac{\varepsilon^n e^{j\beta_\varepsilon i} - \varepsilon^n e^{j\beta_\varepsilon (i-1)}}{\Delta x} = \varepsilon^n e^{j\beta_\varepsilon i} \frac{1 - e^{-j\beta_\varepsilon}}{\Delta x} \tag{51}$$

$$\frac{\partial^2 \varepsilon}{\partial x^2} = -\varepsilon^n e^{j\beta_\varepsilon i} \frac{2}{\Delta x^2} (1 - \cos\beta_\varepsilon) \tag{52}$$

Introducing the discretized values into the linear system Eq. 49, and after some algebraic manipulations the following amplification system is obtained:

$$\xi^{n+1} = \left( I - \Delta t N_{\beta_{\varepsilon X}, \beta_{\varepsilon S}, \beta_{\varepsilon T}} \right) \xi^n \tag{53}$$

where $\beta\epsilon_x$ and $\beta\epsilon_s$ are vectors of frequencies, one composition or saturation per variable.

Since the eigenvectors of the amplification matrix are the same as the eigenvectors of the $N_{\beta\epsilon_X, \beta e_S, \beta e_T}$ matrix, the system is stable if for all the frequencies ($\beta\epsilon_X$, $\beta\epsilon_S$, $\beta\epsilon_T$) the eigenvalues $\lambda_{\beta e_X,\beta e_S,\beta \epsilon_T}$ of the $N_{\beta \epsilon_X,\beta \epsilon_S,\beta e_T}$ matrix satisfy the condition:

$$|1-\Delta t\, \lambda_{\beta e_X,\beta \epsilon_S,\beta e_T}|<1 \tag{54}$$

When there is only one equation (for instance if one only looks at the temperature equation), the extremum amplitude is reached at the frequency $\beta=\pi$. Since $$N_\pi = 2\frac{L^-}{\Delta x} + 4\frac{\dot{M}}{\Delta x^2},$$

the stability criterion is equivalent to:

$$\left|1 - \Delta t \times 2\left(\frac{L}{\Delta x} + 2\frac{M}{\Delta x^2}\right)\right| < 1 \tag{55}$$

In practice $$\frac{L}{\Delta x} + 2\frac{M}{\Delta x^2}$$

is real and positive, resulting in the CFL criterion:

$$\Delta t\left(\frac{L}{\Delta x} + 2\frac{M}{\Delta x^2}\right) < 1 \tag{56}$$

For the general system of coupled equations, since the L and M matrices in Eqs. 22 and 23 are block triangular, the $N_{\beta \epsilon_X,\beta e_S,\beta e_T}$ matrix is also block triangular. This means that the eigenvalues of $N_{\beta \epsilon_X,\beta e_S,\beta e_T}$ are the eigenvalues of its block diagonal. It is then possible to decouple the conditions on the compositions X, saturation S, and temperature T into 3 separate criteria:

$$|1-\Delta t\, N_{\beta \epsilon_X}{}^{X}|<1 \tag{57}$$

$$|1-\Delta t\, N_{\beta e_S}{}^{S}|<1 \tag{58}$$

$$|1-\Delta t\, N_{\beta e_T}{}^{T}|<1 \tag{59}$$

with their associated eigenvalues:

$$|1-\Delta t\, \lambda_{\beta \epsilon_X}{}^{X}|<1 \tag{60}$$

$$|1-\Delta t\, \lambda_{\beta e_S}{}^{S}|<1 \tag{61}$$

$$|1-\Delta t\, \lambda_{\beta e_T}{}^{T}|<1 \tag{62}$$

Moreover, as shown in Eq. 24, the hydrocarbon composition matrix is diagonal. This allows us to decouple the hydrocarbon component conservation equations from each other. Since one equation can be dealt with at a time, the extremum amplitude is reached at the frequency $\beta=\pi$ for every composition. This gives CFL limit for the explicit treatment of each hydrocarbon component c in Eq. 32.

For two-phase systems, since there is only one saturation equation, the extremum amplitude is reached at the frequency $\beta=\pi$. Consequently, the CFL for the explicit treatment of saturation, $S_p$, is given by Eq. 33. For three-phase systems, there are two saturation equations ($S_g$ and $S_w$), and they cannot be decoupled. Extensive testing (Coats 2003) in the isothermal cases indicates that taking $\beta S_g=\beta S_w=\pi$ is a reasonable measure of the stability of the system. Since $$N^S_{\pi,\pi} = \frac{2}{\Delta x} C^{-1}_{SS} L_{SS} + \frac{4}{\Delta x^2} C^{-1}_{SS} M_{SS},$$

$\lambda_{2S}$ are defined as the eigenvalues of the matrix $$\frac{1}{\Delta x} C^{-1}_{SS} L_{SS} + \frac{2}{\Delta x^2} C^{-1}_{SS} M_{SS}.$$

The stability limit is then given by:

$$|1-\Delta t \times 2\lambda_{2S}|<1 \tag{63}$$

In practice, these $\lambda_{2S}$ are real and positive resulting in the following CFL criteria, which is stated in Eq. 34, $$\Delta t\, \lambda_{2S}<1 \tag{64}$$

For the temperature equation, the extremum amplitude is reached at the frequency $\beta=\pi$, and the CFL for the explicit treatment of the temperature T is given in Eq. 35.

As mentioned above, the method (described above and shown in the FIGS. 1-9) has been tested in several exemplary cases related to the oilfield, additional test results are depicted in the examples of FIGS. 10-33.

Water Injection in Dead-Oil Reservoir

Figure 10:
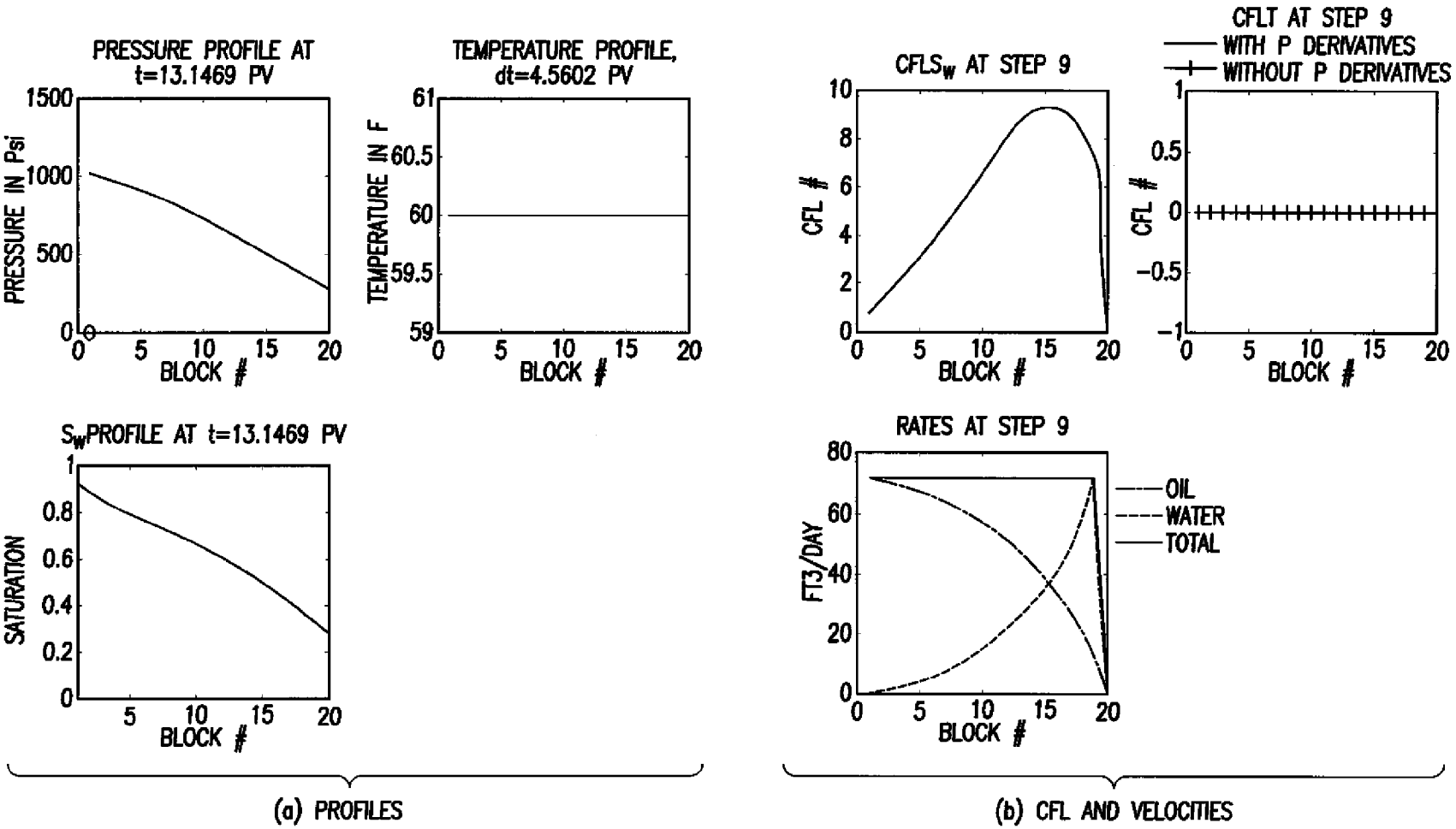
FIGS. 10-33 depict exemplary test results related to a thermal adaptive implicit method.
Figure 11:
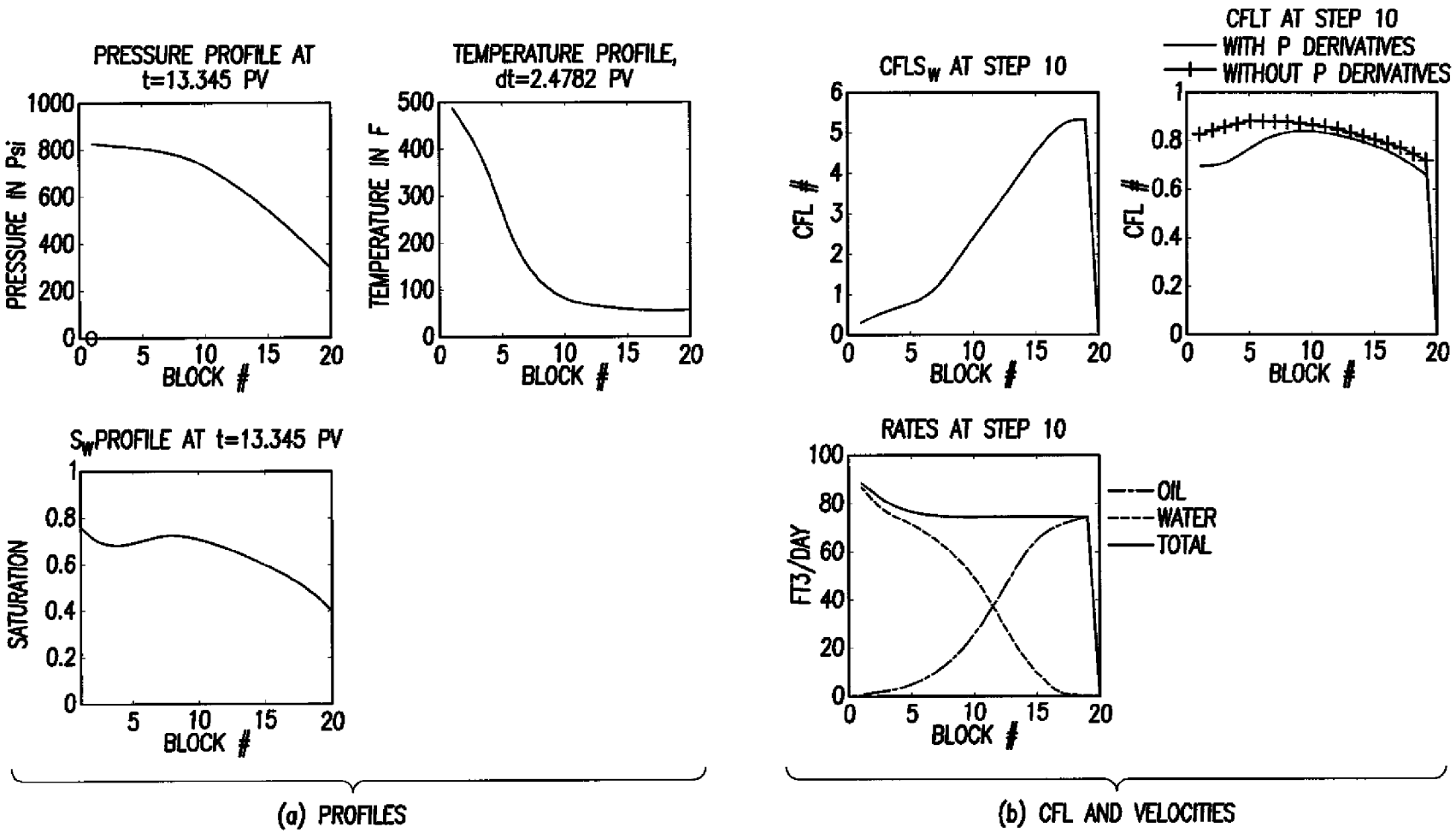

In FIGS. 10 and 11, the total velocity profiles for an isothermal and a thermal run are shown. In both simulations a constant rate of water is injected. For the isothermal case, the oil and water phase velocities sums to a constant velocity along the reservoir. However, it is noted that this is not the case anymore for the thermal case where a slight hook is observed in velocity for cells 1-3 caused by temperature effects. Throughout the exemplary cases, it is important to control how the partial derivative $u_t$ with respect to x is evolving. The linear analysis is based on the fact that this term can be neglected against the other derivatives.

Test CFLS

Figure 12:
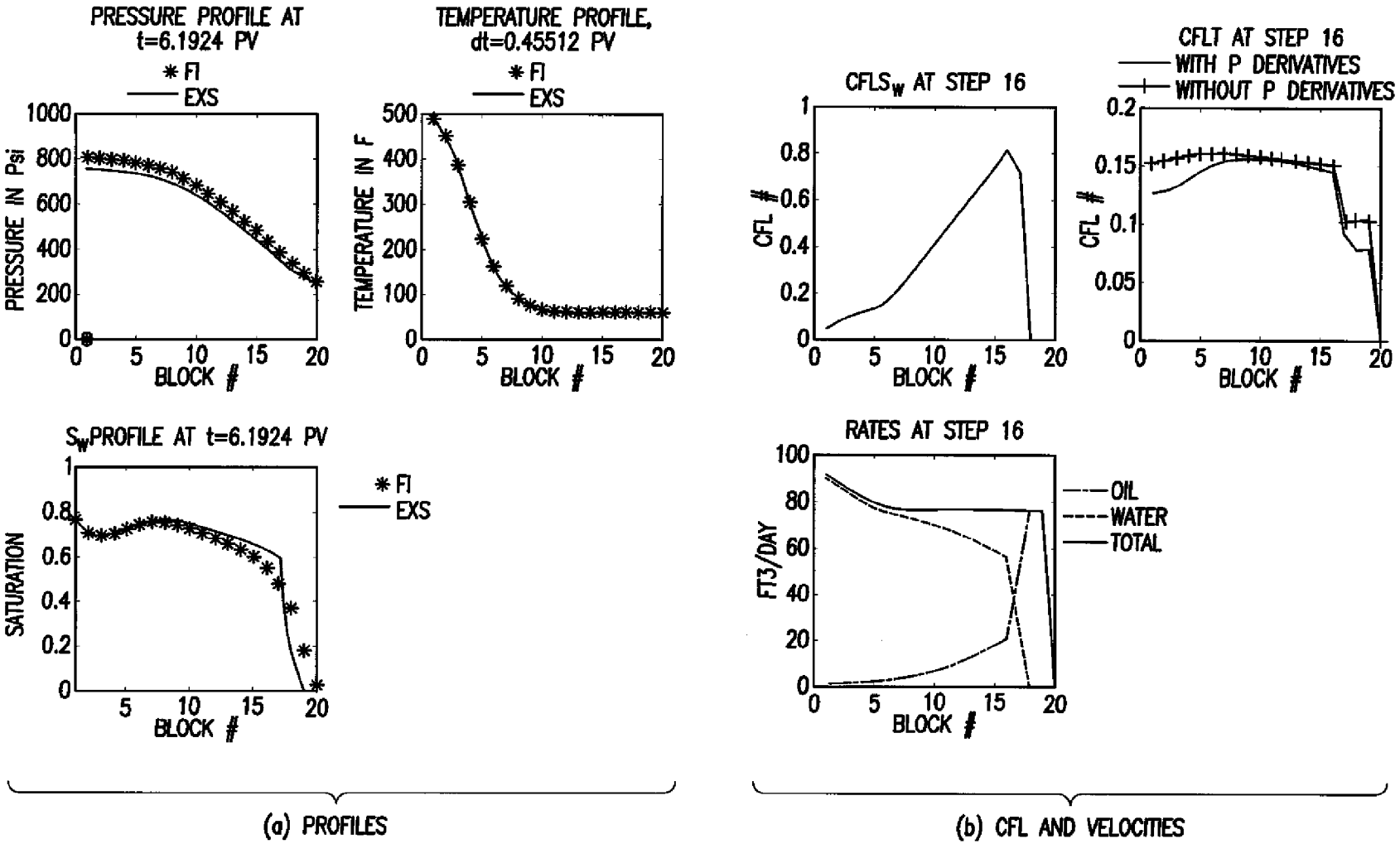
Figure 13:
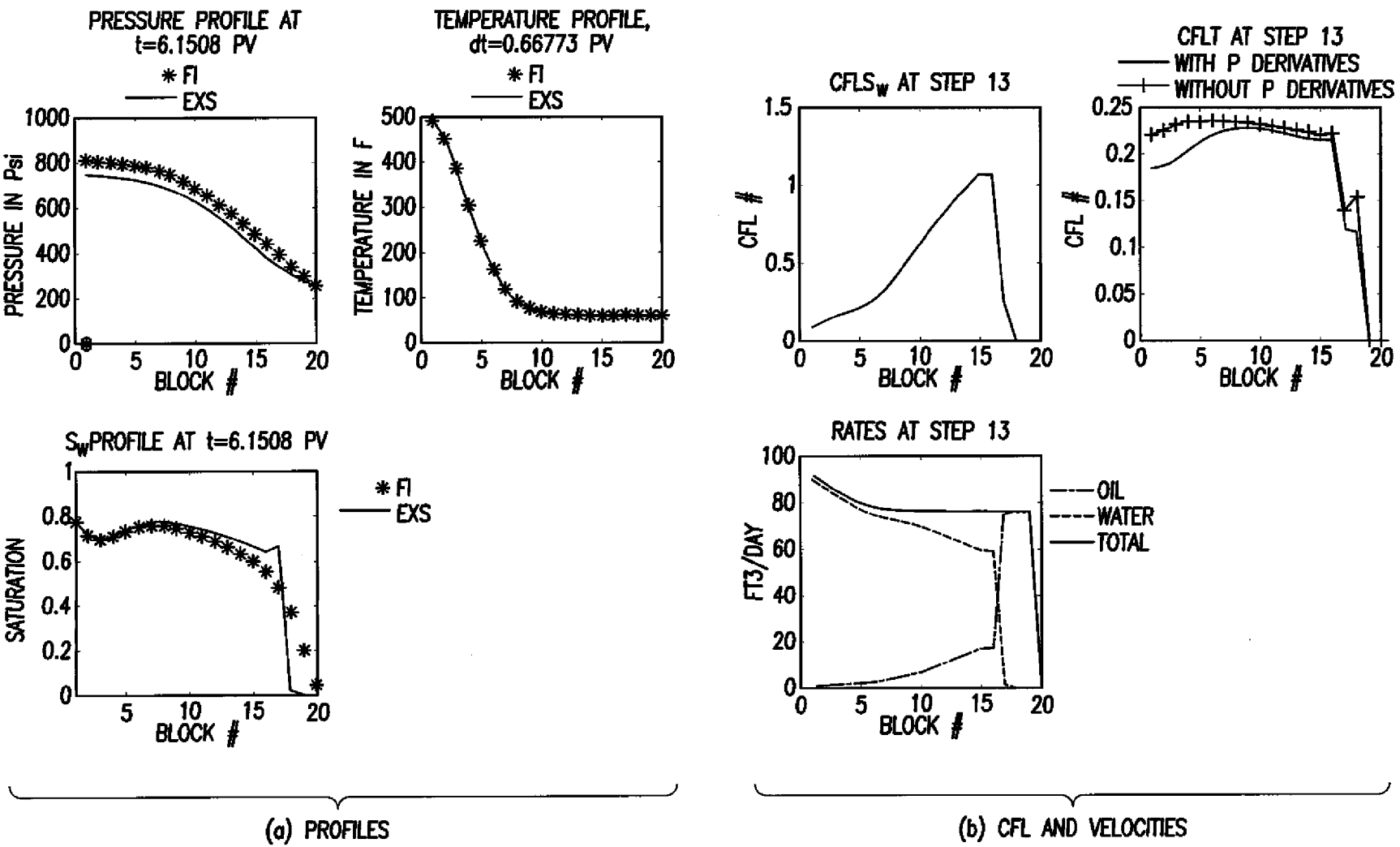
Figure 14:
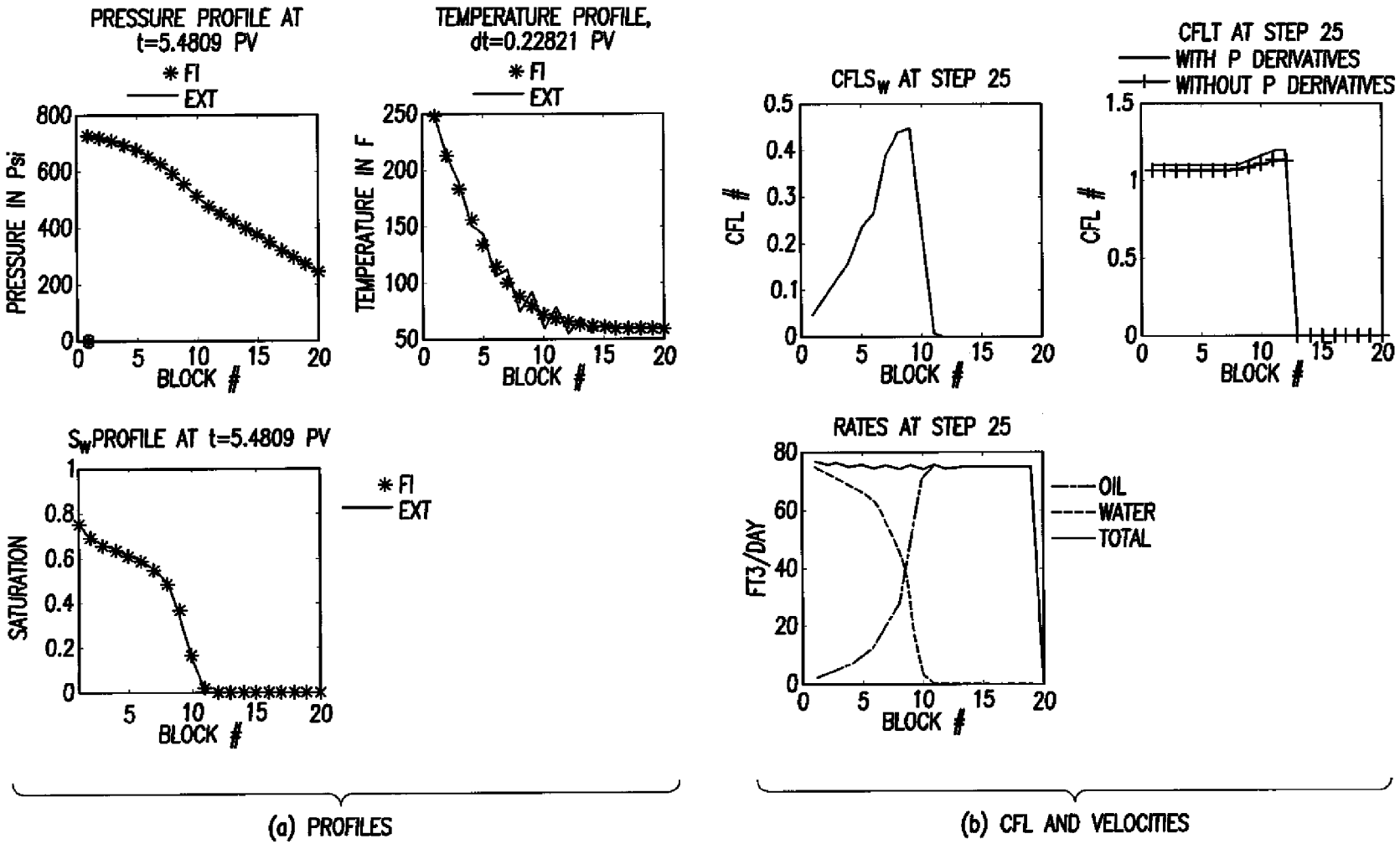

Runs have been done with only saturations taken explicit with the time step controlled by 0.9 CFLS, 1 CFLS and 1.1 CFLS (CFLT around 0.2). The results for the 0.9 CFLS case is shown in FIG. 12. Fully implicit runs with exactly the same time steps have been done after to check the accuracy of the explicit saturations run. It is observed that the explicit saturations solution behaves correctly, with a front with less diffusion as for the fully implicit run. For the run controlled by 1 CFLS, a time step converges with CFLS=1.04 and it is enough to get a small oscillation in the saturation profile (not shown). Results are plotted in FIG. 13 for the run at 1.1 CFLS. This oscillation is seen after 4 time steps. It can be concluded from these tests cases that CFLS is very sharp. However, one can argue saying that the temperature variation is not very big and the intent is to clearly assess the isothermal CFLS. Accordingly, it is necessary to have a test case with the variation of saturation and temperature occurring in the same cells.

Test CFLT

In the fully implicit test case in FIG. 11, CFLS goes up to 6 and CFLT rarely goes above 1. To achieve a fully implicit case that can run easily above CFLT, the heat conductivity has been un-physically increased from 25 to 5000 Btu/ft/day/degF.

In this case, when running the fully implicit simulation, CFLS goes up to 10 and CFLT up to 22. When running an explicit temperature simulation run at 1 CFL, no issue is noticed (not printed) but if the simulation is run at 1.2 CFL, it is observed (after 6 time steps) that an oscillation of the temperature profile grows larger and larger. A fully implicit simulation run with the same time steps as the explicit temperature run is performed and the results of the 2 simulations are compared in FIG. 14.

Gas Injection in Dead-Oil Reservoir

Figure 15:
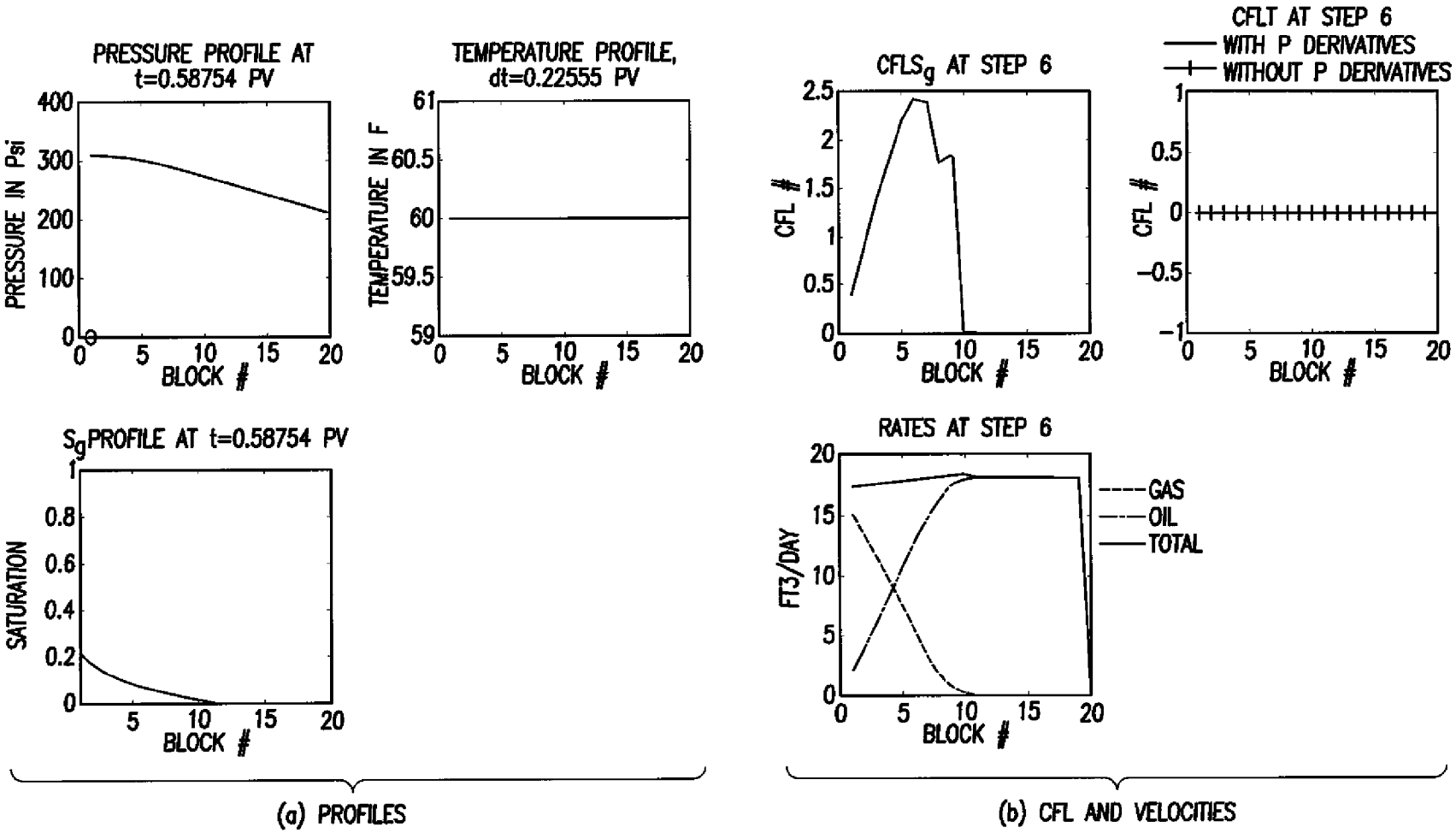
Figure 16:
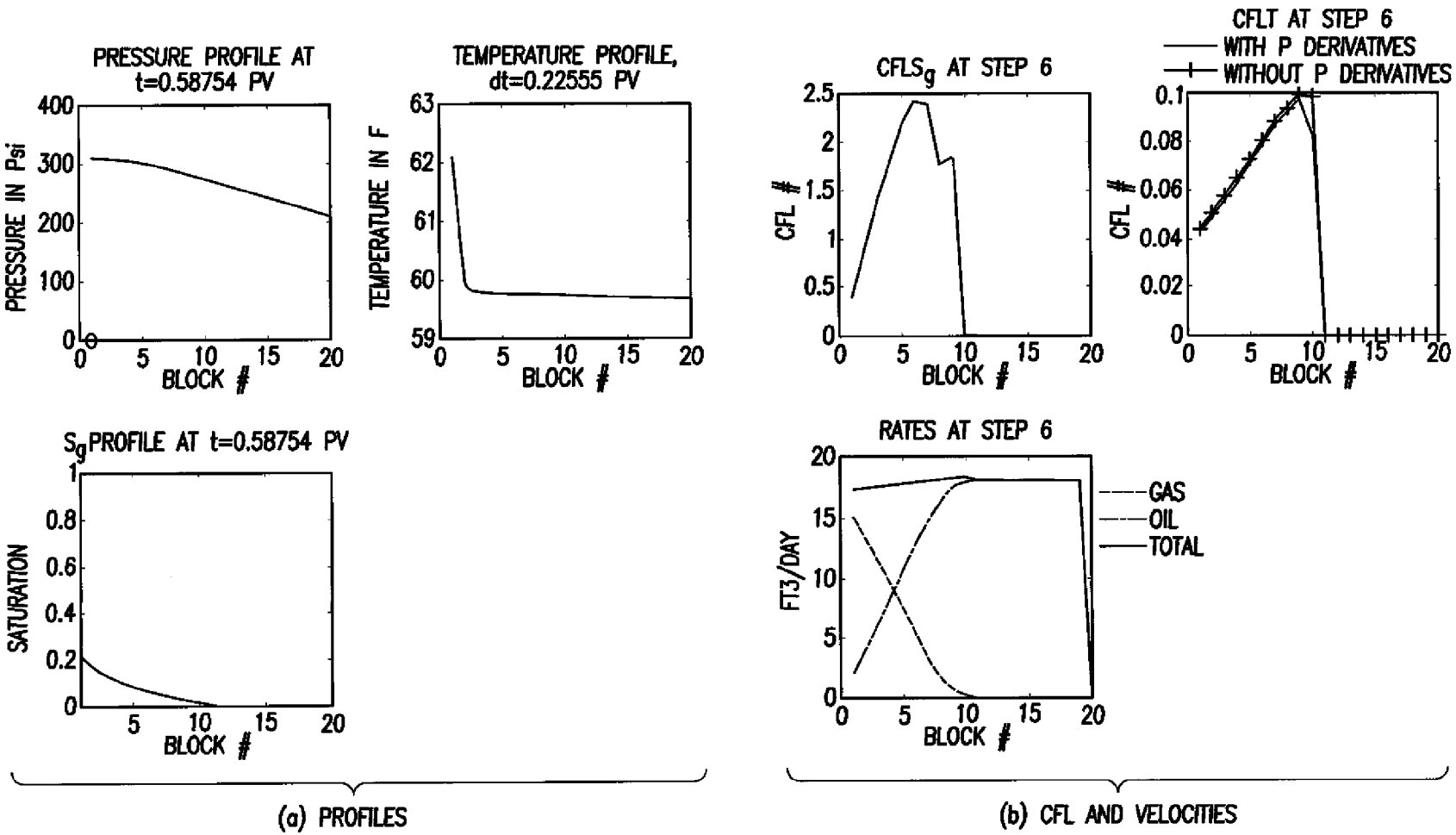
Figure 17:
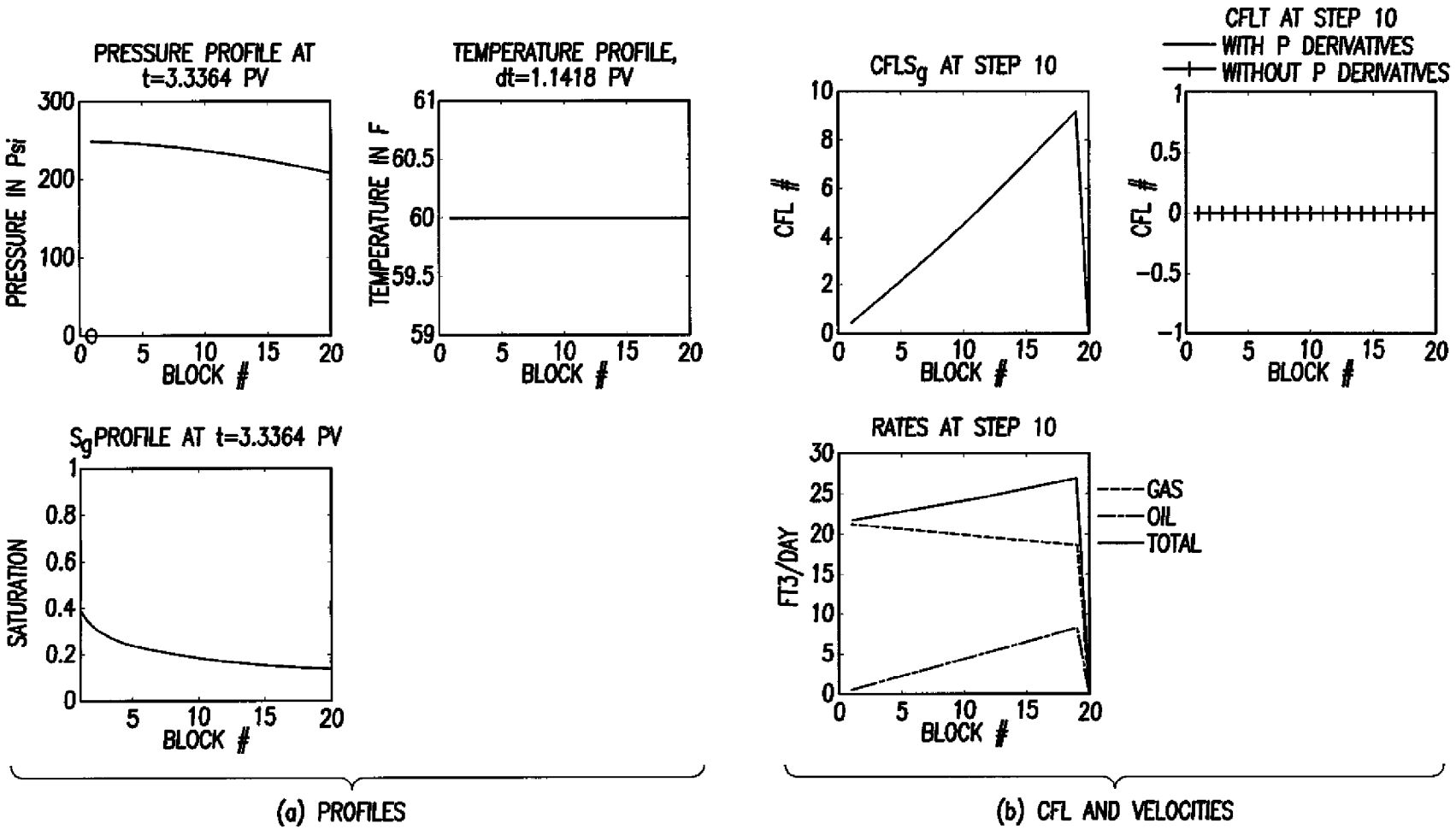
Figure 18:
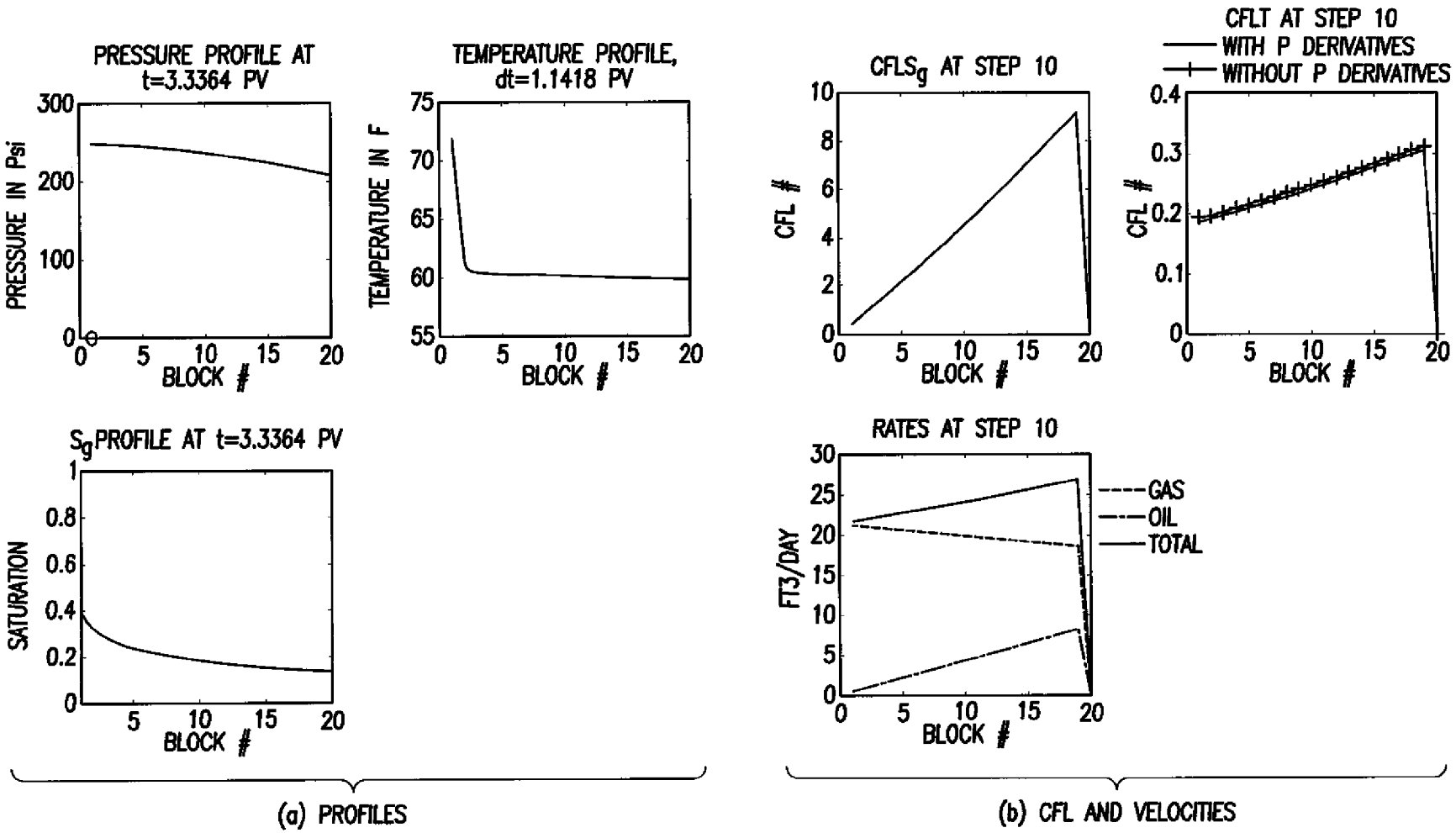

Now, turning to an example of the gas injection in a dead-oil reservoir as described below and depicted in FIGS. 15-22. As the total velocity profile is quite different depending upon whether viewed before or after the breakthrough, both of these 2 situations are studied. FIGS. 15 and 16 depict the total velocity profiles for an isothermal and a thermal run where gas has just started to be injected and has not made is way to the producer. In both simulations the same amount of gas is being injected. The total velocity is almost constant for both cases. CFLS goes up to 2.5 and CFLT up to 0.1. FIGS. 17 and 18 depict the total velocity profiles for an isothermal and a thermal run after breakthrough. The CFL are much larger due to the larger velocity. The total velocity profile is a little tilted. It is observed that CFLS goes up to 8 and CFLT to 0.3. It is then going to be easy to restrict the time step to study the effect of CFLS but some parameters need modification to study CFLT. It is also observed that a very slight hook in the velocity profile is caused by the temperature.

Test CFLS

Figure 19:
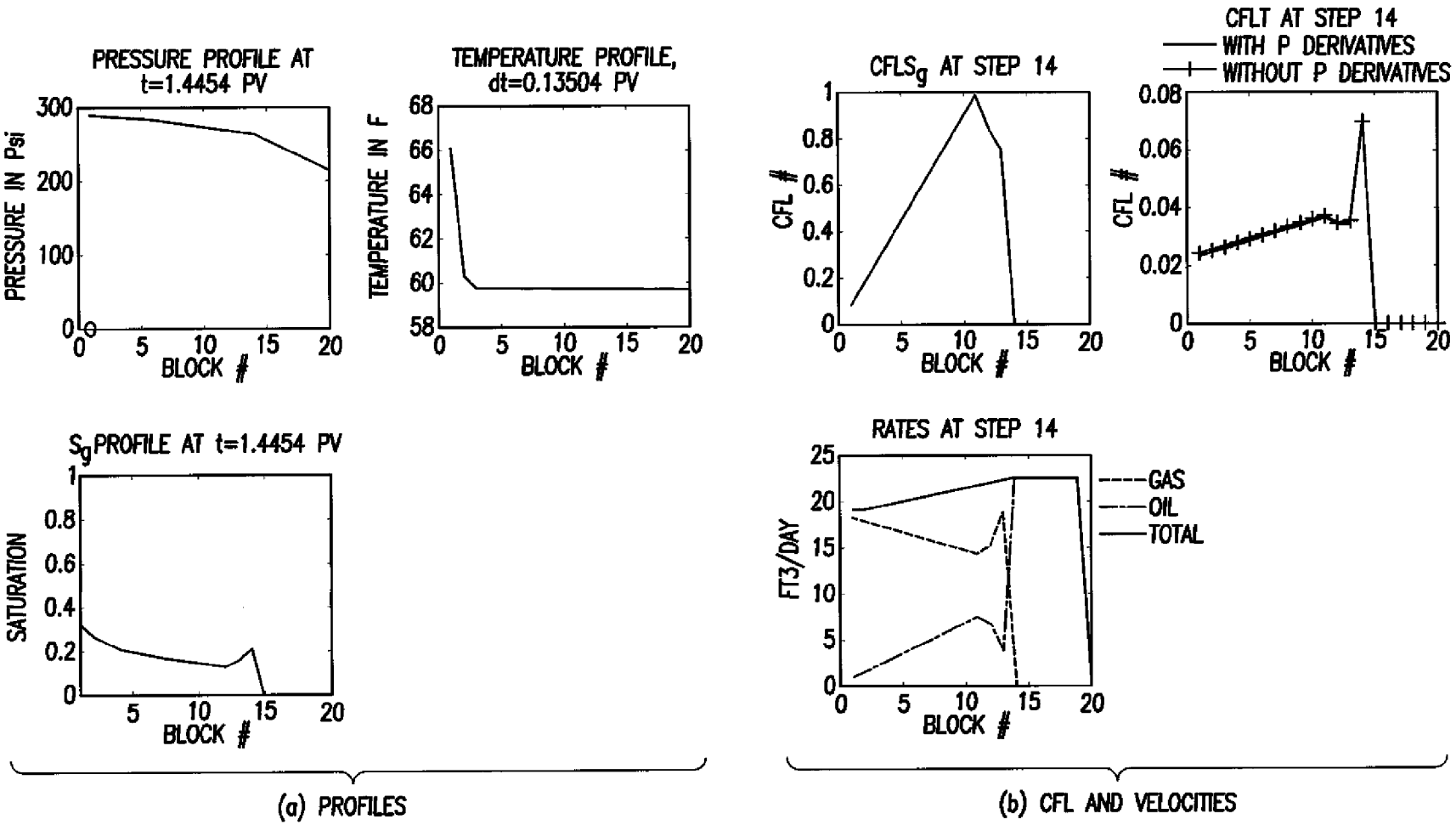

In FIG. 19, the saturation starts to oscillate after 8 steps at 1.1 CFLS (no problem at CFLS). As a remark, if at this state time step is controlled at a value less than 1, then the oscillation is damped. However, the solution has been deteriorated and differs from the FI solution.

Test CFLT

Figure 20:
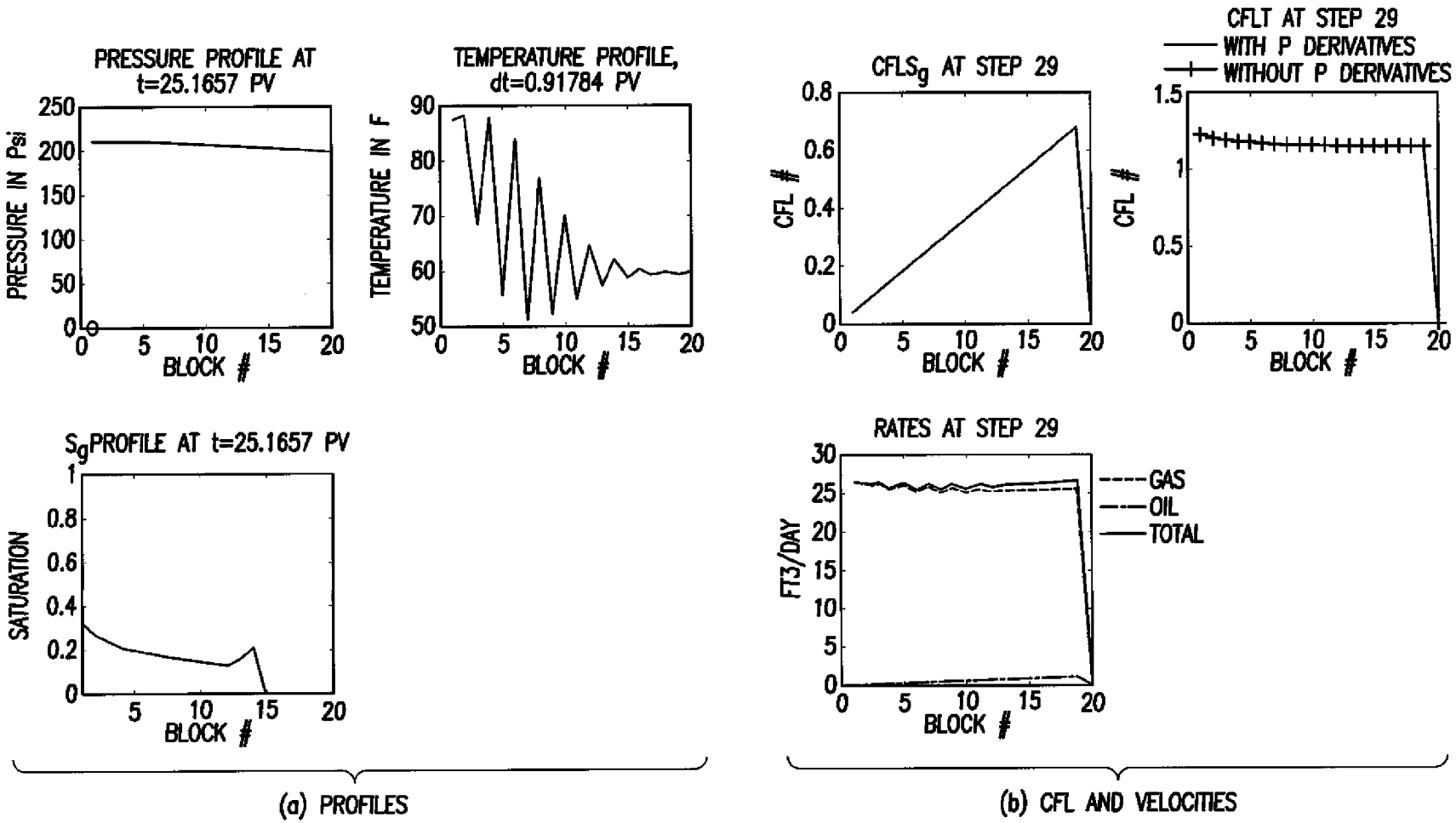

In order to study the effect of the CFLT, the heat conductivity has been un-physically increased from 25 to 2000 Btu/ft/day/degF. In this case, CFLS goes up to 4 and CFLT up to 1.6 when the simulation is run in fully implicit. If a simulation run with an explicit in temperature is run at time step 1 CFLT, no oscillation is observed (no shown); however, when the time step is 1.2 CFLT, after 9 time steps the temperature profile is extremely oscillating. Worth noting is that all cells have CFLT=1.2 (flat profile), as depicted in FIG. 20. Further, it is observed that Sg is also oscillating in a non-linear manner (mostly through the viscosities temperature dependency).

Figure 21:
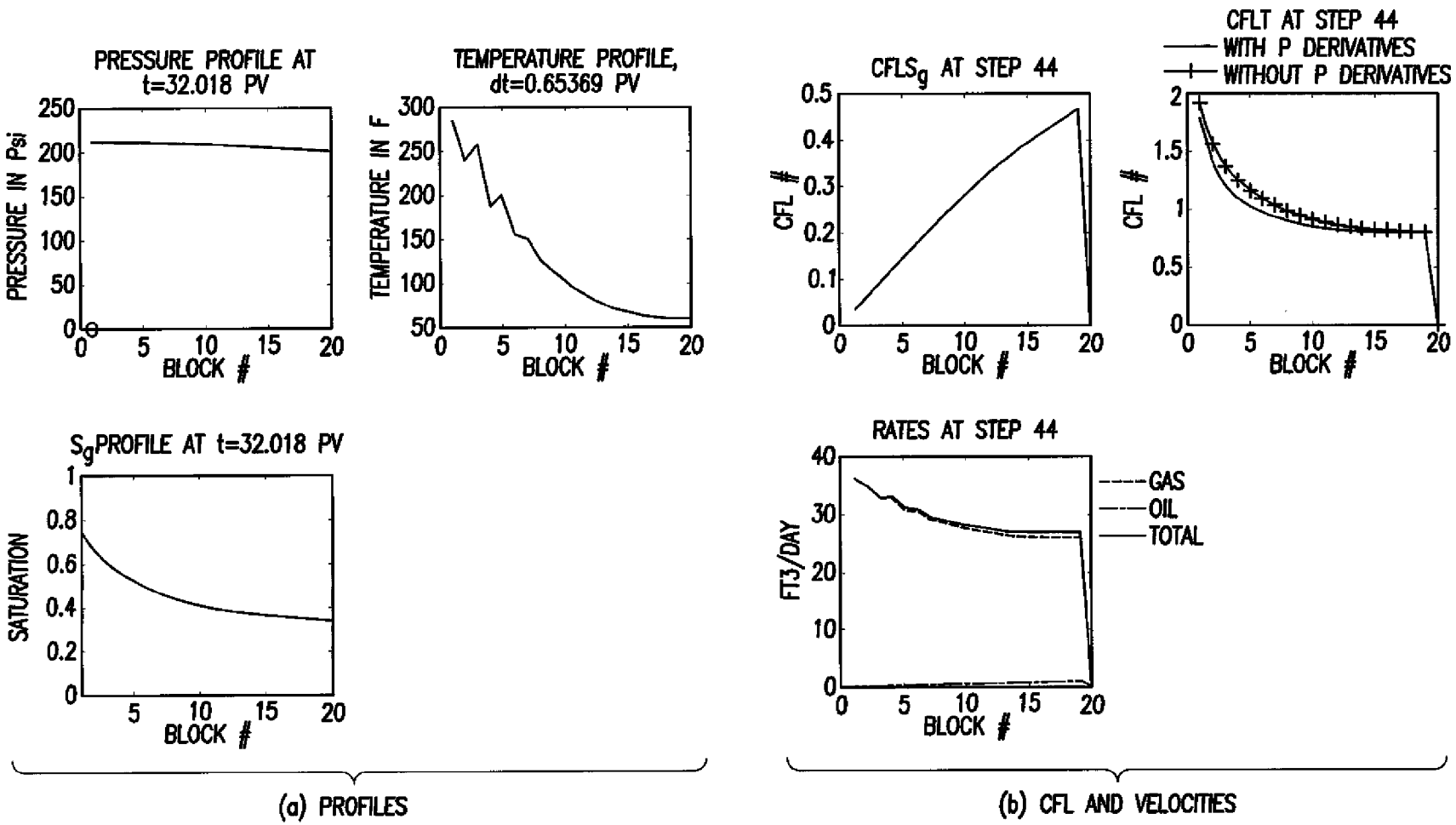
Figure 22:
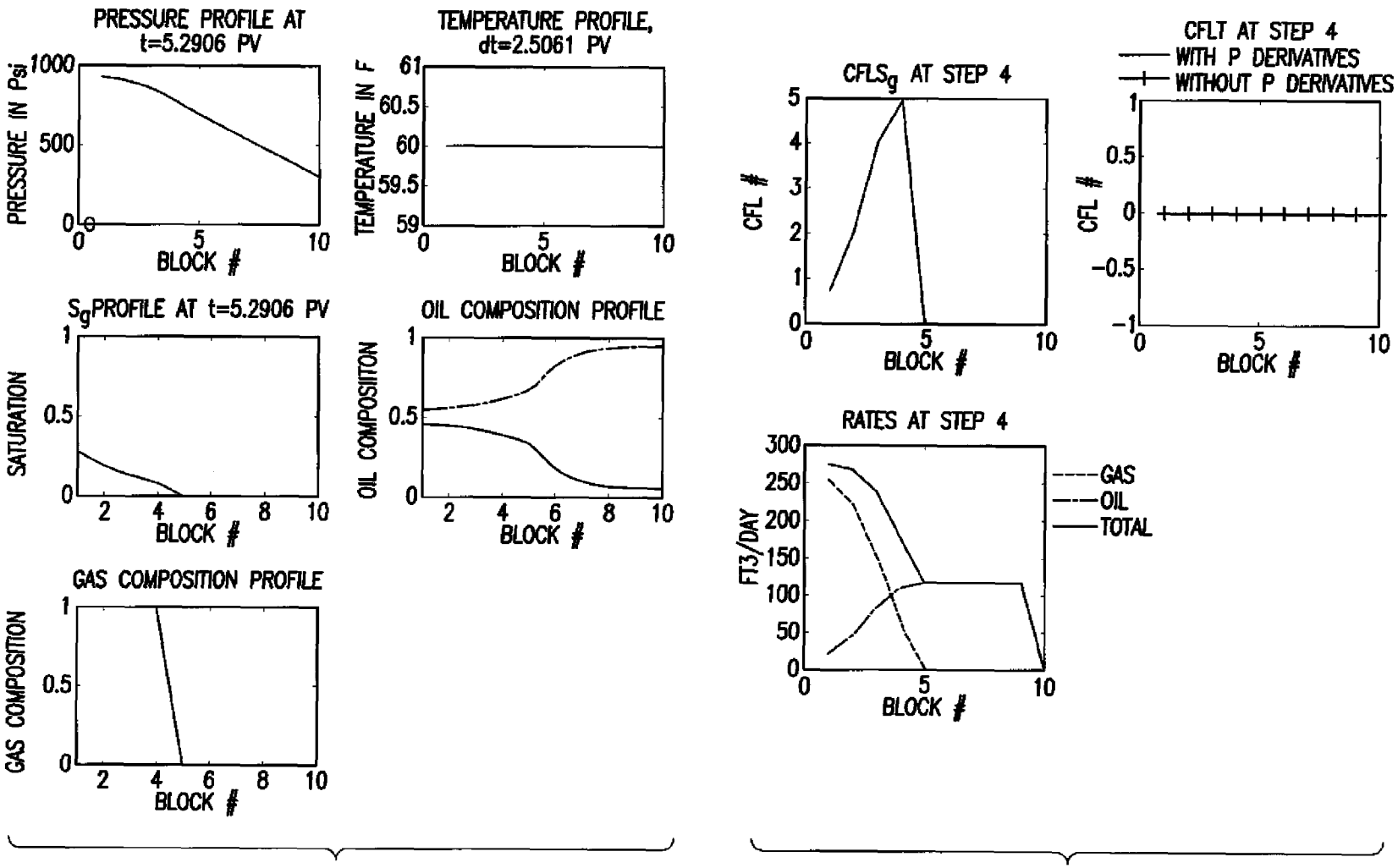

Another way of increasing the CFLT is by not increasing the heat conductivity but by decreasing the heat capacity. In this test case, the heat capacity is put at 0.35 instead of 35 Btu/ft3/degF. A fundamental assumption is that the partial derivative of $u_t$ with respect to t is approximately zero and stays reasonable even if the slight hook is larger than in the water/oil case (it goes from qt=35 ft3/d to 25 ft3/d). When the time step of the simulation is run with CFLT less than 1.4, then no an oscillation is observed. In FIG. 21, 10 time steps are needed prior to observing some oscillations starting to grow. Two notable points are: (1) in this case where only 3 cells are violated between 1 and 1.3, the oscillation effect seems less important and not as sharp as the case where all the cells are violating the CFLT; and (2) the oscillations are localized to the violating cells.

Water Injection in Dry-Gas Reservoir

The total velocity is having the same hook behavior when the T profile is changing and the CFLT values are the same regardless of whether or not the derivatives are neglected with respect to pressure.

Hot Gas Injection in Compositional Oil

Figure 23:
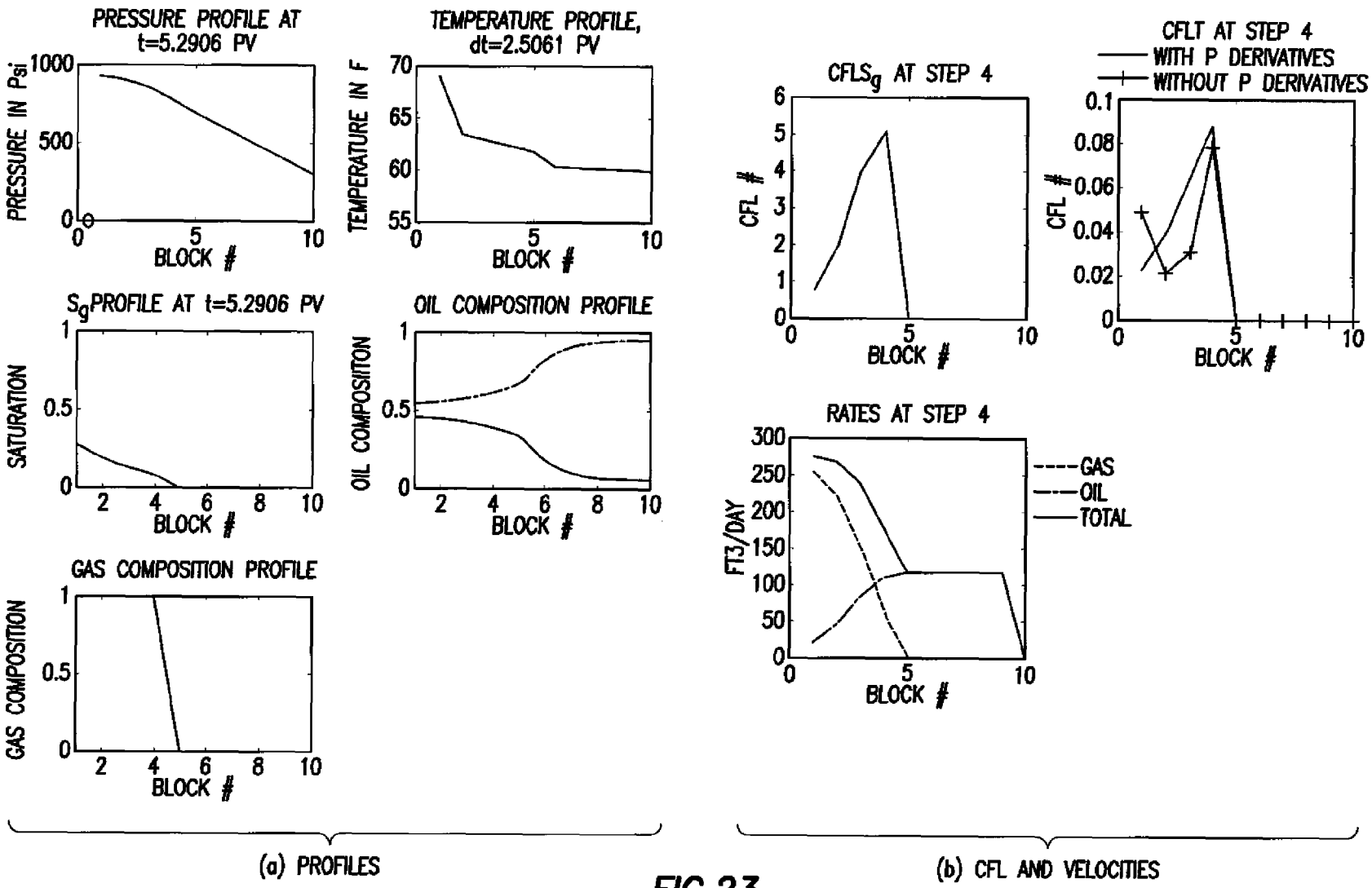
Figure 24:
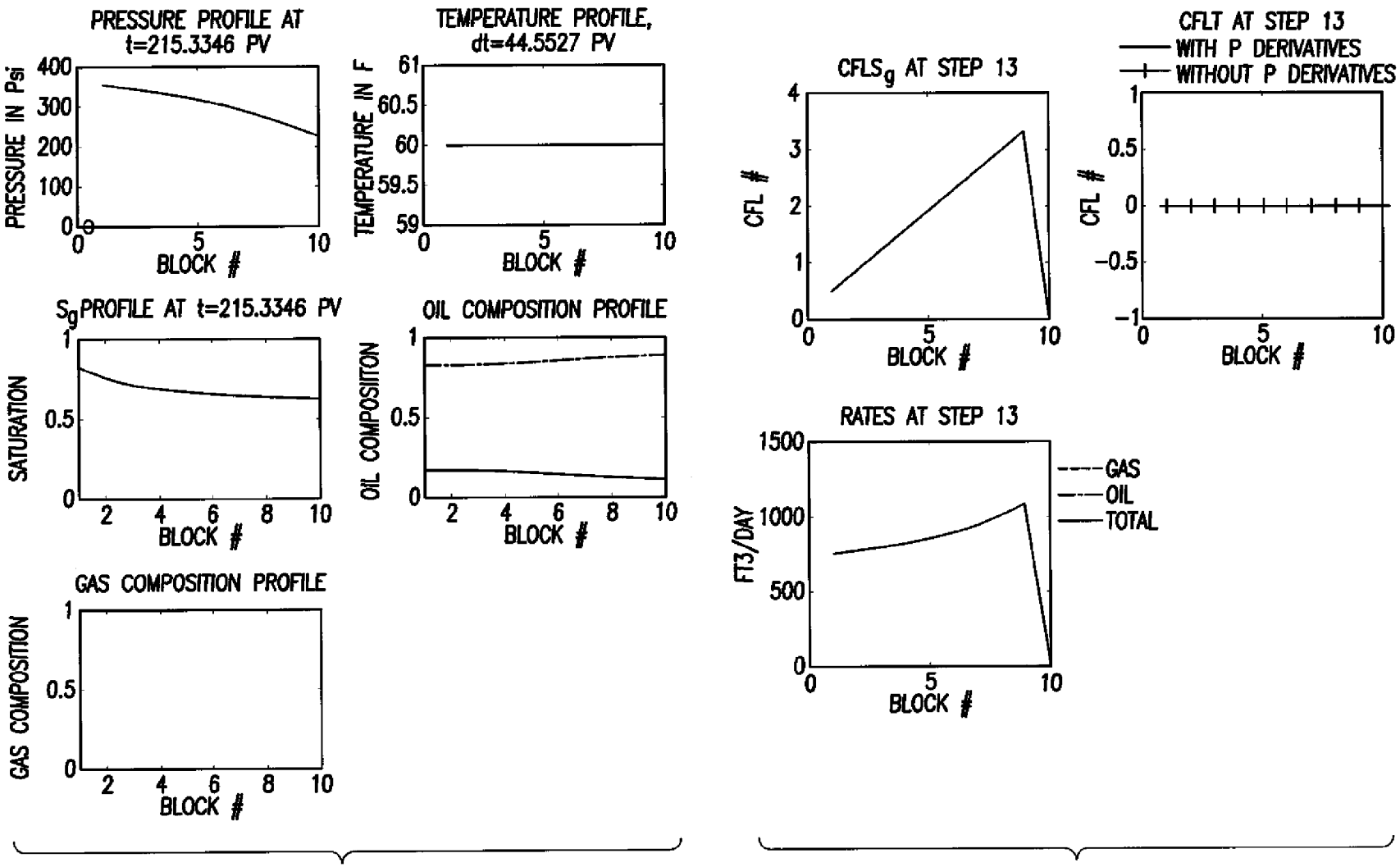
Figure 25:
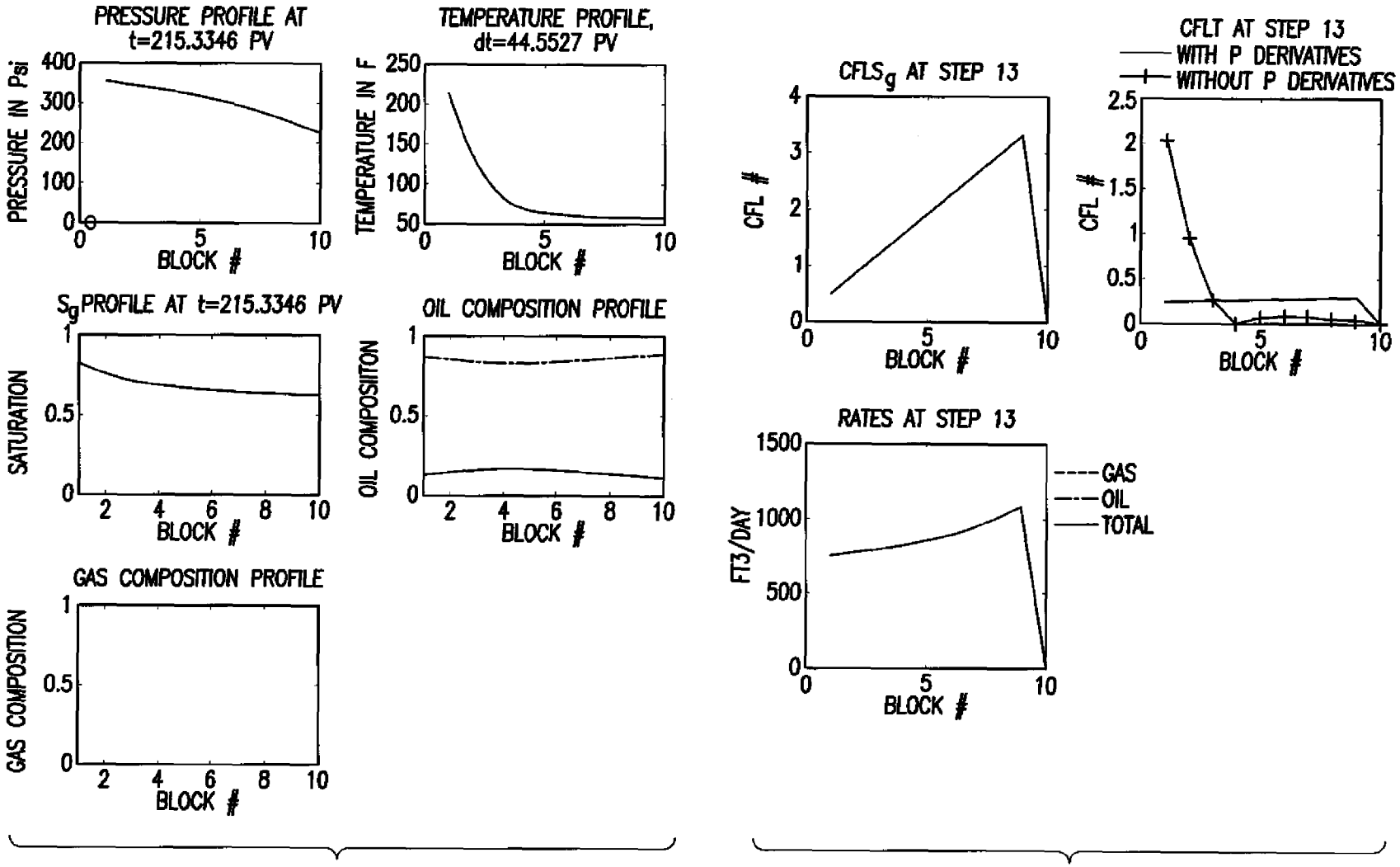
Figure 26:
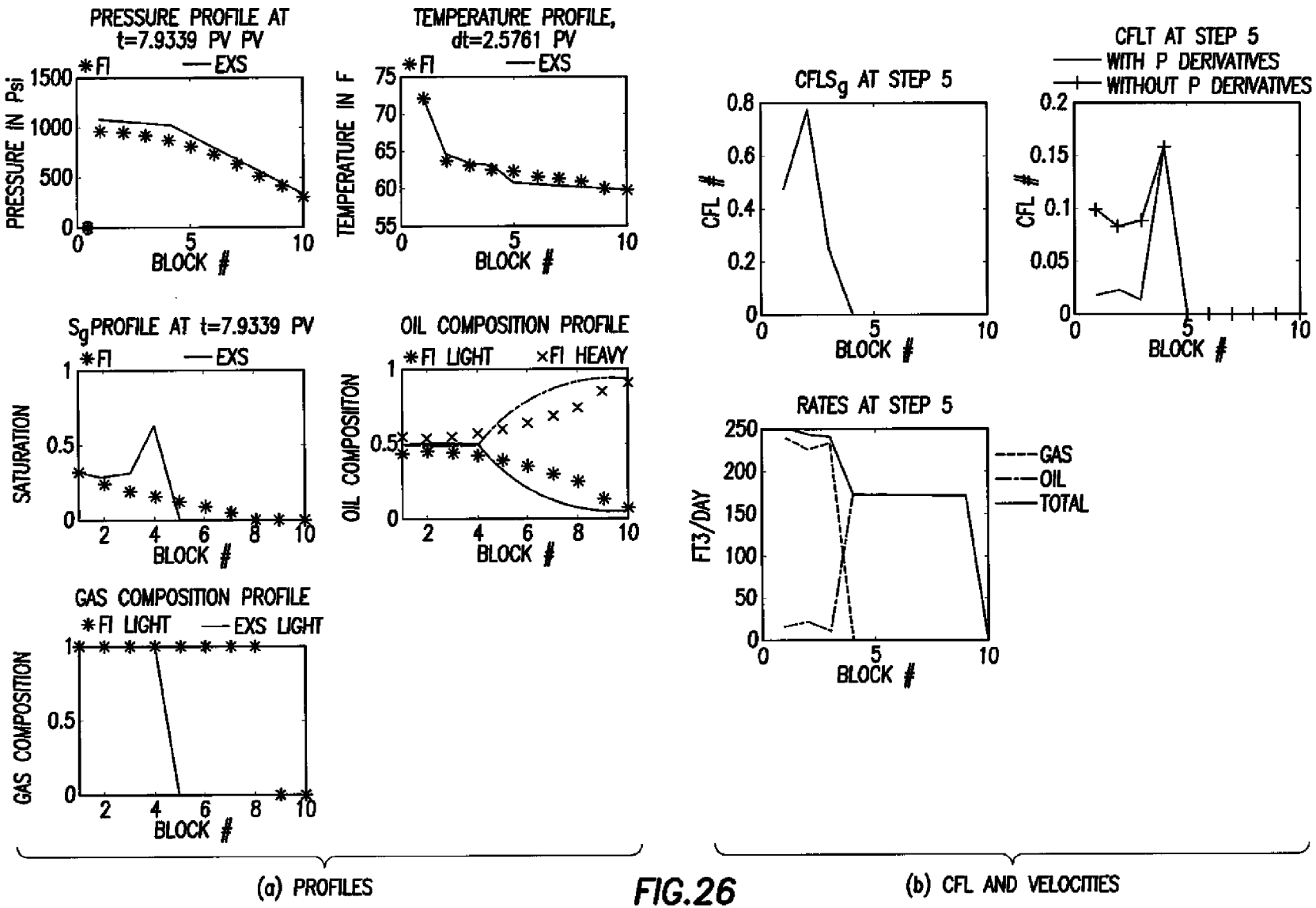

FIGS. 23 and 24 depict an isothermal and thermal injection of gas in a compositional oil reservoir at early times. In both cases, it is observed that the total velocity is changing and can vary from 100 ft3/day to 300 ft3/day. However, this changing velocity for the isothermal cases should not be an issue. At early times, the CFLS can go up to 5 whereas the CFLT stays below 0.1. FIGS. 25 and 26 depict the same runs at a later time when the gas has reached the producer. In that case, the total velocity is much larger but its spatial variation is quite flat. It has to be noticed that in the 2 situations (before or after breakthrough), the CFLS profile is not flat at all. Accordingly, by running just above the CFLS, only a few number of cells may be violated.

In addition, as a compositional run is not only the mass conservation equations but also the equilibrium constraints, it can be difficult to observe oscillations if the stability limit is only violated slightly. One skilled in the art will appreciate that:

(1) running at CFL always results in non-oscillatory stability;

(2) when CFL values are spatially uniform, the CFL criteria is very sharp (oscillations are observed when running simulations just above CFL); and (3) when CFL values are not uniform, it is more difficult to observe when the oscillations start and sometimes simulations must be run much above CFL to observe the oscillations.

These effects are observed in the following tests where a simulation is run at time steps much higher than CFL=1 to depict oscillations in the profile. This is the case for the saturation tests. The very nice thing about the temperature CFL is that it can only be of interest when conduction effects are important. This means that the CFLT values always enjoy a good spatial uniformity and the criteria are extremely sharp in practice.

CFLS before Breakthrough

It is quite a challenge to run a test case exactly at the desired CFL value due to the large dependency of Sg on the composition. When the simulation is run with an explicit saturation at t=1 CFLS, a solution in agreement with the fully implicit solution results. Running at 1.2 CFLS or 1.5 CFLS is very difficult because one time step is observed above CFLS and the next one below CFLS. With this situation, it not possible to assess the stability. However, it seems that the saturation is a slightly diverging from the fully implicit solution. FIG. 26 depicts the difference between a fully implicit run and an explicit in saturation run at 2 CFLS after the first time step. The converging time step in itself is less than CFLS (0.8 CFLS) but 2 CFLS has been reached in the successive Newton iterations. An extremely large oscillation is observed in the saturation profile.

CFLS after Breakthrough

Figure 27:
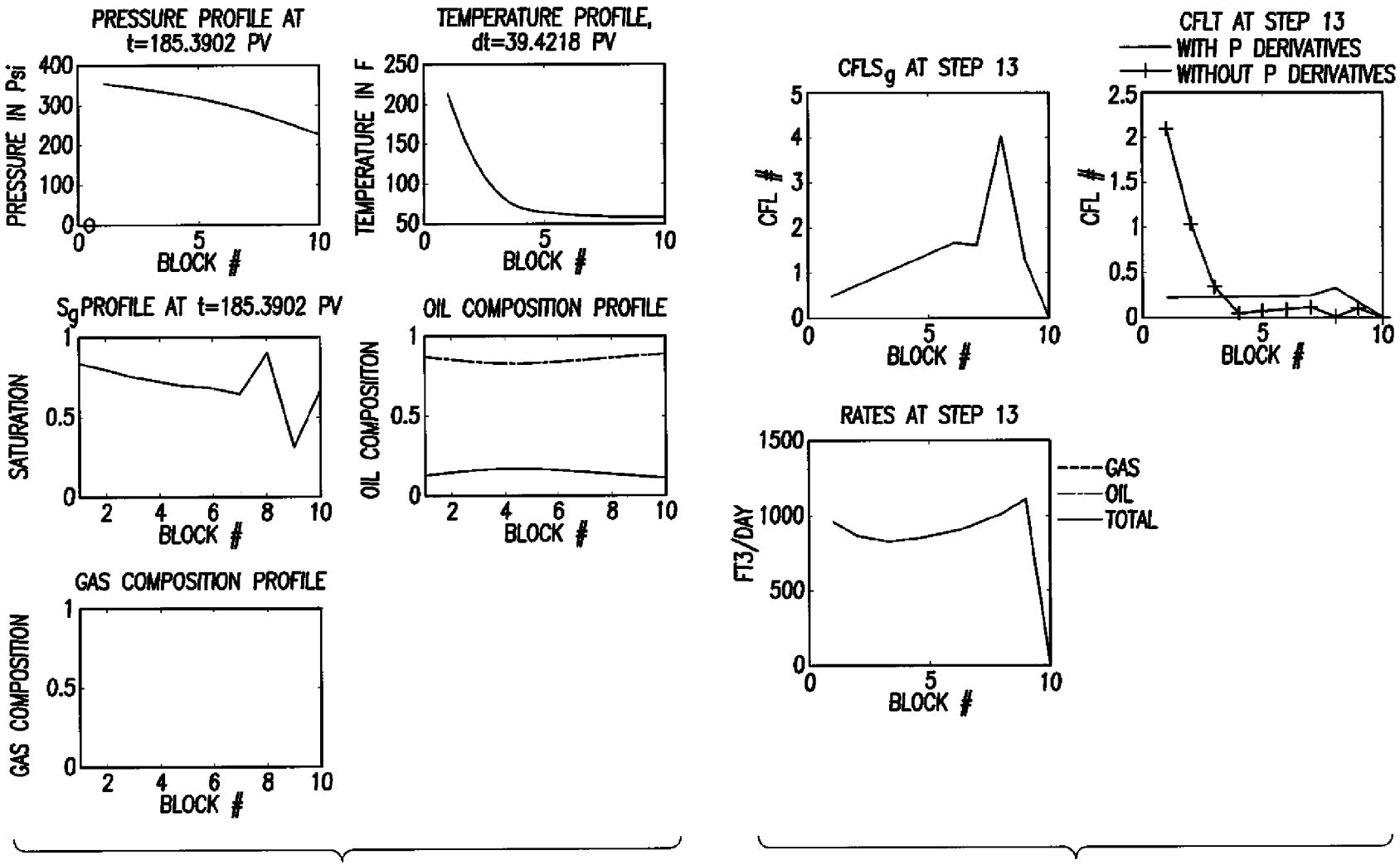
Figure 28:
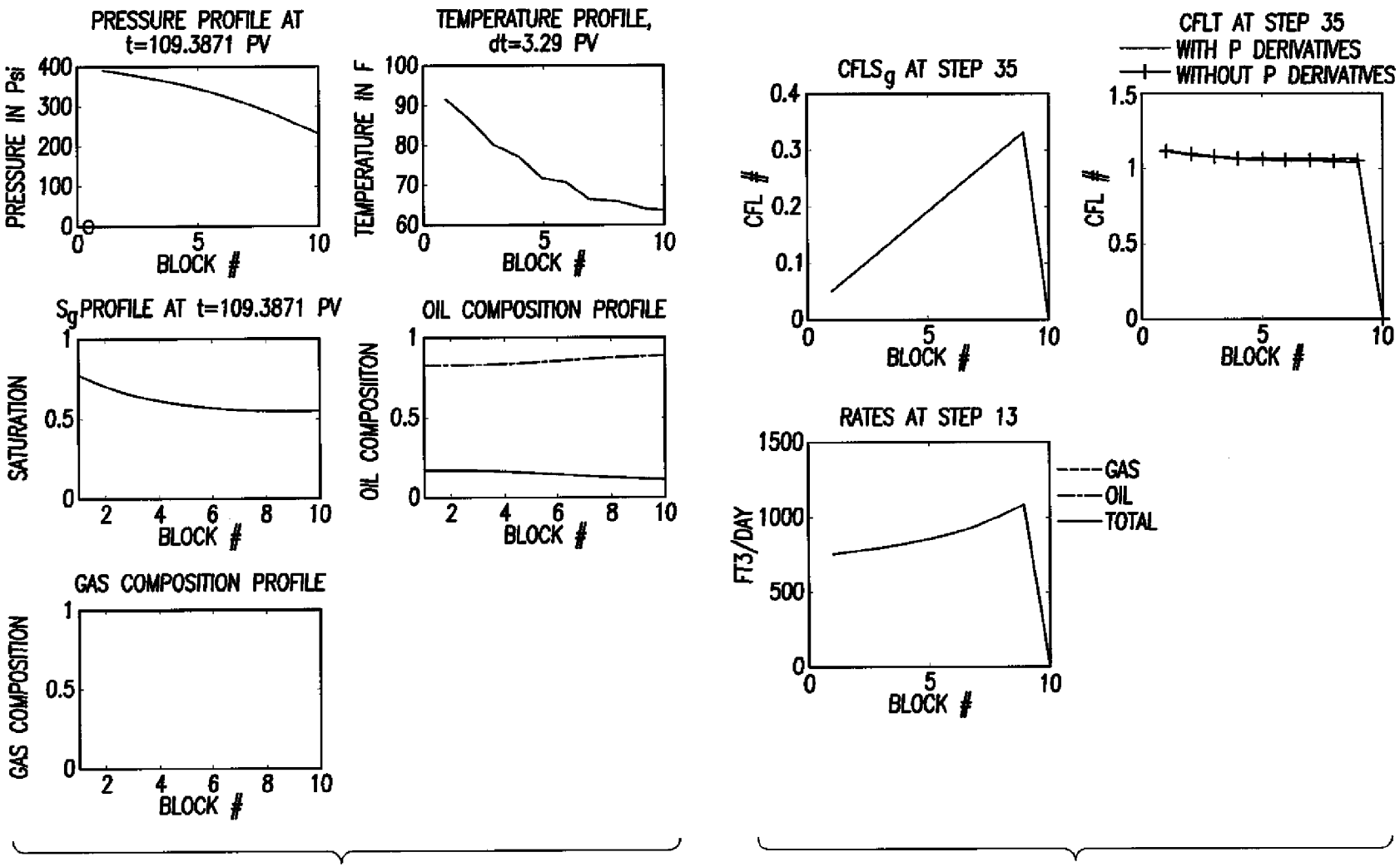

In this case, it seems even more difficult to observer an oscillating saturation profile. In FIG. 27, a case simulation run with 4 CFLS is depicted.

Test CFLT

Figure 29:
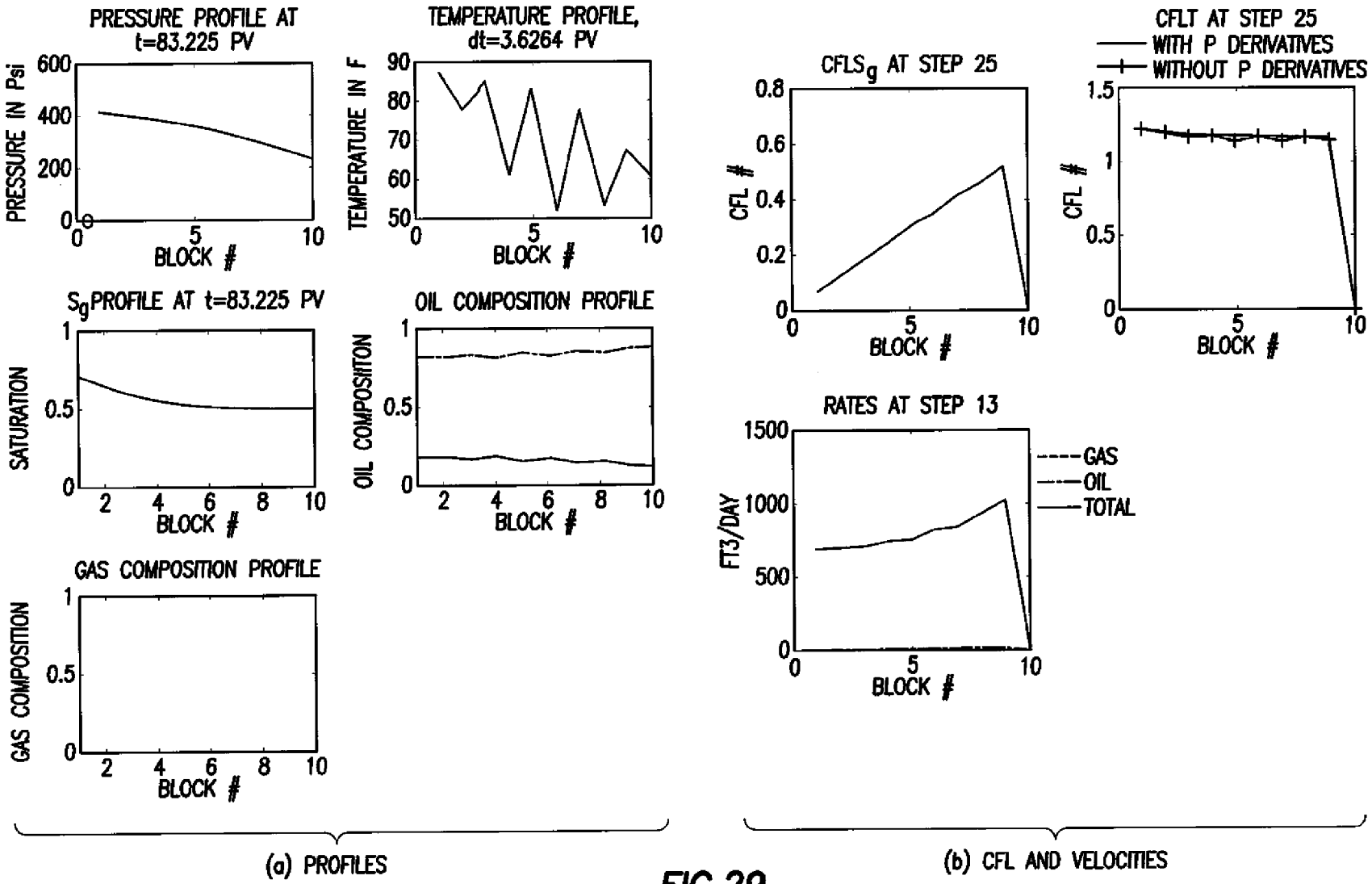

In the two former thermal cases, CFLT was always below 1 so the heat conductivity is increased to 5000 Btu/ft/day/degF. to have CFLT values above 1 in the fully implicit run. For the case after breakthrough, the explicit in temperature simulation run at 1 CFLT gives the same values than the fully implicit and for the simulation run at 1.1 CFLT, oscillations after 5 time steps are observed (see FIG. 28). FIG. 29 depicts the same simulation run performed at 1.2 CFLT with dramatic oscillations (oscillations appear from first time step). As a result, the CFLT is extremely sharp, much sharper than the CFLS. These results are in agreement with Coats' conclusions when the CFL values are uniform through the grid.

Tests on Fully Physics System

Figure 30:
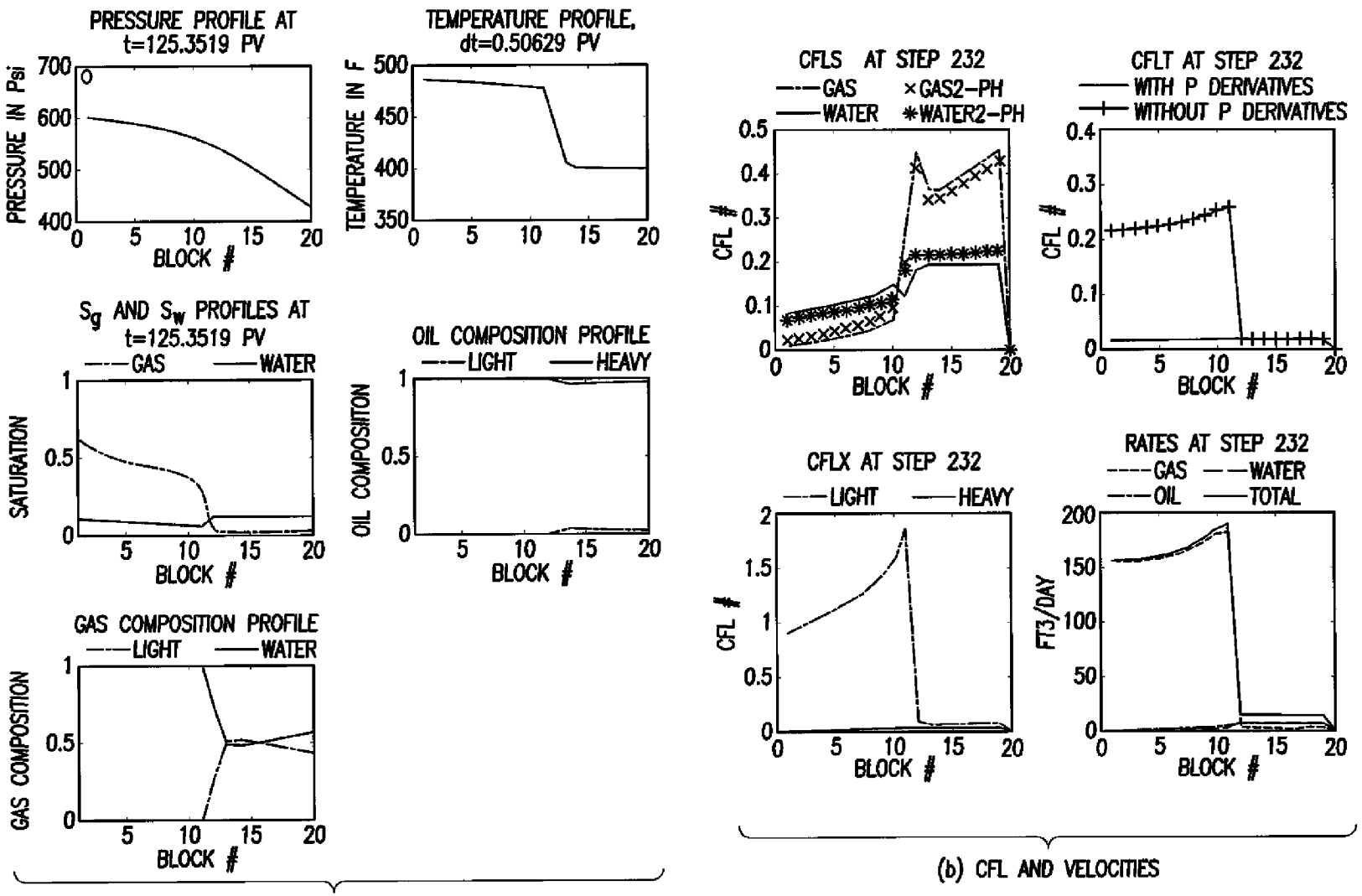

In this case, a full physics system is built. Steam and water are now injected at a steam quality of 80%. In FIG. 30, a reservoir undergoing steam injection can be viewed almost like two connected reservoirs, one being the group of cells that contains mobile steam and the other being the group of cells that contains only a hydrocarbon and perhaps immobile steam. In this test, the system will be shocked when one of the cells of the second type finally achieves mobile steam saturation, and the steam attempts to flow (rapidly) out of the cell under the existing large pressure gradient. If you are able to control the large changes in the state of this cell, it should now become a member of the group of steam containing cells, connected to other such cells with a much smaller pressure gradient than previously. The model undergoes a succession of shocks as mobile steam spreads across the grid. Despite the fact that the total velocity is very different, it can be considered constant in each reservoir. In this fully implicit case, CFLSg goes up to 15 and CFLT around 0.5.

Test CFLS

Figure 31:
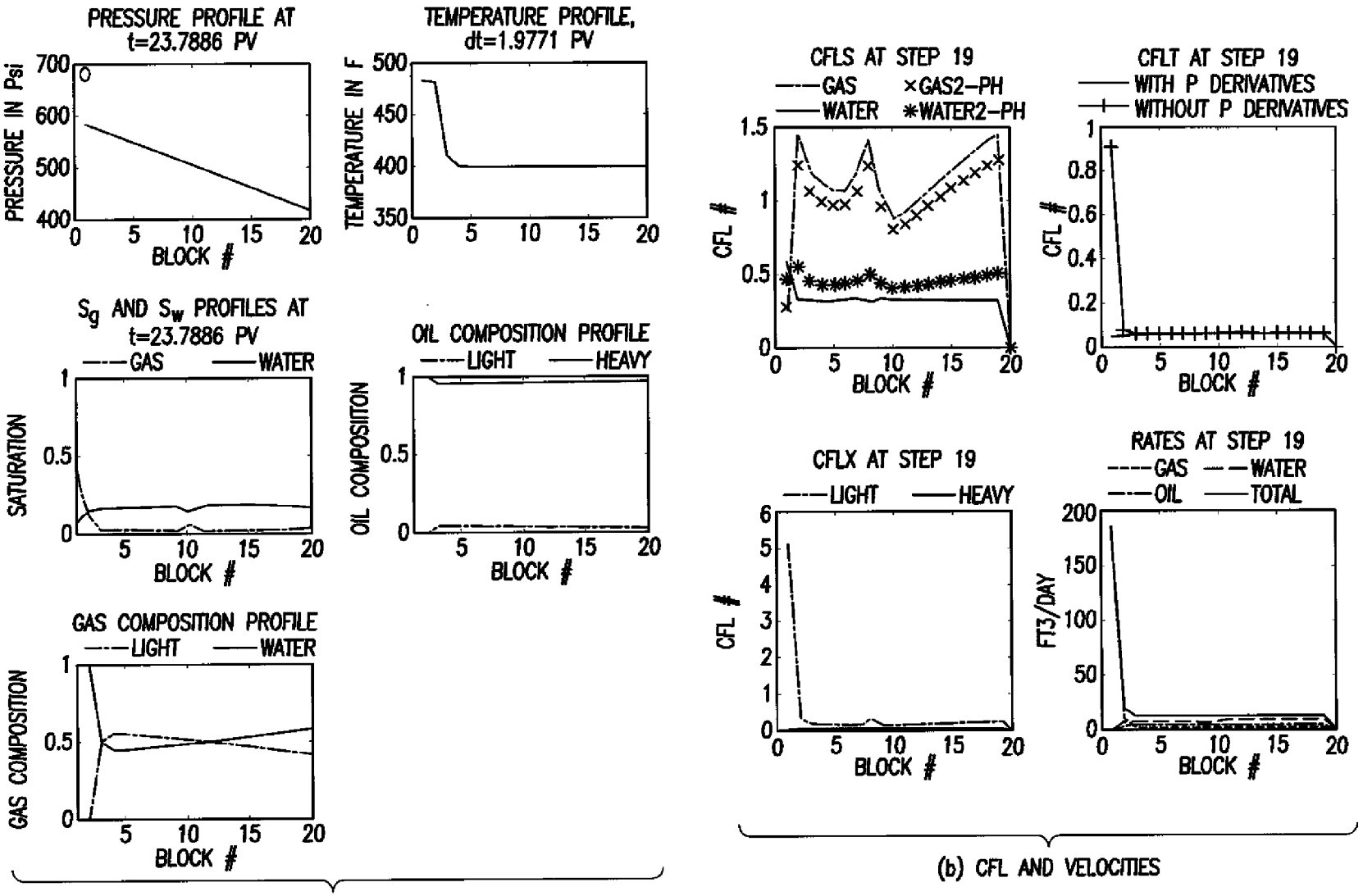

When it is run at CFLSg, there is no issue. Run at 1.2 CFLSg: the beginning of the run is controlled by the CFLSg in the last cells where some gas is forming by the depletion. However, no oscillation is observed. This may be due by the fact Sg is very close to 0 and not really changing. Then, gas starts to form in the first cells, then dt is controlled by the CFLSg of the first cells. A little riddle in Sg is seen traveling along the model. In FIG. 31, the case for CFLSg=1.5 is plotted where 3 cells are observed that have CFLSg between 1 and 1.3 creating a large wave traveling along the model.

Test CFLT

The CFLT stability cannot be assessed with the current values, so the heat conductivity is increased at 2500 instead of 25 Btu/ft/day/degF. A simulation of the same case as before is run and a case with initial gas at Sg=0.3 (50% water, 50% HC) is also run. The results are the same for both and presented for Sg initial=0.3 only. When the simulation is run at CFLT, the same profile as FI (CFLT profile flat) is observed. At 1.2 CFLT, oscillations are observed after 23 time-steps but the oscillations never fully grow.

Figure 32:
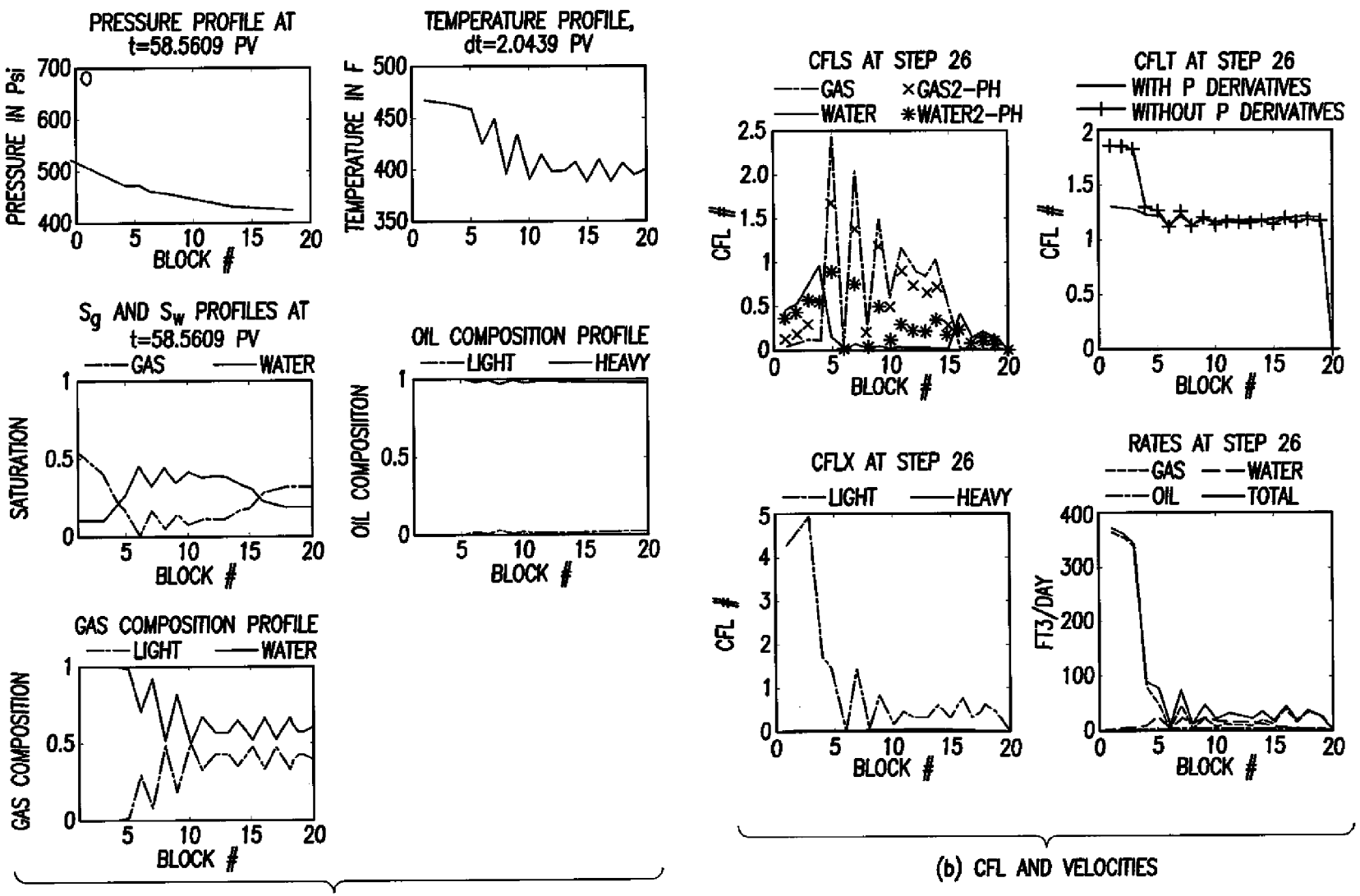
Figure 33:
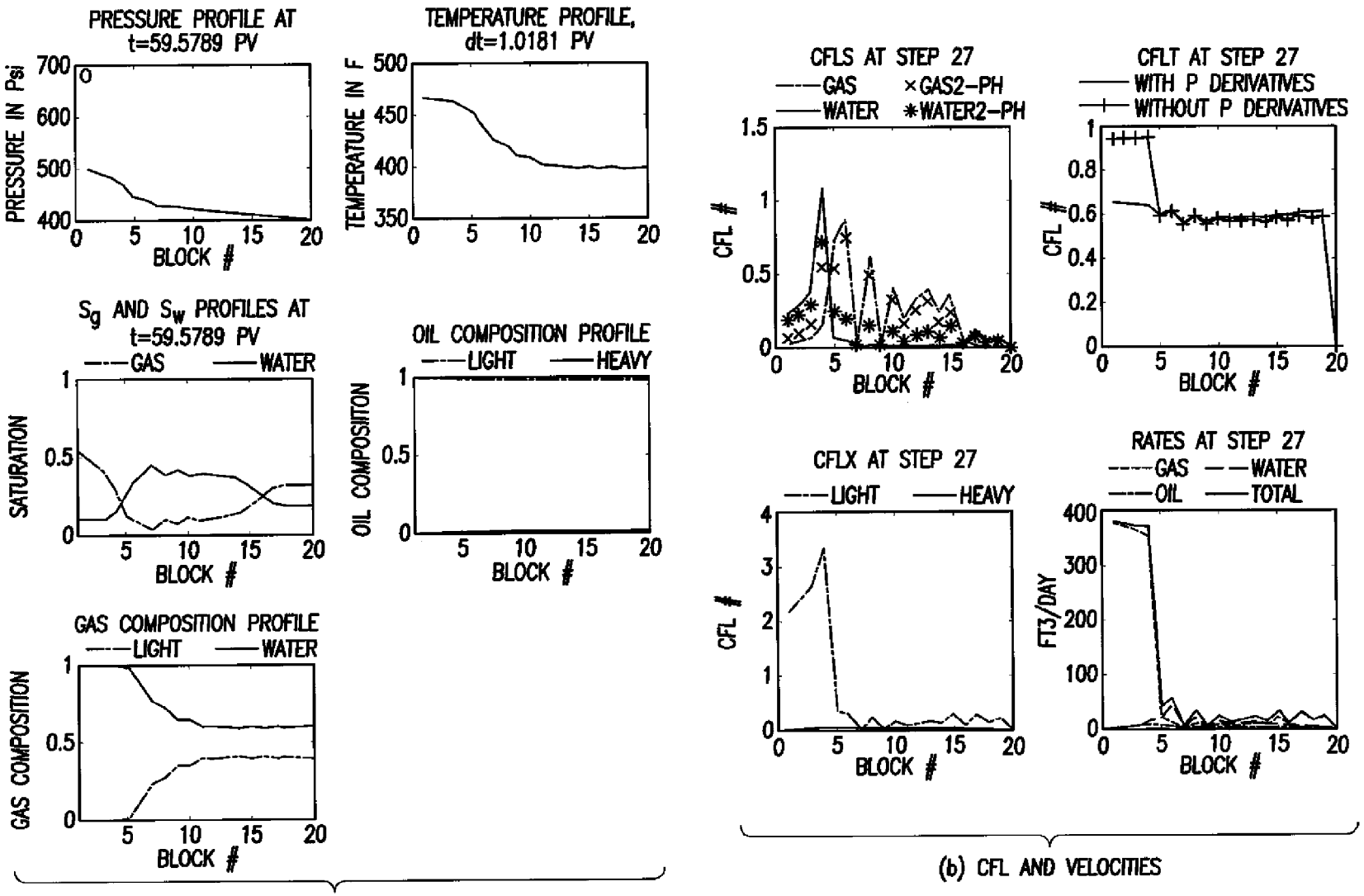

FIG. 32 depicts the profiles for the simulation at 1.3 CFLT. Oscillation is observed after 7 time-steps and they grow to large oscillations. As a remark, when the simulator reaches a point where it cannot converge at 1.3 CFLT, the simulator attempts to divide the time step by 2 (i.e. run at 0.65 CFLT) and it is observed that the temperature profile is smoothed out in this one time step by 2 (i.e. run at 0.65 CFLT) and it is observed that the temperature profile is smoothed out in this one time step (see FIG. 33). After that, if attempts are again made to violate above CFLT, the large oscillations come back directly.

The steps of portions or all of the process may be repeated as desired. Repeated steps may be selectively performed until satisfactory results achieved. For example, steps may be repeated after adjustments are made. This may be done to update the simulator and/or to determine the impact of changes made.

It will be understood from the foregoing description that various modifications and changes may be made in the preferred and alternative embodiments of the present invention without departing from its true spirit. For example, the simulators, time steps and a preferred percentage of cells modeled using IMPES method may be selected to achieve the desired simulation. The simulations may be repeated according to the various configurations, and the results compared and/or analyzed.

This description is intended for purposes of illustration only and should not be construed in a limiting sense. The scope of this invention should be determined only by the language of the claims that follow. The term "comprising" within the claims is intended to mean "including at least" such that the recited listing of elements in a claim are an open group. "A," "an" and other singular terms are intended to include the plural forms thereof unless specifically excluded.

While the invention has been described with respect to a limited number of embodiments, those skilled in the art will appreciate that other embodiments can be devised which do not depart from the scope of the invention as disclosed herein. Accordingly, the scope of the invention should be limited only by the attached claims.

What is claimed is:

1. A method of performing an oilfield operation of an oilfield having at least one wellsite, each wellsite having a wellbore penetrating a subterranean formation for extracting fluid from an underground reservoir therein, the method comprising:

determining a time-step for simulating the reservoir using a reservoir model, the reservoir being represented as a plurality of gridded cells and being modeled as a multi-phase system using a plurality of partial differential equations;

calculating, by a computer processor, a plurality of Courant-Friedrichs-Lewy (CFL) conditions of the reservoir model corresponding to the time-step, the plurality of CFL conditions being calculated for each of the plurality of gridded cells and comprising a temperature CFL condition, a composition CFL condition, and a saturation CFL condition, the temperature CFL condition being calculated based on a thermal simulator;

simulating, by the computer processor, a first cell of the plurality of gridded cells using the thermal simulator with an Implicit Pressure, Explicit Saturations (IMPES) system to obtain a first simulation result, the first cell having no CFL condition of the plurality of CFL conditions with a value greater than one;

simulating, by the computer processor, a second cell of the plurality of gridded cells using the thermal simulator with a Fully Implicit Method (FIM) system to obtain a second simulation result, the second cell having at least one CFL condition of the plurality of CFL conditions with a value greater than one; and performing the oilfield operation based on the first and second simulation results.

2. The method of claim 1, wherein calculating the plurality of CFL conditions comprises:

decoupling the plurality of partial differential equations by separating a temperature effect, a composition effect, and a saturation effect in the reservoir model to generate a plurality of decoupled equations; and calculating the temperature CFL condition, the composition CFL condition, and the saturation CFL condition concurrently using the plurality of decoupled equations.

3. The method of claim 1, wherein the multi-phase system has a plurality of phases and the reservoir model has no mass transfer among the plurality of phases, wherein calculating the plurality of CFL conditions comprises:

deriving a general temperature CFL expression to calculate the temperature CFL condition, the general temperature CFL expression being independent of a number of phases of the multi-phase system.

4. The method of claim 1, wherein performing the oilfield operation comprises:

preparing a forecast of the oilfield operation based on the first and second simulation results; and improving production from the reservoir based on the forecast.

5. The method of claim 1, wherein performing the oilfield operation comprises:

preparing a development plan of the oilfield operation based on the first and second simulation results.

6. The method of claim 1, wherein the time-step comprises at least one selected from a group consisting of a second, a minute, an hour, a day, a week, a month, and a year.

7. A method of performing an oilfield operation of an oilfield having at least one wellsite, each wellsite having a wellbore penetrating a subterranean formation for extracting fluid from an underground reservoir therein, the method comprising:

determining a time-step for simulating the reservoir using a reservoir model, the reservoir being represented as a plurality of gridded cells and being modeled as a multi-phase system using a plurality of partial differential equations, the multi-phase system having a plurality of phases;

calculating, by a computer processor, a plurality of Courant-Friedrichs-Lewy (CFL) conditions of the reservoir model corresponding to the time-step, the plurality of CFL conditions being calculated for each of the plurality of gridded cells and comprising a temperature CFL condition, a composition CFL condition, and a saturation CFL condition, wherein the temperature CFL condition comprises a convection term dependent on a phase volumetric rate and a conduction term dependent on a heat transmissibility;

simulating, by the computer processor, a first cell of the plurality of gridded cells using an Implicit Pressure, Explicit Saturations (IMPES) system to obtain a first simulation result, the first cell having no CFL condition of the plurality of CFL conditions with a value greater than one;

simulating, by the computer processor, a second cell of the plurality of gridded cells using a Fully Implicit Method (FIM) system to obtain a second simulation result, the second cell having at least one CFL condition of the plurality of CFL conditions with a value greater than one; and performing the oilfield operation based on the first and second simulation results.

8. The method of claim 7, wherein calculating the plurality of CFL conditions comprises:

decoupling the plurality of partial differential equations by separating a temperature effect, a composition effect, and a saturation effect in the first reservoir model to generate a plurality of decoupled equations; and calculating the temperature CFL condition, the composition CFL condition, and the saturation CFL condition concurrently using the plurality of decoupled equations.

9. The method of claim 7, wherein calculating the plurality of CFL conditions comprises:

deriving a general temperature CFL expression to calculate the temperature CFL condition, the general temperature CFL expression being independent of a number of phases of the multi-phase system.

10. The method of claim 7, wherein performing the oilfield operation comprises:

preparing a forecast of the oilfield operation based on the first and second simulation results; and improving production from the reservoir based on the forecast.

11. The method of claim 7, wherein performing the oilfield operation comprises:

preparing a development plan of the oilfield operation based on the first and second simulation results.

12. The method of claim 7, wherein the time-step comprises at least one selected from a group consisting of a second, a minute, an hour, a day, a week, a month, and a year.

13. A method of optimizing computer usage when performing simulations for a reservoir using a reservoir model wherein the reservoir model is gridded into cells, the method comprising:

a. determining a preferred percentage of cells to be simulated using an Implicit Pressure, Explicit Saturations (IMPES) system for optimizing computer usage;

b. determining a time-step for simulating the reservoir;

c. calculating, by a computer processor, Courant-Friedrichs-Lewy (CFL) conditions according to the time-step for each cell of the reservoir including calculating a temperature CFL condition, a composition CFL condition, and a saturation CFL condition, the temperature CFL condition being calculated based on a thermal simulator;

d. calculating, by the computer processor, a percentage of cells having no CFL condition greater than one;

e. determining, using the computer processor, whether the percentage calculated from step d is equal to or greater than the preferred percentage and if not, reducing the time-step and returning to step c; and f. simulating, by a computer processor, all cells having no CFL value greater than one using the thermal simulator with the IMPES system and simulating all other cells using the thermal simulator with a Fully Implicit Method (FIM) system.

14. The method of claim 13, wherein step c comprises:

providing a plurality of partial differential equations to model the reservoir in the reservoir model, wherein the plurality of partial differential equations model a temperature effect, a composition effect, and a saturation effect;

separating the temperature effect, the composition effect, and the saturation effect to generate a plurality of decoupled equations; and computing the temperature CFL condition, the composition CFL condition, and the saturation CFL condition using the plurality of decoupled equations concurrently.

15. The method of claim 13, the reservoir being modeled as a multi-phase system using a plurality of partial differential equations, wherein step c comprises:

deriving a general temperature CFL expression to calculate the temperature CFL condition, the general temperature CFL expression being independent of a number of phases of the multi-phase system.

16. The method of claim 13, wherein the time-step comprises at least one selected from a group consisting of a second, a minute, an hour, a day, a week, a month, and a year.

17. A computer system with optimized computer usage when performing simulations for an oilfield operation of an oilfield having at least one wellsite, each wellsite having a wellbore penetrating a subterranean formation for extracting fluid from an underground reservoir therein, the computer system comprising:

a processor;

memory;

and software instructions stored in memory to execute on the processor to:

a. determine a preferred percentage of cells to be simulated using an Implicit Pressure, Explicit Saturations (IMPES) system for optimizing computer usage;

b. determine a time-step for simulating the reservoir;

c. calculate Courant-Friedrichs-Lewy (CFL) conditions according to the time-step for each cell of the reservoir model including calculating a temperature CFL condition, a composition CFL condition, and a saturation CFL condition, wherein the temperature CFL condition comprises a convection term dependent on a phase volumetric rate and a conduction term dependent on a heat transmissibility;

d. calculate a percentage of cells having no CFL condition with a value greater than one;

e. determine whether the percentage calculated from step d is equal to or greater than the preferred percentage and if not reducing the time-step and returning to step c; and f. simulate all cells having no CFL value greater than one using the IMPES system and simulating all other cells using a Fully Implicit Method (FIM) system.

18. The computer system of claim 17, wherein step c comprises:

providing a plurality of partial differential equations to model the reservoir in the reservoir model, wherein the plurality of partial differential equations model a temperature effect, a composition effect, and a saturation effect;

separating the temperature effect, the composition effect, and the saturation effect to generate a plurality of decoupled equations; and computing the temperature CFL condition, the composition CFL condition, and the saturation CFL condition using the plurality of decoupled equations concurrently.

19. The computer system of claim 17, wherein the time-step comprises at least one selected from a group consisting of a second, a minute, an hour, a day, a week, a month, and a year.

* * * * *